US009895284B2

(12) United States Patent
Henshue et al.

(10) Patent No.: US 9,895,284 B2
(45) Date of Patent: Feb. 20, 2018

(54) TACTILE WARNING SURFACE MOUNT PANEL FOR MOUNTING ON A PREFORMED GROUND SURFACE

(71) Applicant: Brandbumps, LLC, Madison, WI (US)

(72) Inventors: Christopher Gary Henshue, Verona, WI (US); Gary LaVerne Henshue, Madison, WI (US)

(73) Assignee: Brandbumps, LLC, Middleton, WI (US)

( * ) Notice: Subject to any disclaimer, the term of this patent is extended or adjusted under 35 U.S.C. 154(b) by 0 days.

(21) Appl. No.: 14/661,853

(22) Filed: Mar. 18, 2015

(65) Prior Publication Data

US 2015/0265491 A1 Sep. 24, 2015

Related U.S. Application Data

(60) Provisional application No. 61/954,924, filed on Mar. 18, 2014.

(51) Int. Cl.
*A61H 3/06* (2006.01)
*E01C 5/00* (2006.01)

(52) U.S. Cl.
CPC ..... *A61H 3/066* (2013.01); *E01C 5/001* (2013.01)

(58) Field of Classification Search
CPC ..... A61H 3/066; E01C 5/001
USPC ..... 404/34–36, 28, 42
See application file for complete search history.

(56) References Cited

U.S. PATENT DOCUMENTS

| | | | |
|---|---|---|---|
| 4,055,550 | A | 10/1977 | Panandiker |
| 4,080,087 | A | 3/1978 | Phillips |
| 4,109,439 | A | 8/1978 | Feasel |
| 4,275,189 | A | 6/1981 | Danick et al. |
| 4,395,529 | A | 7/1983 | Danick et al. |
| 4,715,743 | A | 12/1987 | Schmanski |
| 4,740,426 | A | 4/1988 | Tremper |
| 4,818,589 | A | 4/1989 | Johnson et al. |
| 5,006,612 | A | 4/1991 | Danick et al. |
| 5,034,275 | A | 7/1991 | Pearson et al. |
| 5,086,287 | A | 2/1992 | Nutzel |
| 5,217,319 | A | 6/1993 | Klohn |
| 5,271,690 | A | 12/1993 | Fennessy, Sr. |
| 5,302,049 | A | 4/1994 | Schmanski |

(Continued)

FOREIGN PATENT DOCUMENTS

| | | | |
|---|---|---|---|
| CA | 2560422 | A1 | 9/2005 |
| EP | 426896 | A1 | 9/1989 |
| WO | 03/12767 | A1 | 2/2003 |
| WO | 2013/050883 | | 4/2013 |

OTHER PUBLICATIONS

Supplementary Partial European Search Report, EP Patent Application No. 13747308.8, dated Sep. 11, 2015, six pages.

(Continued)

*Primary Examiner* — Raymond W Addie
(74) *Attorney, Agent, or Firm* — Casimir Jones S.C.

(57) ABSTRACT

Methods of installation, securement, removal and replacement of tactile warning surface mount plates/panels (TWSP's), preferably having at least a two color graphic design thereon, on pedestrian walkways, driveways, sidewalks, ramps, handicap ramps, retail floors and other types of existing preformed ground surfaces. The present invention includes TWSP's for both attention plates/panels and guiding plates/panels.

73 Claims, 64 Drawing Sheets

(56) References Cited

U.S. PATENT DOCUMENTS 5,303,493 A 4/1994 Plumly
5,303,669 A 4/1994 Szekely
5,320,790 A 6/1994 Lowe
5,363,579 A 11/1994 Plumly
5,403,637 A * 4/1995 Pickard ..... E01C 13/045 404/32
5,468,532 A 11/1995 Ho et al.
5,775,835 A 7/1998 Szekely
5,795,122 A 8/1998 Bowers
5,816,738 A * 10/1998 Harnapp ..... E01C 5/20 404/18
5,827,009 A 10/1998 Kokoletsos
5,992,888 A 11/1999 North
6,001,919 A 12/1999 Yen
6,015,469 A 1/2000 Fenzi
6,041,533 A 3/2000 Lemmond
6,103,003 A 8/2000 Burgess
6,136,126 A 10/2000 Fenzi
6,270,853 B1 8/2001 Brown et al.
6,335,749 B1 1/2002 Carizzoni et al.
6,387,504 B1 5/2002 Mushovic
6,450,728 B1 9/2002 Grahmbeek et al.
6,481,921 B1 11/2002 Fenimore et al.
6,490,773 B1 12/2002 Estes et al.
6,511,257 B1 * 1/2003 Seaux ..... E01C 9/086 404/34
6,576,074 B1 6/2003 Cabrera et al.
6,676,792 B1 1/2004 Fenzi
6,685,388 B2 2/2004 Webster et al.
6,692,182 B1 2/2004 Fenimore et al.
6,709,191 B1 3/2004 McCuskey
6,718,714 B1 4/2004 Montgomery
6,746,986 B1 6/2004 Sato et al.
6,769,530 B2 8/2004 Molinaro
6,775,937 B2 8/2004 Ruana
6,783,829 B2 8/2004 Arena
6,843,945 B1 1/2005 Lee et al.
6,883,430 B2 4/2005 Hollander
6,939,078 B1 9/2005 Anderson et al.
6,960,989 B1 11/2005 Grayson
6,964,244 B2 11/2005 Stockton
6,971,818 B1 12/2005 Schabacker
6,987,081 B2 1/2006 Sato et al.
6,998,005 B2 2/2006 Magee
7,001,103 B2 2/2006 Sippola
7,022,202 B2 4/2006 Goertzen
7,033,973 B2 4/2006 Fenzi
7,045,193 B2 5/2006 Tanei et al.
7,051,465 B2 5/2006 Slesinski
7,077,926 B2 7/2006 Goffi et al.
7,124,526 B2 10/2006 Keach
7,142,095 B1 11/2006 Grayson
7,189,025 B1 3/2007 Greer et al.
7,215,300 B1 5/2007 Reid
7,223,048 B1 5/2007 Greer
7,249,911 B2 7/2007 Hyams
7,267,281 B2 9/2007 Hopkins
7,302,981 B2 12/2007 Benetton
7,303,800 B2 * 12/2007 Rogers ..... B32B 3/02 404/34
7,339,547 B2 3/2008 Reid
7,351,003 B1 4/2008 Fenimore et al.
7,390,057 B2 6/2008 Autterson
7,631,450 B2 12/2009 Popowich
7,674,066 B2 3/2010 Wehmeyer
7,681,346 B2 3/2010 Bruce
7,690,862 B2 * 4/2010 Szekely ..... E01F 1/00 14/73
7,740,413 B1 6/2010 Grayson
7,753,616 B2 7/2010 Greer
7,758,279 B2 7/2010 Driscoll
7,779,581 B2 8/2010 Flaherty et al.
7,799,379 B2 9/2010 Julnes
7,810,538 B2 10/2010 Magee
7,827,928 B2 11/2010 Shaw
7,845,122 B2 12/2010 Sippola
7,866,104 B2 1/2011 Babinsky et al.
7,955,024 B2 6/2011 Driscoll et al.
8,002,938 B2 8/2011 Elwakil
8,010,408 B2 8/2011 Rubinstein
8,017,297 B1 9/2011 Davis
8,028,491 B2 10/2011 Flaherty et al.
D648,238 S 11/2011 Niver et al.
8,061,927 B1 * 11/2011 Martinez ..... E01C 9/086 15/94
8,082,872 B2 12/2011 Cook
8,088,306 B2 1/2012 Kim
8,146,302 B2 4/2012 Sippola
8,241,739 B2 8/2012 Schonfeld
8,261,497 B2 9/2012 Sippola
8,266,876 B1 9/2012 Thuesen
8,308,891 B2 11/2012 Drake
8,317,956 B2 11/2012 Greer
8,439,596 B1 * 5/2013 Dvoracek ..... E01C 5/20 404/19
8,534,009 B2 9/2013 Kay
9,010,060 B2 * 4/2015 Rapaz ..... E04C 2/34 428/133
2002/0019312 A1 2/2002 Ramsden
2003/0015274 A1 8/2003 Arena et al.
2003/0235468 A1 * 12/2003 Sproules ..... E01C 5/08 404/34
2004/0151899 A1 8/2004 Sato et al.
2004/0253373 A1 12/2004 Langlois
2005/0013662 A1 1/2005 Provenzano
2005/0031415 A1 2/2005 Sippola
2005/0066623 A1 3/2005 Sippola
2005/0079330 A1 4/2005 Tanel
2005/0098086 A1 5/2005 Moore
2005/0265782 A1 12/2005 Everett
2006/0024132 A1 2/2006 Seman
2006/0039752 A1 2/2006 Hyams
2006/0157370 A1 7/2006 Thuesen
2006/0174567 A1 8/2006 Sippola
2006/0245827 A1 11/2006 Rydin
2007/0201949 A1 8/2007 Veldboom et al.
2007/0224343 A1 9/2007 Langlois
2007/0258255 A1 11/2007 Kessler et al.
2007/0269264 A1 * 11/2007 Boghossian ..... A61H 3/066 404/19
2008/0008526 A1 1/2008 Boghossian
2008/0095576 A1 * 4/2008 Donald ..... E01C 5/00 404/34
2008/0107481 A1 5/2008 Donald
2008/0132865 A1 6/2008 Li et al.
2008/0230941 A1 9/2008 Williamson
2008/0236064 A1 10/2008 Sippola
2008/0280097 A1 11/2008 Flaherty
2010/0129150 A1 5/2010 Sippola
2010/0186311 A1 7/2010 Jun
2010/0229783 A1 9/2010 Szekely
2010/0266782 A1 10/2010 Langlois
2010/0286644 A1 11/2010 Li et al.
2010/0313502 A1 12/2010 Flaherty
2011/0179728 A1 7/2011 Cerny et al.
2011/0185961 A1 8/2011 Flaherty
2011/0311721 A1 12/2011 Langlois
2012/0076579 A1 3/2012 Flaherty et al.
2012/0207543 A1 8/2012 Sippola
2012/0272597 A1 11/2012 Hilburn, Jr.
2012/0275858 A1 11/2012 Szekely et al.
2013/0212046 A1 8/2013 Henshue et al.
2013/0318844 A1 12/2013 Duhaime Ohnstad
2014/0270945 A1 * 9/2014 Bach ..... E01C 5/20 404/36

OTHER PUBLICATIONS

International Search Report and Written Opinion, International Patent Application No. PCT/US2015/021281, dated Jun. 23, 2015.

(56) References Cited

OTHER PUBLICATIONS

International Search Report and Written Opinion dated Jun. 25, 2013, PCT/US13/25574.

* cited by examiner

TACTILE WARNING SURFACE MOUNT PANEL FOR MOUNTING ON A PREFORMED GROUND SURFACE

CROSS REFERENCE TO RELATED APPLICATIONS

This application claims the benefit of the U.S. Provisional Application 61/954,924, filed on Mar. 18, 2014, the entire contents of which are incorporated herein by reference.

FIELD OF THE INVENTION

The present invention relates to the means and methods of installation, securement, removal and replacement of tactile warning surface mount plates/panels (TWSP's), preferably having at least a two color graphic design thereon, on pedestrian walkways, driveways, sidewalks, ramps, handicap ramps, retail floors and other types of existing preformed ground surfaces. The present invention includes TWSP's for both attention plates/panels and guiding plates/panels.

BACKGROUND OF THE INVENTION

There are numerous ways to secure to existing preformed ground surfaces objects, fixtures, structures, plates, panels, beams and other items using many different types of fastening systems and/or fasteners. The existing preformed ground surfaces could be made out of concrete, asphalt, brick, tile or many other types of materials. Most ground surface fastening systems and/or fasteners used for these types of existing preformed ground surfaces, secure the objects and/or fixtures to the ground surface semi-permanently or permanently. The objects and/or fixtures that these types of ground surface fastening systems/fasteners secure are not made to be removed frequently.

There is a marketplace need to have a fastening system or fastener which secures objects to the existing preformed ground surface, as well as, allows the object and/or fixture to be efficiently and frequently removed without having to replace the entire fastening system or fastener(s). An example of this type of application is a tactile warning surface mount plate and/or panel (TWSP). In the United States TWSP products for the visually impaired are called tactile warnings, tactile warning panels, detectable warnings, detectable warning panels or truncated domes. Tactile warnings were required in 1991 by the Americans with Disabilities Act (ADA). The ADA mandated that municipalities, governmental bodies, commercial/public buildings, shopping centers, transit platforms, loading docks, etc. utilize tactile warning panels.

A tactile warning panel is a distinctive surface pattern of domes (three-dimensional) detectable by cane or underfoot and are used to alert people with visual impairments of their approach to hazardous vehicular situations and hazardous drop-offs. The visually impaired rely on a combination of visual cues (color contrast), tactile cues (sweeping cane, sole of shoes, wheelchairs and walker wheels) and audio cues (sound) in order to identify these hazardous areas. Tactile warning panels are secured by different means to ground surfaces such as concrete pavement, asphalt pavement, sidewalks, pedestrian walkways and transit platforms. Currently, the majority of tactile warning panels (both attention and guiding patterns) are installed in fresh and/or wet set concrete or asphalt (at the time the concrete is poured or the asphalt is laid). These tactile warning panels most prevalently have a frame or fastening system on the underside of the tactile surface that gets permanently embedded into the moldable fresh and/or wet concrete or asphalt.

Tactile warning panel products having a replaceable top feature still have a bottom frame section or attached anchors that are embedded into moldable fresh and/or wet concrete or asphalt and are therefore permanent installations. U.S. Pat. Nos. 8,261,497 and 8,528,278 disclose an embedment tile with a replaceable top plate. These two patents disclose a lower portion that is permanently secured into the moldable fresh and/or wet concrete or asphalt. In addition, these patents disclose an upper panel with a downwardly extending flange around at least a portion of the perimeter of the upper panel and the flange extending downwardly to an elevation below the surface of the associated lower portion. U.S. Pat. Nos. 7,779,581 and 8,028,491 disclose a replaceable wet-set tactile warning surface unit and method of installation and replacement. These two patents require the tactile warning surface to be installed in moldable fresh and/or wet concrete. The present invention eliminates the requirement that the tactile warning panel has a frame or attached fastening system that is permanently embedded into moldable fresh and/or wet set concrete or asphalt. In addition, current surface mount style tactile warning panels not only require a mechanical anchoring system of some type but also require the use of glue and/or other adhesives to reinforce securement of the panel to the existing ground surface. These methods prevent the efficient and frequent removal and replacement of the tactile warning panel. Tactile warning panels can be damaged by vehicles, chemical corrosion, ultra violet radiation, snowplows, foot traffic, as well as, general wear and tear from the harsh outdoor environment, thus requiring regular replacement. Depending on conditions of use, a standard one-color tactile warning panel may require replacement every 2-10 years. The tactile warning panel design/decoration and proposed usage as taught in co-pending Patent Application US 2013/0212046 A1 creates an incentive to replace panels more frequently. This Patent Application relates to tactile warning panels that display text and/or other graphic information such as commercial messages, trademarks, logos, directions, slogans, pictures, names, product illustrations, emblems, promotional information related to a product or service, Quick Response Codes and other optical machine-readable labels and combinations thereof. Thus, as the messaging changes there is a need to remove and replace panels unrelated to repair or exigency. Such replacements may be desired at short intervals.

SUMMARY OF THE INVENTION

The present invention relates to the means and methods of installation, securement, removal and replacement of tactile warning surface mount plates/panels (TWSP's), preferably having at least a two color graphic design thereon, on pedestrian walkways, driveways, sidewalks, ramps, handicap ramps, retail floors and other types of existing preformed ground surfaces. The present invention includes TWSP's for both attention plates/panels and guiding plates/panels.

Accordingly, in some embodiments, the present invention provides surface mount panel assemblies comprising: a lower base plate directly attachable to an existing preformed ground surface, the lower base plate having a plurality of anchor holes therein for securing by anchoring the lower base plate to the preformed ground surface and a plurality of securement members therein that are offset from the anchor holes; and a removable upper panel having an upper surface, the upper panel having a plurality of through holes therein that register with the securement members when the upper panel is placed on the lower base plate so that the upper panel can be removeably secured to the lower plate.

In further preferred embodiments, the present invention provides surface mount panel assemblies comprising: a lower base plate directly attachable to an existing preformed ground surface, the lower base plate having a plurality of anchor holes therein for securing by anchoring the lower base plate to the preformed ground surface and a plurality of securement members therein that are offset from the anchor holes; a removable upper panel having an upper surface, the upper panel having a plurality of through holes therein that register with the securement members when the upper panel is placed on the lower base plate so that the upper panel can be removeably secured to the lower plate; and a plurality of anchors insertable through the anchor holes so that the lower base plate can be secured to the preformed ground surface.

In still further preferred embodiments, the present invention provides surface mount panel assemblies comprising: a lower base plate directly attachable to a preformed ground surface, the lower base plate having a plurality of anchor holes therein for securing by anchoring the lower base plate to the preformed ground surface and a plurality of securement members therein that are offset from the anchor holes; a removable upper panel having an upper surface, the upper panel having a plurality of through holes therein that register with the securement members when the upper panel is placed on the lower base plate so that the upper panel can be removeably secured to the lower base plate and having thereon a plurality of raised, truncated domes or raised projections providing a hollow void therein; and a plurality of anchors insertable through the anchor holes so that the lower base plate can be secured to the preformed ground surface, the anchors each comprising a head, wherein the hollow void of the domes accommodates the heads of the plurality of anchors when the upper panel is attached to the lower plate.

In some preferred embodiments, the assemblies described above comprise a plurality of anchors insertable through the anchor holes so that the lower base plate can be secured to the preformed ground surface. In some embodiments, the plurality of anchors comprise expansion flanges that engage the preformed ground surface. In some embodiments, the plurality of anchors are nail drive expansion anchors. In some embodiments, the plurality of anchors are mechanical anchors selected from the group consisting of screw anchors, drop-in anchors and impact anchors. In some embodiments, the plurality of anchors each comprises a head. In some embodiments, the removable upper panel comprises a plurality of hollow domes or raised projections that accommodate the heads of the plurality of anchors when the upper panel is attached to the lower plate.

In some embodiments, the upper panel further comprises additional hollow domes that provide a tactile warning surface. In some embodiments, the tactile warning surface is ADA compliant. In some embodiments, the removable upper panel has a plurality of openings therein that accommodate the heads of the plurality of anchors when the upper panel is attached to the lower plate. In some embodiments, the upper panel comprises a tactile warning surface selected from the group consisting of attention and guiding patterns. In some embodiments, the tactile warning surface comprises a plurality of raised, truncated domes. In some embodiments, the upper panel comprises a plurality of raised structures that provide slip resistance.

In some embodiments, the plurality of through holes have a shape selected from the group consisting of circles, ovals, teardrops, keyholes, and oblong holes and combinations thereof. In some embodiments, the plurality of securement members comprise a shaft and head that project upwardly from the lower base plate and engage the upper panel through the through holes to releasably secure the upper panel to the lower base plate. In some embodiments, the securement members are selected from the group consisting of a stand-off stud and a threaded screw or bolt.

In some embodiments, the securement member further comprises a plurality of receivers on the lower base plate and a plurality of fasteners that releasably secure the upper panel to the lower base plate. In some embodiments, the fasteners are selected from the group consisting of threaded screws, threaded bolts, quick release fasteners, quarter turn fasteners, cam-lock fasteners, and dual lock reclosable fasteners. In some embodiments, the plurality of receiver members project downwardly from the lower base plate and the plurality of fasteners engage the receiver members when inserted through the upper panel through holes to releasably secure the upper panel to the lower base plate. In some embodiments, the receiver members are threaded receivers and the fasteners are threaded bolts that can be screwed into the threaded receivers. In some embodiments, the receiver members are quarter turn receivers and the fasteners are quarter turn fasteners that engage the quarter turn receivers.

In some embodiments, the lower base plate does not include a downwardly projecting perimeter or interior flange. In some embodiments, the upper panel does not include a downwardly projecting perimeter or interior flange. In some embodiments, the lower base plate is mountable so that it is flush with the preformed ground surface. In some embodiments, the lower base plate and the upper panel are flushly secured to as to prevent tripping. In some embodiments, wherein the upper panel is formed from a plastic composite and comprises a beveled edge that extends past the outer edge of the lower base plate and has therein an indentation on the underside of the upper panel to accommodate the lower base plate. In some embodiments, the upper panel and lower base plate are secured without the use of an adhesive agent.

In some embodiments, the assembly comprises at least two removeable upper panels that are removeably securable to the lower base plate. In some embodiments, the assembly comprises at least two lower base plates.

In some embodiments, the upper panel comprises a graphic display displaying at least two colors. In some embodiments, the graphic design displays at least three colors. In some embodiments, the graphic design has a resolution of at least 300×300 dots per inch. In some embodiments, the upper panel is textured to provide slip resistance and durability. In some embodiments, the upper panel comprises raised features to provide slip resistance. In some embodiments, the upper panel comprises an array of raised, truncated domes that are in register with raised, truncated domes on the lower base plate. In some embodiments, the upper panel comprises a material selected from the group consisting of metal, polymeric materials, concrete, bricks, natural stone, ceramic, and tile. In some embodiments, the metal is selected from the group consisting of cast iron, ductile iron, steel, aluminum, and alloys thereof. In some embodiments, the polymeric material is selected from the group consisting of a plastic, thermoset plastic, thermoplastic, plastic composite, and fiber entrained plastic impregnated with carbon nanotubes, carbon black, or combinations thereof.

In some embodiments, the lower base plate comprises a graphic display displaying at least two colors. In some embodiments, the graphic design displays at least three colors. In some embodiments, the graphic design has a resolution of at least 300×300 dots per inch. In some embodiments, the lower base plate is textured to provide slip resistance and durability. In some embodiments, the lower base plate comprises raised features to provide slip resistance. In some embodiments, the lower base plate comprises an array of raised, truncated domes that are in register with raised, truncated domes on the upper panel. In some embodiments, the lower base plate comprises a material selected from the group consisting of metal, polymeric materials, concrete, bricks, natural stone, ceramic, and tile. In some embodiments, the metal is selected from the group consisting of cast iron, ductile iron, steel, aluminum, and alloys thereof. In some embodiments, the polymeric material is selected from the group consisting of a plastic, thermoset plastic, thermoplastic, plastic composite, and fiber entrained plastic impregnated with carbon nanotubes, carbon black, or combinations thereof.

In some embodiments, the present invention provides surface mount panel assemblies comprising: a lower base plate directly attachable to a preformed ground surface, the lower base plate having a plurality of anchor holes therein for securing by an anchoring the lower base plate to the preformed ground surface and a first plurality of plastic reclosable fastener members distributed in a pattern on the lower base plate; a removable upper panel having an upper surface and a lower surface, the lower base plate surface comprising a second plurality of plastic reclosable fastener members distributed in a pattern that matches the pattern on the lower base plate so that the upper panel can be removeably secured to the lower base plate via the first and second plurality of plastic reclosable fastener members; and a plurality of anchors insertable through the anchor holes so that the lower base plate can be secured to the preformed ground surface.

In some embodiments, the upper panel comprises hollow domes that provide a tactile warning surface. In some embodiments, the tactile warning surface is ADA compliant. In some embodiments, the assembly comprises at least two upper removable plates that are removeably securable to the lower base plate. In some embodiments, the upper panel comprises a graphic display displaying at least two colors. In some embodiments, the upper panel and the lower base plate comprise a material selected from the group consisting of metal, polymeric materials, concrete, bricks, natural stone, ceramic, and tile.

In some embodiments, the present invention provides method for attaching to a preformed ground surface a surface mount assembly comprising a plurality of anchors, a plurality of fasteners, a lower base plate having a plurality of anchor holes therein and a plurality of receiver members therein that are offset from the anchor holes and a removable upper panel having a plurality of through holes therein that register with the receiver members, the method comprising: forming a plurality of counter sunk holes in the preformed ground surface that register with the receiver members in the lower base plate allowing for flush securement of the lower base plate with the preformed ground surface; attaching the lower base plate to the preformed ground surface with the plurality of anchors; and removeably attaching the upper panel to the lower base plate by inserting the fasteners through the through holes in the upper panel to engage the receivers in the lower base plate.

BRIEF DESCRIPTION OF THE DRAWINGS

For a better understanding of the present invention, reference may be made to the accompanying drawings.

FIG. 43A illustrates four (4) individual 1'×2' surface mount upper panels consisting of a plurality of domes a plurality of through-holes on the interior and around the perimeter of the upper panel. Also illustrated is a 2'×4' lower base plate in which the four (4) individual 1'×2' upper panels can be directly attached to.

FIG. 43B illustrates a one piece 2'×4' surface mount upper panel consisting of a plurality of domes and a plurality of through-holes on the interior and around the perimeter of the upper panel. This drawing also illustrates a 2'×4' lower base plate which the 2'×4' upper panel can be directly attached to.

FIG. 44A illustrates three (3) individual 1'×2' upper panels consisting of a plurality of domes and a plurality of through-holes on the interior and around the perimeter of the upper panels. This drawing also illustrates a 2'×3' lower base plate which the three (3) individual 1'×2' upper panels can be directly attached to.

FIG. 44B illustrates a one (1) piece 2'×3' upper panel consisting of a plurality of domes and a plurality of through-holes on the interior and around the perimeter of the upper panel. This drawing also illustrates a 2'×3' lower base plate, in which the 2'×3' upper panel can be directly attached to.

FIG. 45A illustrates two (2) individual 1'×2' upper panels consisting of a plurality of domes and a plurality of through-holes on the interior and around the perimeter of the upper panels. This drawing also illustrates a 2'×2' lower base plate which the two (2) individual 1'×2' upper panels can be directly attached to.

FIG. 45B illustrates a one piece 2'×2' upper panel consisting of a plurality of domes and a plurality of through-holes on the interior and around the perimeter of the upper panel. This drawing also illustrates a 2'×2' lower base plate which the 2'×2' upper panel can be directly attached to.

FIG. 46 illustrates a 1'×2' upper panel consisting of a plurality of domes and a plurality of through-holes on the interior and around the perimeter of the upper panel. This drawing also illustrates a 1'×2' lower base plate, which the 1'×2' upper panel can be directly attached to.

FIG. 47 illustrates three (3) individual 1'×2' upper panels consisting of a plurality of domes and a plurality of through-holes on the interior and around the perimeter of the upper panels that have been decorated with a single continuous graphic image. This drawing also illustrates a 2'×3' lower base plate which the three (3) individual 1'×2' upper panels can be directly attached to.

FIG. 48 illustrates three (3) individual 1'×2' upper panels consisting of a plurality of domes and a plurality of through-holes on the interior and around the perimeter of the upper panels that have been decorated with a single continuous graphic image on two (2) of the 1'×2' upper panels and a completely separate graphic image on the third 1'×2' upper panel. This drawing also illustrates a 2'×3' lower base plate which the three (3) individual 1'×2' upper panels can be directly attached to.

DEFINITIONS

Figure 1A:
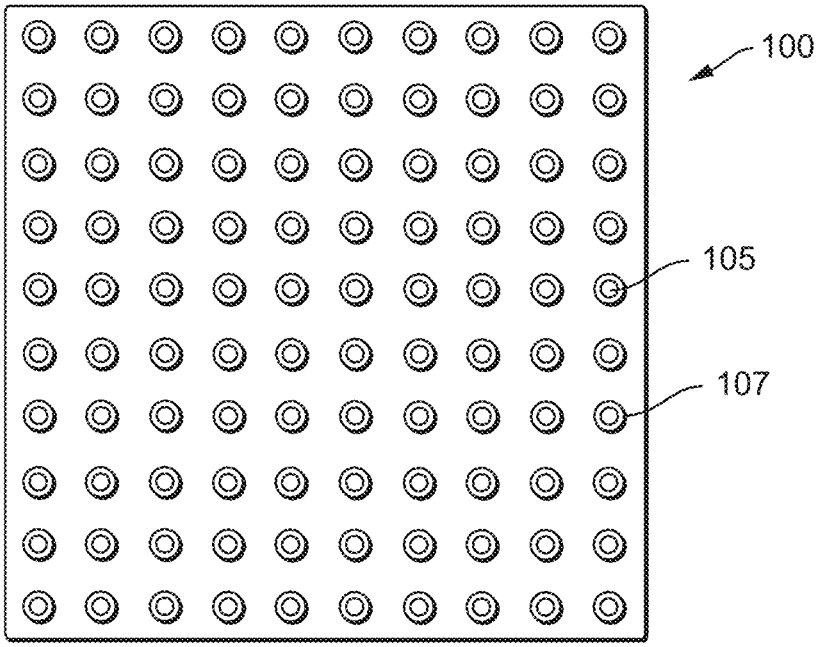
FIG. 1A illustrates a Tactile Warning Surface Panel (TWSP's) "attention pattern" showing truncated domes or cones parallel to the principal direction of travel.

To facilitate an understanding of the present invention, a number of terms and phrases are defined below.

"Attention pattern" as used herein refers to a TWSP design calling attention to a hazard, or to hazards and decision points. Attention patterns can be installed in the vicinity of pedestrian crossings, at-grade curbs, railway platforms, stairs, ramps, escalators, travelators, elevators, etc.

"Guiding pattern" as used herein refers to a TWSP design indicating a direction of travel or a landmark.

"Hazard" as used herein refers to any area or element in, or adjacent to, a direction of travel, which may place people at risk of injury.

"Keyhole through-holes" is a hole in which a larger diameter circular hole is connected to a smaller diameter circular hole.

"Lower base plate expansion anchor and/or fasteners" as used herein refers to the expansion anchors and/or fasteners that secure the lower base plate to the existing preformed ground surface.

"Lower base plate anchor-holes" as used herein refers to the holes in the lower base plate which expansion anchors/fasteners are installed in to secure the lower base plate to the existing preformed ground surface.

"Lower base plate receivers" as used herein refers to receivers in the lower base plate that allow the upper tactile panel to be efficiently attached to the lower base plate. These lower base plate receivers allow the upper tactile panel to be removed and reinstalled very efficiently.

"Lower base plate receiver holes" as used herein refers to the holes in the lower base plate where a multitude of different types of mechanical receivers can be installed/attached.

"Quick release receiver" as used herein refers to self-clinching fasteners that create a permanent, flush joining of two plates. Mechanically pressing-in, or self-clinching, the quick release fastener receiver into a pre-drilled through hole causes the cold-flow of the plate material into the fasteners two separate clinch profiles. These receivers have built-in retention features that keep the fastener hardware internal which eliminates dropped or lost components. A great advantage of these receivers is that quick release studs require minimal torqueing into order to remove the secured part.

"Threaded receivers" as used herein refers to inserts that feature a knurled body and reduced profile head to allow for virtually flush installations. On the inside of the threaded receivers are machined threads that allow for threaded screws to be inserted and rotationally torqued to provide securement of a part.

"Standoff stud" as used herein refers to self-clinching fasteners create a permanent, flush joining of two sheets. Squeezing the fastener into a pre-drilled through-hole causes the cold-flow of the plate material into the fasteners two separate clinch profiles. Coming up from the self-clinching end of the fastener is a solid metal core, which at the end of it has a rounded "button" top.

"Tactile Walking Surface Mount Panel (TWSP)" as used herein refers to a standardized walking surface used for information by blind or vision-impaired persons.

"Teardrop through-hole" as used herein refers to a hole having a spherical or globular shape at one end and tapering to a point at the other end.

"Oblong through-hole" as used herein refers to a hole with an elongated design.

"Truncated domes or cones" as used herein refers to a type of attention pattern also referred to as flat-topped domes or cones.

"Upper tactile panel through-holes" as used herein refers to the holes in the upper panel in which fasteners are installed in to secure the upper panel to the lower base plate.

"Preformed ground surface" as used herein refers to a ground surface such as a concrete or asphalt surface that set up, hardened or cured.

DETAILED DESCRIPTION OF THE INVENTION

The present invention provides a tactile warning surface mount panel double plate assembly, which includes both a lower base plate and an upper tactile panel. In some embodiments, this tactile warning surface mount TWSP double plate assembly is designed such that the lower base plate, a plate with no tactile warnings or truncated domes, is secured directly to the existing preformed ground surface with commercially available mechanical anchors and/or fasteners. The upper tactile panel, a panel with tactile warnings, truncated domes or raised projections, is attached to the lower base plate with mechanical fasteners and/or receivers that allow the upper tactile panel to be removed and replaced an infinite number of times. The present invention allows the TWSP to be installed after the concrete, asphalt or ground surface sets up, hardens or cures. The present invention provides the means and methods for a TWSP double plate assembly that allows the upper tactile panel to efficiently be removed and replaced from the lower base plate which is anchored with mechanical anchors and/or fasteners to the existing preformed ground surface, without requiring permanently embedded frames, receivers or anchors into new, fresh or moldable surfaces.

Currently, there is not a quick and efficient way to install, onto existing preformed ground surfaces, a tactile warning surface mount panel which can then be easily and efficiently removed and replaced when it eventually becomes worn, damaged or whenever a person chooses to replace it. The TWSP double plate assembly system gives a skilled construction tradesperson the alternative of installing the concrete or asphalt ground surface first and then installing the TWSP double plate system at a later time after the concrete or asphalt sets up, cures or hardens. In many situations this could be a much more efficient installation, saving both time and money. In addition, at many retail and public right of way locations the concrete handicap ramp has been installed for many years but the handicap ramp does not have a tactile warning panel installed in and/or on the ramp. The current invention provides the opportunity to install a surface mount tactile warning panel onto the existing preformed concrete handicap ramp.

In accordance with the present invention, a tactile warning surface mount assembly of the present invention has a lower base plate. The lower base plate has a plurality of anchor-holes for securing by an anchor the lower base plate to the existing preformed ground surface and a plurality of offset receivers. The upper ADA-compliant tactile panel has an upper surface bearing a plurality of raised domes and a plurality of through-holes in vertical alignment with the receivers attached to the lower base plate. The preferred anchor is an anchor drive pin having an upper shaft portion and a lower expandable flange portion insertable through the anchor-holes of the lower base plate. These are vertically aligned with the centers of the raised domes on the upper panel. The invention also has fasteners such as threaded screws to insert through the offset through-holes of the upper plate to engage in vertical alignment with the threaded receivers.

The present invention has multiple differences from other replaceable and/or removable tactile warning panels. The differences are as follows—

- The present invention tactile warning surface mount TWSP double plate assembly is not installed in wet set concrete and/or asphalt or other moldable materials.
- The tactile warning surface mount TWSP double plate assembly is attached to the existing preformed ground surface with mechanical fasteners only. No adhesives and/or glues are needed and/or required to secure.
- Neither the lower base plate nor the upper tactile panel of the present invention has a downwardly extending flange around the perimeter or interior of the members.

Accordingly, the assemblies of the present invention preferably include a tactile warning surface mount double plate and/or panel assembly incorporating a lower base plate and an upper tactile panel. This double plate/panel assembly is designed so that the lower base plate is semi-permanently or permanently secured to the existing preformed ground surface, which can be cured and/or hardened concrete or asphalt. The upper tactile panel, with truncated domes or raised projections, is secured onto the lower base plate utilizing receivers in the lower base plate with different types of fasteners that allow the upper tactile panel to be removed. This design provides a removable and replaceable TWSP product that can be changed efficiently and effectively an infinite number of times.

The TWSP double plate/panel assembly preferably comprises a lower base plate, no truncated domes or raised projections, with anchor-holes and different stud/screw type receivers that are mechanically attached to the lower base plate and protrude downward from the bottom of the lower base plate. The lower base plate can be made of different sizes such as 1'×2', 2'×2', 2'×3', 2'×4', 2'×5', 3'×4', as well as, various other sizes depending upon the application and existing site conditions. The lower base plate can be made out of various types of materials such as steel, metal, stainless steel, galvanized steel, aluminum, plastic, plastic composites, fiberglass and other types of materials. The substantially flat lower base plate has a plurality of anchor-holes that enable securement of the lower base plate directly onto an existing preformed ground surface with commercially available mechanical anchors and/or fasteners. The lower base plate anchor-holes are spaced such that they are aligned vertically in the center of the numerous truncated domes and/or raised projections on the upper tactile panel. This design allows the head of the mechanical fastener to sit beneath the designed void space or fabricated indentation under the truncated domes on the upper tactile panel. This enables the upper tactile panel to sit flush on top of the lower base plate when the double plate assembly is installed and secured to the existing preformed ground surface. The lower base plate is installed on the existing preformed ground surface by first hammer drilling approximately 5-35 holes into the existing preformed ground surface (concrete, asphalt or other material) with an appropriately sized drill bit. A hammer drill provides the best hole in concrete or other hard material and is therefore desired for hole drilling. The drilled hole locations in the existing preformed ground surface will match the lower base plate round anchor-holes. A drill template can be used to mark the holes on the existing preformed ground surface before hammer drilling. Mechanical anchors and/or fasteners are inserted through the round anchor-holes in the lower base plate and then expanded by various mechanical methods in the existing preformed ground surface material. This secures the lower base plate to the existing preformed ground surface. The mechanical anchors and/or fasteners used to secure the lower base plate to the existing preformed ground surface can be drive pin anchors, nailin anchors, impact anchors, pin anchors, drive pin, spike pin, drop-in anchors, Leadwood screw anchors, lag shield anchors, hit anchors or other types of commercially available anchors and/or fasteners. This semi-permanently or permanently secures the lower base plate to the existing preformed ground surface.

The lower base plate also has a plurality of receivers mechanically attached and protruding from the bottom of the lower base plate. These receivers in the lower base plate are aligned with the upper tactile panel through-holes. The receivers in the lower base plate allow the upper tactile panel to be mechanically attached to the lower base plate with different types of fasteners (threaded screws, threaded bolts, quick release fasteners, quarter turn fasteners, cam-lock fasteners, standoff studs, dual lock reclosable fasteners, etc.) depending on the receiver type/style. When installing the lower base plate a drilled hole is also needed in the existing preformed ground surface wherever there is a receiver on the bottom of the lower base plate. Typically, this requires an additional 5 to 20 holes in the existing preformed ground surface. These holes provide a void cavity and/or hole in the existing preformed ground surface for the receivers to sit down in so the lower base plate sits flush on top of the existing preformed ground surface.

In some preferred embodiments, the removable upper tactile panel is a surface mount ADA-compliant tactile warning panel that has a plurality of raised truncated domes and/or raised projections and a plurality of through-holes in vertical alignment with the receivers on the lower base plate. Mechanical fasteners are inserted through the through-holes in the upper tactile panel to engage the receivers on the lower base plate. A multitude of different types of receivers can be used on the lower base plate, which allows different removable fasteners to be used in order to attach the upper tactile panel to the lower base plate. These different types of fastening and/or receiver systems on the lower base plate allow the upper tactile panel to be replaced very quickly, efficiently and frequently. The upper panel is typically the same dimensions as the lower base plate. The upper panel can be made in different sizes such as 1'×2', 2'×2', 2'×3', 2'×4', 2'×5', 3'×4', as well as, various other sizes depending upon the application and existing site conditions. The upper tactile panel can be made out of various types of materials such as steel, metal, stainless steel, galvanized steel, aluminum, plastic, plastic composites and other types of materials.

In an alternate embodiment, the tactile warning surface mount double plate and/or panel assembly has a lower base plate having aligned standoff studs or screw receivers that act as standoff studs. Additionally, this assembly requires an upper tactile panel that aligns with this style of lower base plate. The upper panel displays truncated domes, a plurality of through-holes of elongated asymmetric shape arranged in parallel orientation and spaced to simultaneously permit passage of the head portion of standoff studs or screws at a height slightly greater than the thickness of the upper panel. The shape of the elongated asymmetric upper tactile panel through-holes are large enough at its widest dimension to admit the head of the standoff studs or screws, and at its narrowest dimension, only wide enough to admit the shaft of the standoff stud or screw, but of lesser diameter than that of the head of the standoff stud or screw.

When the upper tactile panel is assembled onto the lower base plate all of the standoff studs or screw heads are aligned so that the wide portion(s) of the apertures is available to accommodate all of the standoff stud or screw heads at their largest circumference. The upper panel is then laterally shifted to the locked position, all the narrower shaft standoff studs are aligned in the same direction, securing the upper panel to lower base plate. The shape of the upper tactile panel elongated asymmetric through-holes may be various shapes such as, round, keyhole, oval, oblong, teardrop and others or a combination thereof. In the preferred embodiment, the standoff studs are threaded screws, which have been partially inserted into threaded receivers in the lower base plate. These screws are installed through the upper tactile panel and into the receivers in the lower base plate. The receivers are in vertical alignment with the upper tactile panel through-holes. Thus, the replacement of one upper tactile panel with another can be accomplished by merely loosening the standoff screw studs, without actually removing the screws completely, thereby facilitating rapid removal and replacement of the upper tactile panel.

In another alternate embodiment, the tactile warning surface mount double plate and/or panel assembly has a lower base plate and upper panel incorporating a plurality of different shaped strips of 3M™ Dual Lock reclosable fasteners (hook and loop style fastener). The Dual Lock reclosable fasteners provide the securement mechanism that secures the upper panel to the lower base plate. The Dual Lock reclosable fasteners provide securement without having the head of a securement screw or fastener showing through on the surface of the upper panel. This may be more aesthetically appealing for the messaging on the upper panel.

In another alternate embodiment, the tactile warning surface mount double plate and/or panel assembly has an upper panel that does not include tactile warnings, truncated domes or raised projections. This upper panel is a flat upper panel with only micro-textures on it for slip resistance. This upper panel provides an alternative where it is not appropriate to utilize a tactile upper panel.

In a further embodiment, the tactile warning surface mount double plate and/or panel assembly has a lower base plate that is flat substrate with micro-texturing on it. The purpose of a lower base plate with micro-texturing is to provide a slip resistance surface on the lower base plate, if and when, the upper panel is removed and not replaced. This gives the lower base plate the ability to be used without an upper panel.

In another embodiment, the tactile warning surface mount double plate and/or panel assembly has a lower base plate that includes tactile warnings, truncated domes or raised projections on the lower base plate. The purpose of a lower base plate with tactile warnings is to serve as an ADA compliant TWSP, if and when, the upper panel is removed and not replaced. This gives the lower base plate the ability to be used as an ADA compliant TWSP without an upper panel.

The TWSP upper tactile panel can have multiple tactile designs. The TWSP could have "attention pattern" or "guiding pattern" surface features. The tactile warning surface mount double plate/panel assembly does not have any downwardly extending flanges around the perimeter, or interior, of the upper tactile panel or lower base plate.

In some preferred embodiments, the surface mount upper tactile warning panel is a flat panel, with a plurality of domes or with spatially raised features pointing upward away from the surface. This surface mount upper tactile panel does not have any downwardly extending flanges around the perimeter or interior of the upper panel. Because the surface mount upper tactile panel does not have any downward extending features there is no need during installation to cut a slot or slots in the existing concrete, asphalt or other type of ground surface.

The present invention also includes multiple unique upper tactile panel through-hole designs on the surface mount upper tactile panel. These different upper tactile panel through-hole designs include a round, keyhole, oval, oblong, teardrop design, and the like or a combination thereof. There is a need to have some flexibility in aligning, adjusting and securing the surface mount upper tactile panel to the lower base plate assembly. The present invention upper tactile panel with round, keyhole, oval, oblong, tear drop designs, or a combination thereof for the through-holes provides the needed flexibility (room for alignment error and adjustment) in aligning the upper tactile panel through-holes when securing the surface mount upper tactile panel to the lower base plate.

The tactile warning panel design and proposed usage as outlined in Patent Pending application US 2013/0212046, which is incorporated by reference herein in its entirety, creates a new need to replace the panels more frequently. This patent pending invention provides the opportunity for the upper tactile panel to display text and/or other graphic information such as commercial messages, trademarks, logos, directions, slogans, pictures, names, product illustrations, emblems, promotional information related to a product or service, Quick Response Codes, matrix codes, two-dimensional bar code, optical machine-readable labels, and combinations thereof. The present invention allows the upper tactile panel to be efficiently removed and replaced, as the messaging needs change. There are numerous examples of messaging/information/advertising/branding being installed on pedestrian walkways, driveways, retail floors and other ground surfaces. Examples of this include, pedestrian warnings and alerts in train stations and at transit platforms, city historical districts where messaging is put on the ground, the Hollywood Walk of Fame where bronze plaques are embedded in the concrete sidewalk and advertising on the floors of retailers. In addition, ground graphics have become popular for sporting and other special events. There is increasing demand for messaging, advertising, branding and other forms of communication to be placed on the ground. People don't walk without looking where they are going. In reality, feet are our guide where our eyes follow the path in front of our stride. On pedestrian walkways the space at our feet is uncluttered and when our heads look down, peripheral vision is limited to the immediate surroundings. Messaging on the ground surface gets noticed because the communication is directly in the consumer's site line and the raised tactile surface of a detectable warning and/or guiding pattern panel have the same affect for the visually impaired as they do for fully sited consumers—they demand attention.

A. Tactile Walking Surface Indicators

Tactile walking surface indicators (TWSIs) are widely used in many developed, and some developing countries, to provide safe wayfinding information to pedestrians who are visually impaired. TWSIs are also used to alert people with visual impairments when they are approaching a hazard such as the edge of a platform, a flight of stairs, an escalator or the end of the pavement and the beginning of the street or parking lot. TWSIs should be readily detectable and distinguishable from the surrounding or adjacent surfaces by visually impaired people. They are used for both indoor, as well as, outdoor locations.

Among their advantages, TWSIs can lead users precisely to a destination, can be used to provide information both indoors and outdoors, do not require electric power and do not require users to purchase or maintain any special equipment. Two generic texture patterns are used for TWSIs known as "attention patterns" and "guiding patterns." The usage of TWSI patterns differs somewhat from country to country. Over the years, extensive research in various countries has established that both "attention patterns," truncated domes or cones, and "guiding patterns," raised bars, are highly detectable when used in association with typical walking surfaces, and that they are distinguishable from each other.

Figure 1B:
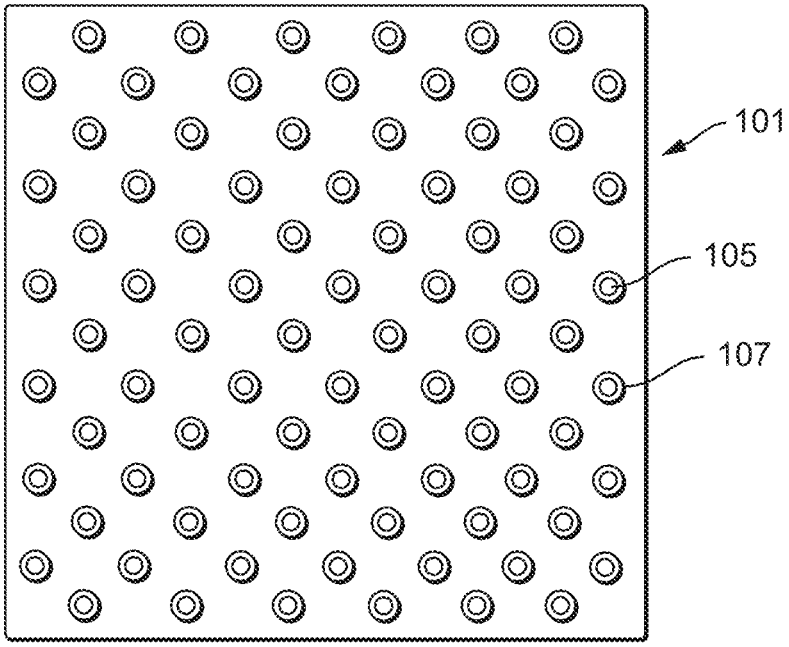
FIG. 1B illustrates a TWSP's "attention pattern" showing truncated domes or cones diagonal at 45 degrees to the principal direction of travel.

The "attention pattern" comprises truncated domes or cones, also commonly referred to as: detectable warning system, detectable warnings, detectable warning surface, detectable warning panel, tactile warning surfaces, raised tactile profiles, tactile tile, tactile detectable warnings, tactile warning surface, tactile, truncated domes, truncated dome surface, embedment tile device, Braille blocks, blister paver and attention patterns are used primarily to indicate hazards, decision points or destination facilities. A decision point may be at an intersection or at a change in direction along a guided path. "Attention patterns" are arranged in a square grid, parallel or diagonal at 45 degrees to the principal direction of travel. FIG. 1A illustrates an "attention pattern" panel 100 with a square or inline grid. The "attention pattern" panel 100 is preferably parallel to the principal direction of pedestrian travel. The truncated domes or cones are rounded and/or conical dome structures 107 protruding upward from the surface of the panel substrate. The top area 105 of the truncated domes and/or cones is a flat surface. FIG. 1B illustrates an "attention pattern" panel 101 with truncated domes and/or cones diagonal at 45 degrees to the principal direction of pedestrian travel. The truncated domes and/or cones are rounded and/or conical dome structures 107 protruding upward from the surface of the panel substrate. The top area 105 of the truncated domes and/or cones is a flat surface. The spacing and size of the domes varies depending on specific country, government or local municipality specifications. These truncated dome panels can be any color as long as the color contrasts to the surrounding concrete or pavement. Common colors are red, yellow, black, brown, patina, grey, and white. "Attention patterns" may be installed in the vicinity of pedestrian crossings, at-grade curbs, railway platforms, stairs, ramps, escalators, travelators, elevators, etc.

Figure 2A:
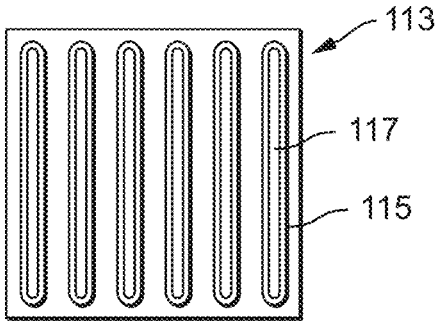
FIG. 2A illustrates TWSP's "guiding pattern" with a flat-topped elongated oval bars pattern.
Figure 2B:
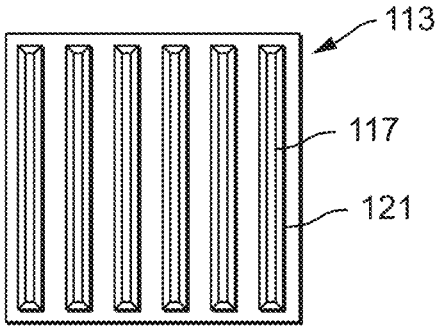
FIG. 2B illustrates a TWSP's "guiding pattern" with a flat-topped elongated rectangle bars pattern.
Figure 2C:
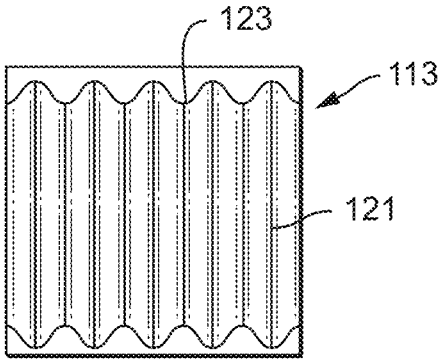
FIG. 2C illustrates a TWSP's "guiding pattern" with a sinusoidal ribs pattern.
Figure 2D:
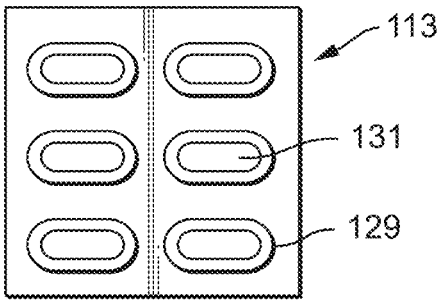
FIG. 2D illustrates a TWSP's "guiding pattern" with a flat-topped elongated oval rib pattern.

The "guiding pattern" comprises raised bars, also commonly referred to as: elongated bars, directional blocks, elongated oval bars, elongated oval ribs, elongated rectangle bars, thin linear protrusions, raised ovals, sinusoidal ribs, sinusoidal, ribbed tile and guiding pattern are used to guide visually impaired pedestrians to particular places such as pedestrian crossings, entrances to buildings, lifts and other amenities. Different designs have been developed for "guiding patterns" although flat-topped elongated bars are the most common. FIG. 2A is a "guiding pattern" substrate 113 with elongated oval bars. The elongated oval bars have a rounded top edge 115 and a flattop 117. FIG. 2B illustrates a "guiding pattern" substrate 113 with elongated rectangle bars. The elongated rectangle bars have a rounded top edge 121 and a flattop 117. FIG. 2C is a "guiding pattern" substrate 113 with a sinusoidal ribs design. The sinusoidal ribs have high ridges 121 and low valley points 123. Sinusoidal patterns are less easily damaged by snowplows than flat-topped bars. FIG. 2D is a "guiding pattern" substrate 113 with an elongated oval rib design. The elongated oval ribs have a rounded top edge 129 and a flattop 131. The raised bars of "guiding patterns" in most cases run parallel to the direction of pedestrian travel. The spacing and size of the raised bars varies depending on specific country, government or local municipality specifications. The flat-elongated bars or sinusoidal ribs can be any color as long as the color contrasts to the surrounding concrete, asphalt, pavement or other ground surface.

"Guiding patterns" may be used alone or in combination with "attention patterns" in order to indicate the walking route from one place to another. Truncated domes or cones and elongated bars or sinusoidal ribs preferably have beveled or rounded edges to decrease the likelihood of tripping and to enhance safety and negotiability for people with mobility impairments.

Multiple companies manufacture and sell ADA compliant TWSI's. The detectable warning panel substrate can be made out of many different types of materials. In addition the panel substrates come in different panel sizes and designs depending on the TWSI specifications, as well as, installation requirements in the field. FIG. 3A illustrates a top view 149 of an ADA compliant 24"×48" surface mount detectable warning panel with an inline dome attention pattern.

The drawing illustrates the truncated domes and/or cones 151 and the round holes 153 in the detectable warning panel where it is securely fastened directly to the concrete/pavement or to lower base plate.

Figure 3B:
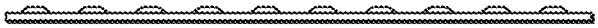
FIG. 3B illustrates an end view of an ADA compliant attention pattern surface mount tactile warning panel with domes or cones parallel to the principal direction of travel.
Figure 3A:
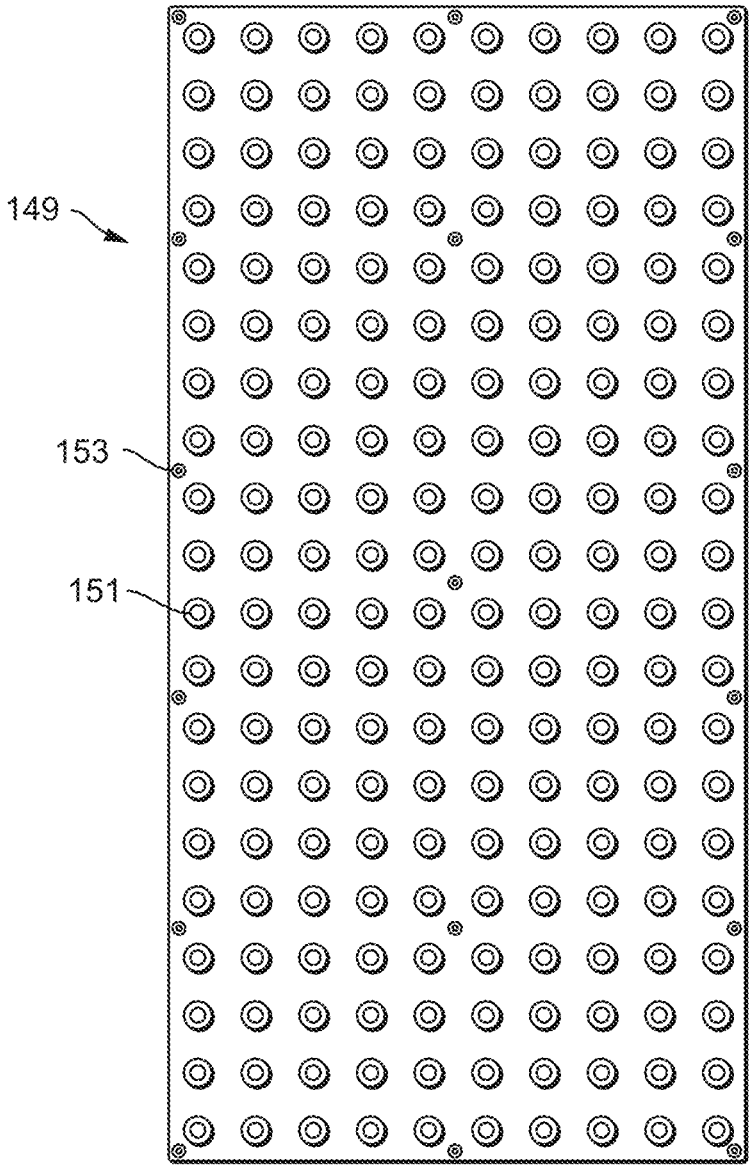
FIG. 3A illustrates a plan view of an ADA compliant attention pattern surface mount tactile warning panel with domes or cones parallel to the principal direction of travel.
Figure 3C:
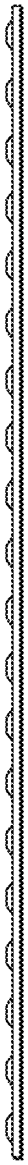
FIG. 3C illustrates a profile view of an ADA compliant surface mount tactile warning panel with domes or cones parallel to the principal direction of travel.

FIG. 3B is an end view and FIG. 3C is a side view of this surface mount detectable warning panel. Of critical importance for the present invention is that FIG. 3B and FIG. 3C do not have perimeter or interior downwardly projecting flanges.

Figure 4A:
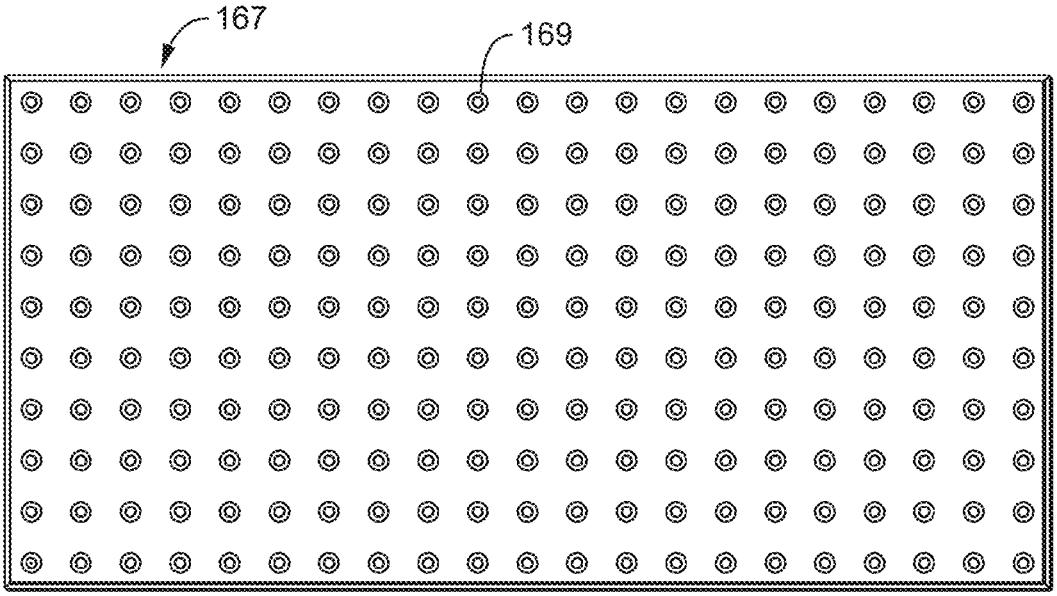
FIG. 4A illustrates a plan view of a plastic composite attention pattern surface mount tactile warning panel with domes or cones parallel to the principal direction of travel.
Figure 4B:
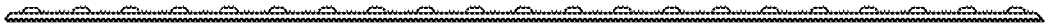
FIG. 4B illustrates a profile view of a plastic composite attention pattern surface mount tactile warning panel with domes or cones parallel to the principal direction of travel.
Figure 4C:
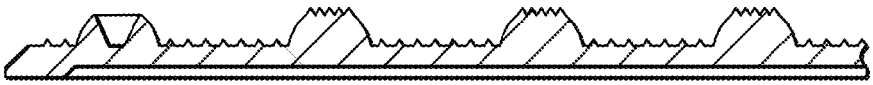
FIG. 4C illustrates a detailed profile view of the molded textured pattern of a plastic composite attention pattern surface mount tactile warning panel.
Figure 4D:
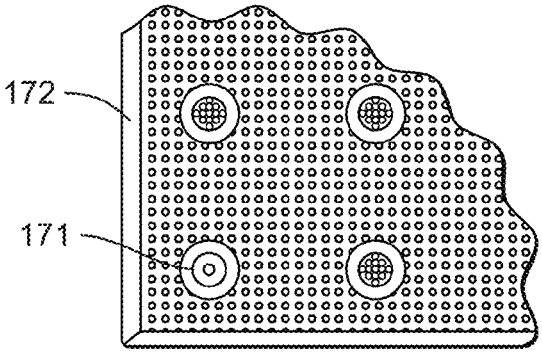
FIG. 4D illustrates a detailed plan view of a plastic composite tactile warning panel.

FIG. 4A illustrates a top view 167 of a plastic composite ADA compliant surface mount detectable warning panel with an inline dome attention pattern. The drawing illustrates the truncated domes and/or cones 169 on the panel. FIG. 4B is a side view of this panel. FIG. 4C is a cut-away view of this panel, which illustrates the truncated domes and the micro texturing which are molded into the panel to provide the necessary slip resistance. FIG. 4D illustrates the through-holes 171 in the panel for fasteners to secure the panel onto the concrete, asphalt, pavement or other existing preformed ground surface. This surface mount panel also has a sloped angle 172 on the edge of the panel so that it does not create a trip hazard and to provide the necessary strength to the plastic substrate. Of critical importance for the present invention is that FIG. 3B and FIG. 3C do not have perimeter or interior downwardly projecting flanges.

B. Tactile Warning Surface Mount Double Plate/Panel Assembly

The present invention includes multiple embodiments for both upper tactile panels and lower base plates. Upper tactile panels and lower base plates are part of the TWSP double plate/panel assemblies. Upper tactile panels can be manufactured from various materials such as, steel, cast iron, ductile iron, ceramic, concrete, HDPE, plastic, plastic composite, vitrified polymer composite, herculite polymer composite, nylon 6, nylon 6/6, fiberglass, rubber, other fibrous materials and the like. Lower base plates can also be manufactured from different types of materials but in most cases it will be made out of steel or a plastic composite material.

Figure 5A:
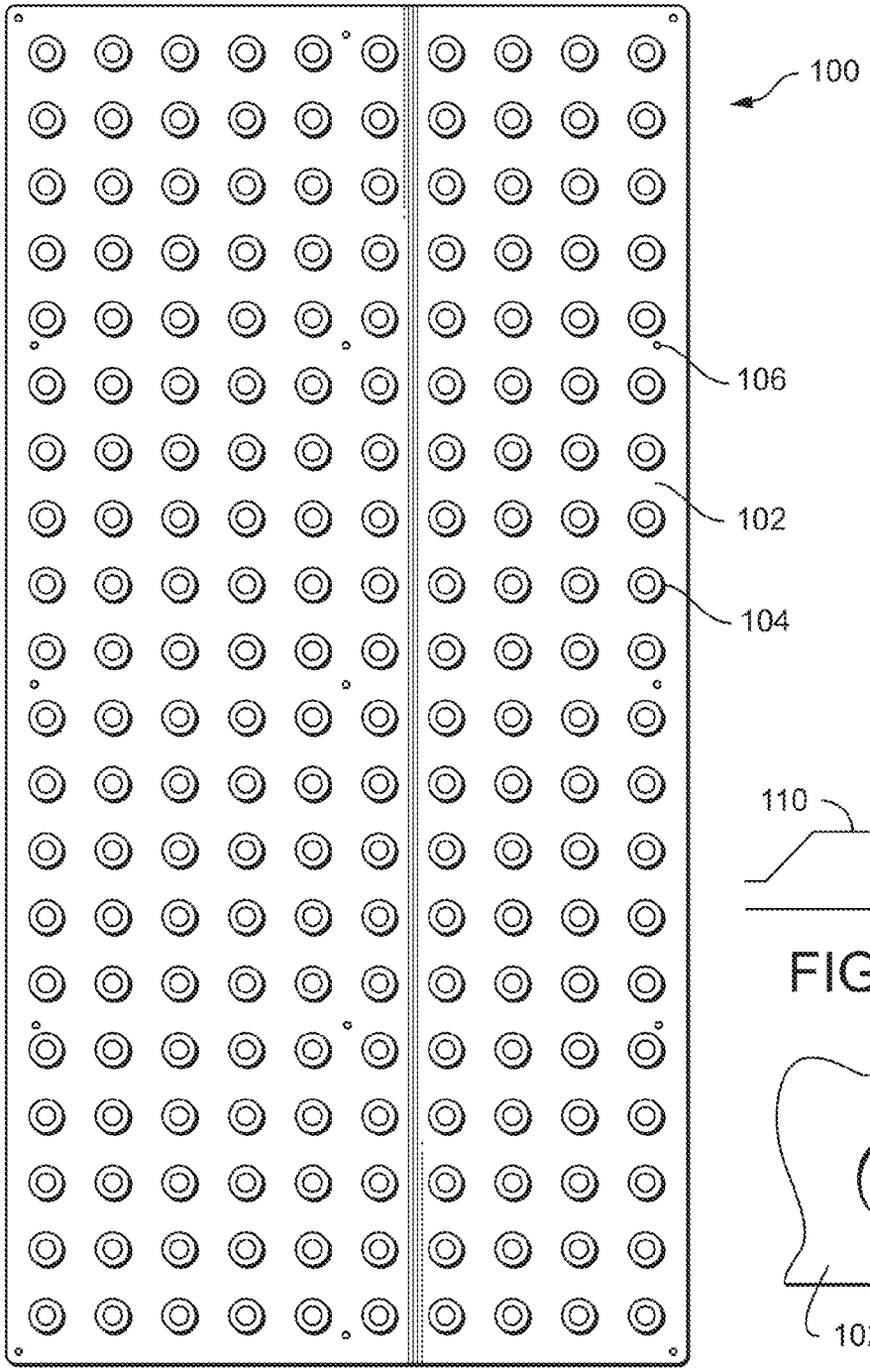
FIG. 5A illustrates a plan view of an ADA compliant surface mount upper tactile panel, consisting of a plurality of domes and a plurality of round through-holes on the interior and around the perimeter of the upper tactile panel.
Figure 5B:
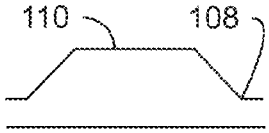
FIG. 5B illustrates a detailed profile view of an upward projection on the tactile panel.
Figure 5C:
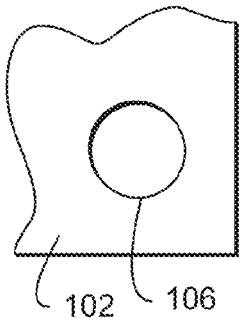
FIG. 5C illustrates a detail of a round through-hole manufactured into a tactile panel.

The first embodiment for the tactile warning surface mount double panel assembly consists of an upper panel as illustrated in FIG. 5A. FIG. 5A illustrates a tactile warning surface mount upper panel 100 incorporating an attention pattern constructed of a solid substrate 102 that can be manufactured out of multiple types of material. The most common types of material for tactile warning panels include steel or plastic composite materials. The upper panel 100 contains a plurality of upward projections 104 extending upwards from the surface of the solid member substrate 102 and a number of round through-holes 106. Each projection 104 generally consists of a raised surface called a truncated dome, as illustrated in FIG. 5B. FIG. 5B illustrates the truncated dome extending upward 108 from the solid substrate, FIG. 5A, 102 to a top flat section 110. FIG. 5C illustrates that the design of this particular upper tactile panel utilizes round through-holes 106 around the perimeter and interior of the TWSP, FIG. 5A, 100 which are used to secure this upper tactile panel to a lower base plate.

Figure 6:
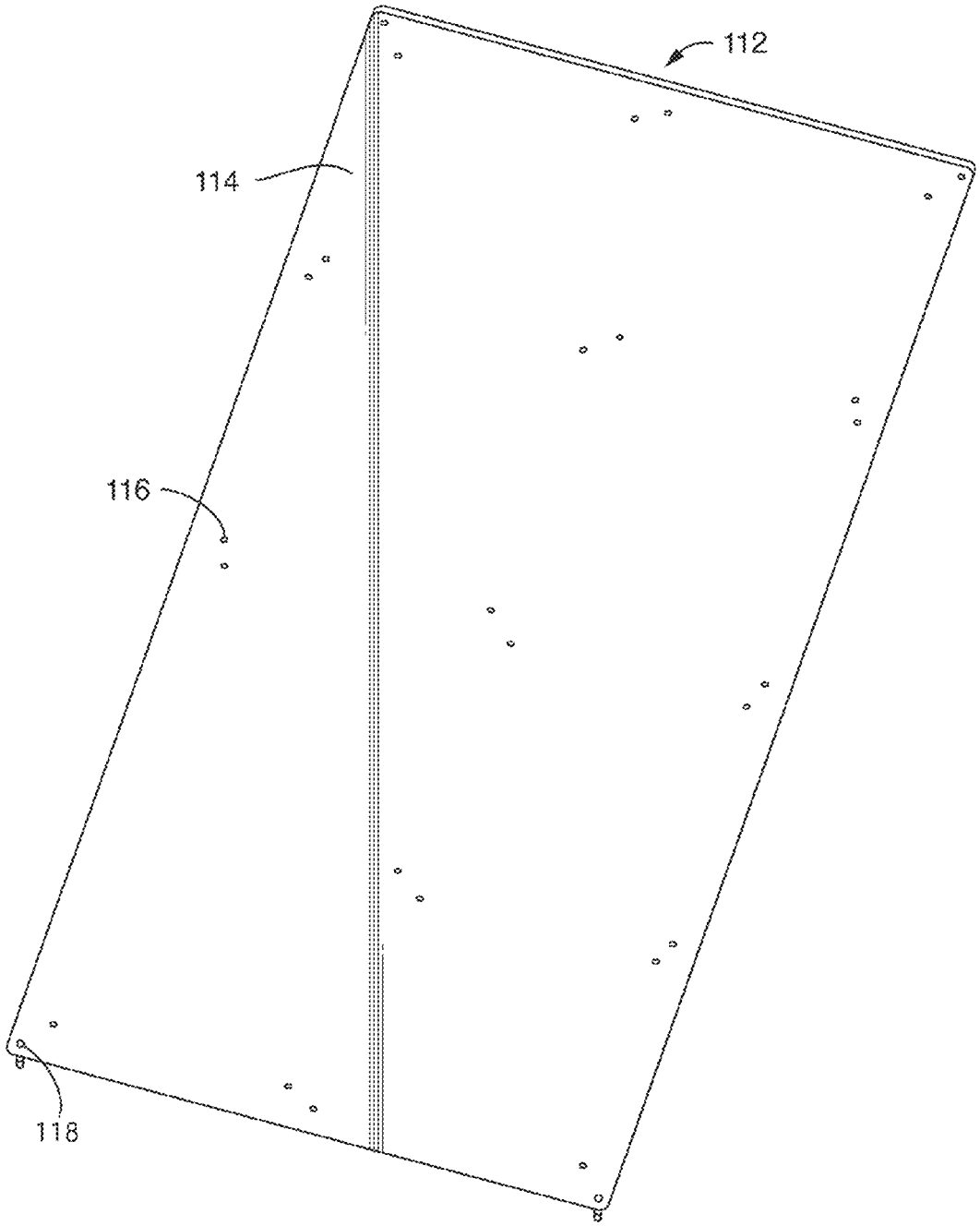
FIG. 6 illustrates a surface mount lower base plate, with a plurality of round anchor-holes and an associated plurality of receivers mechanically secured to the plate.

This upper tactile panel, FIG. 5A, can be secured to a lower base plate, FIG. 6, 112 that is secured with concrete fasteners to the existing preformed ground surface. FIG. 6 illustrates a lower base plate 112 manufactured of a solid substrate member 114 that has a plurality of round anchor-holes 116 and threaded receivers 118 around the perimeter and interior of the lower base plate 112.

Figure 7:
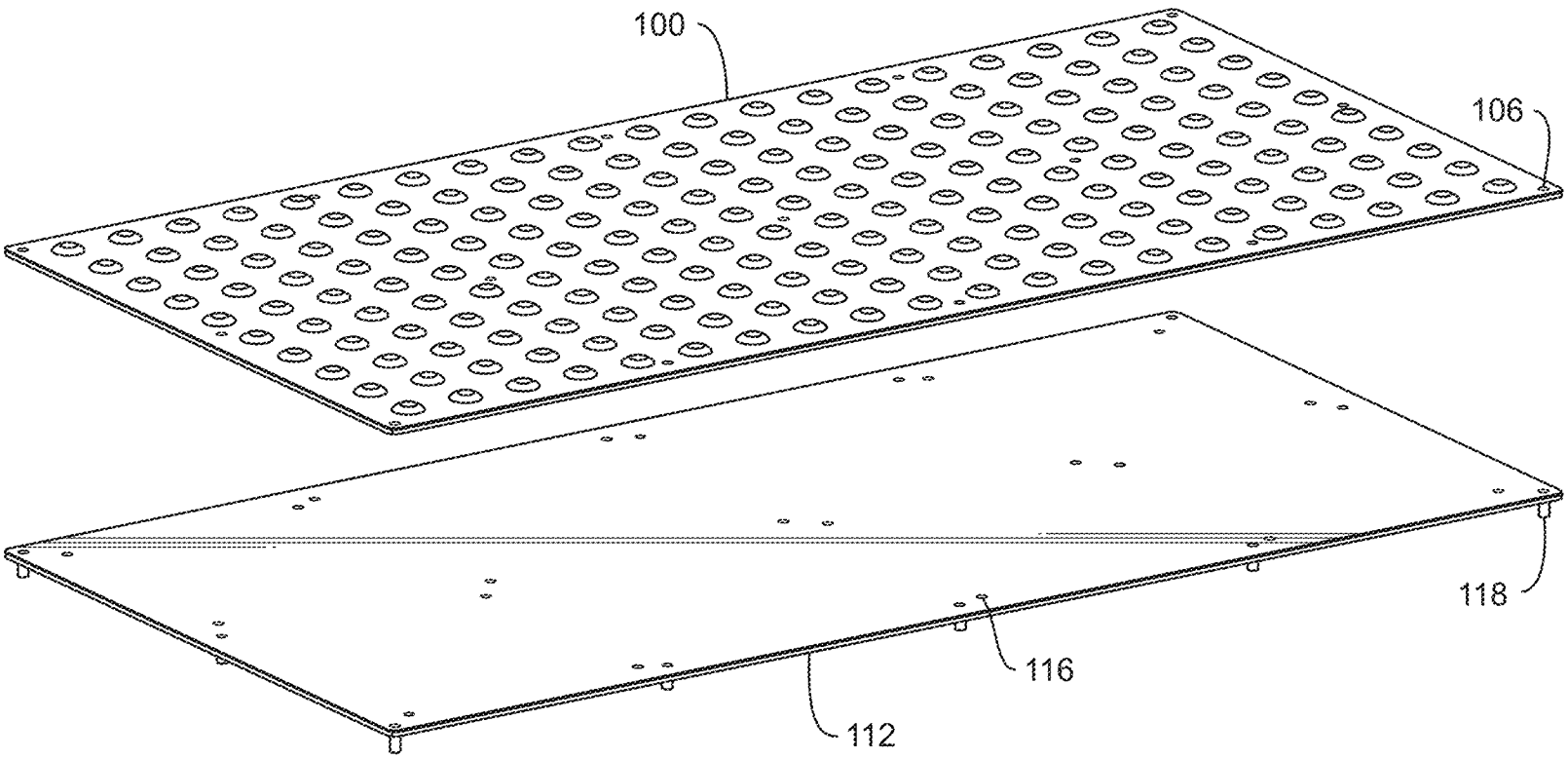
FIG. 7 illustrates a lower base plate, with a plurality of round anchor-holes and an associated plurality of receivers secured to the lower base plate. Also illustrated is an upper tactile panel, with a plurality of domes and a plurality of round through-holes.
Figure 8:
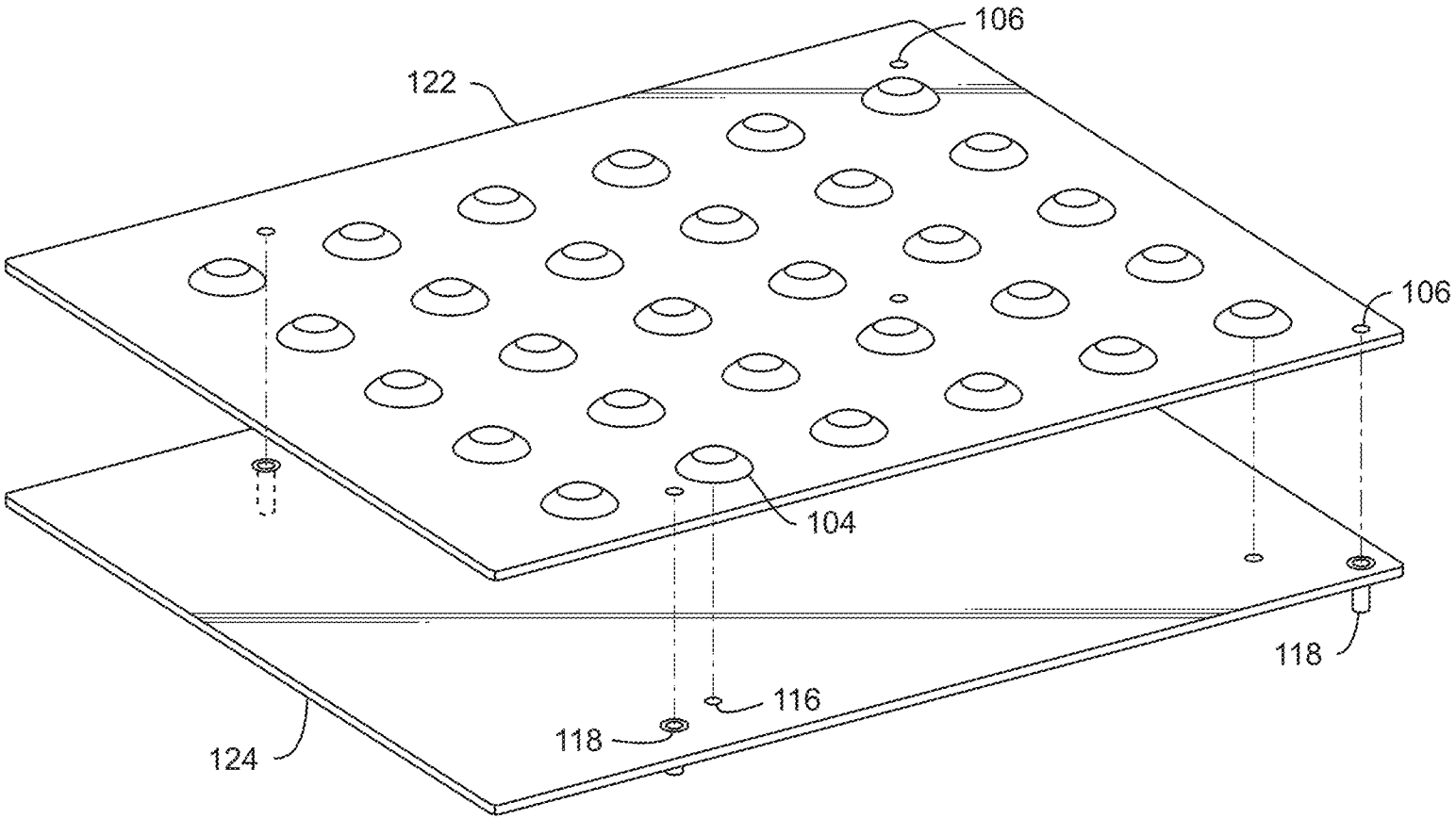
FIG. 8 illustrates a close up partial view of FIG. 7.
Figure 9:
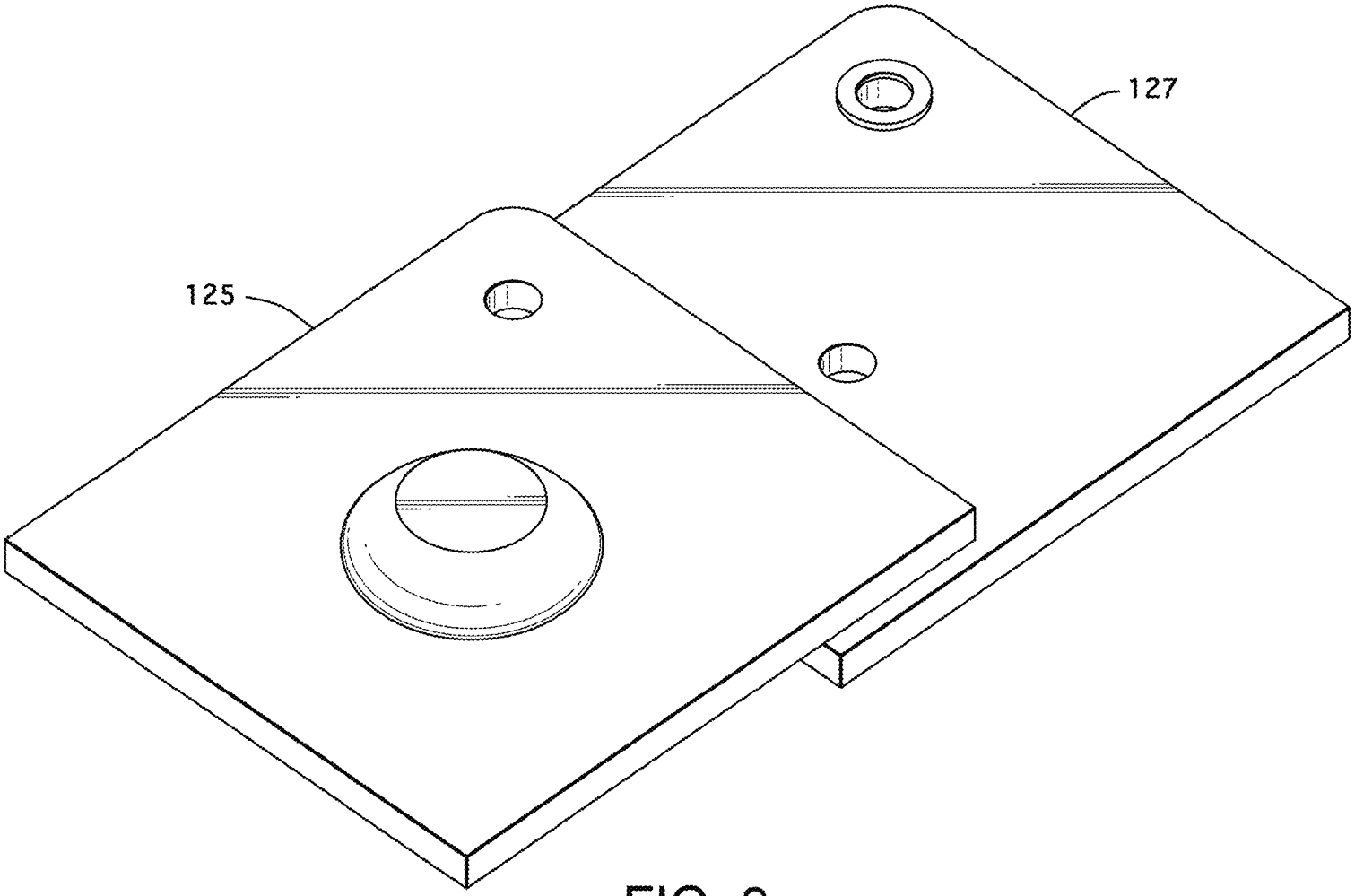
FIG. 9 illustrates a close up partial view of FIG. 8.

FIG. 7 illustrates the upper tactile panel 100, placed directly above the lower base plate 112. FIG. 7 also illustrates the round through-holes 106 in the upper tactile panel 100 aligning with the receivers 118 in the lower base plate 112. In addition, FIG. 7 illustrates anchor-holes 116 which are used to anchor and/or fasten the lower base plate 112 to the existing preformed ground surface. FIG. 8 illustrates an enlarged partial view of a small section 122 of the upper tactile panel, FIG. 5A, 100 and how the round through-holes 106 in the upper tactile panel, FIG. 5A, 100 align with the receivers 118 in the small section of the lower base plate 124. FIG. 8 also illustrates that the small section of the upper tactile panel 122 fits directly on top of the small section of the lower base plate 124 such that the upper tactile panel 122 upward projections 104 align directly on top of the anchor-holes 116 in the lower base plate 124. The alignment of the anchor-holes 116 in the lower base plate 124 reside under the void cavities of the upward projections 104 of the upper tactile panel 122 allowing space for the fastener head of a larger diameter than the anchor-hole 116 to project upward from the surface of the lower base plate 124. FIG. 9 illustrates an even further enlarged view of the upper tactile panel 125 and lower base plate 127 assemblies.

Figure 10A:
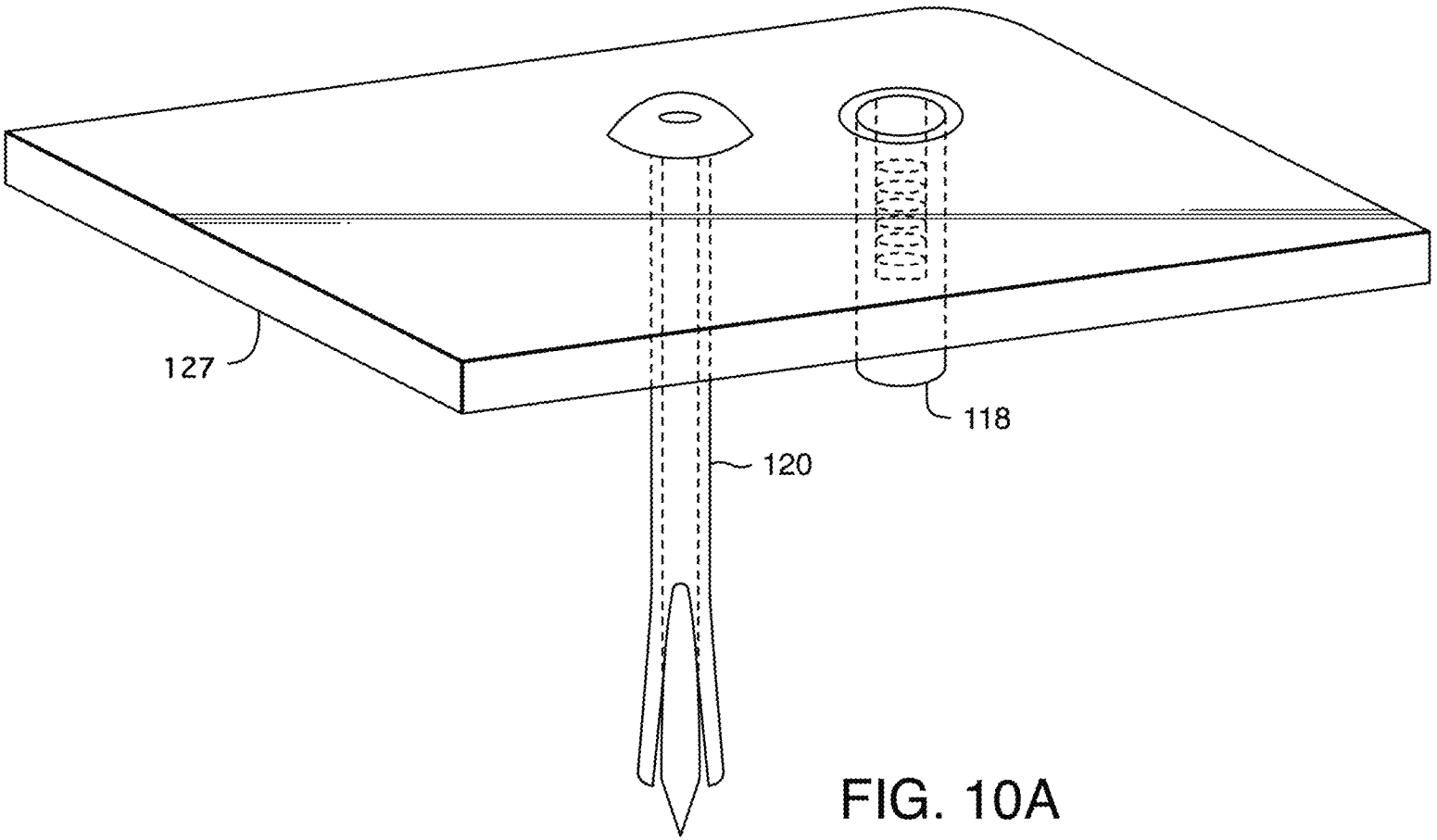
FIG. 10A illustrates a lower base plate secured to the existing preformed ground surface as well as the lower base plate containing a mechanically attached threaded receiver.
Figure 10B:
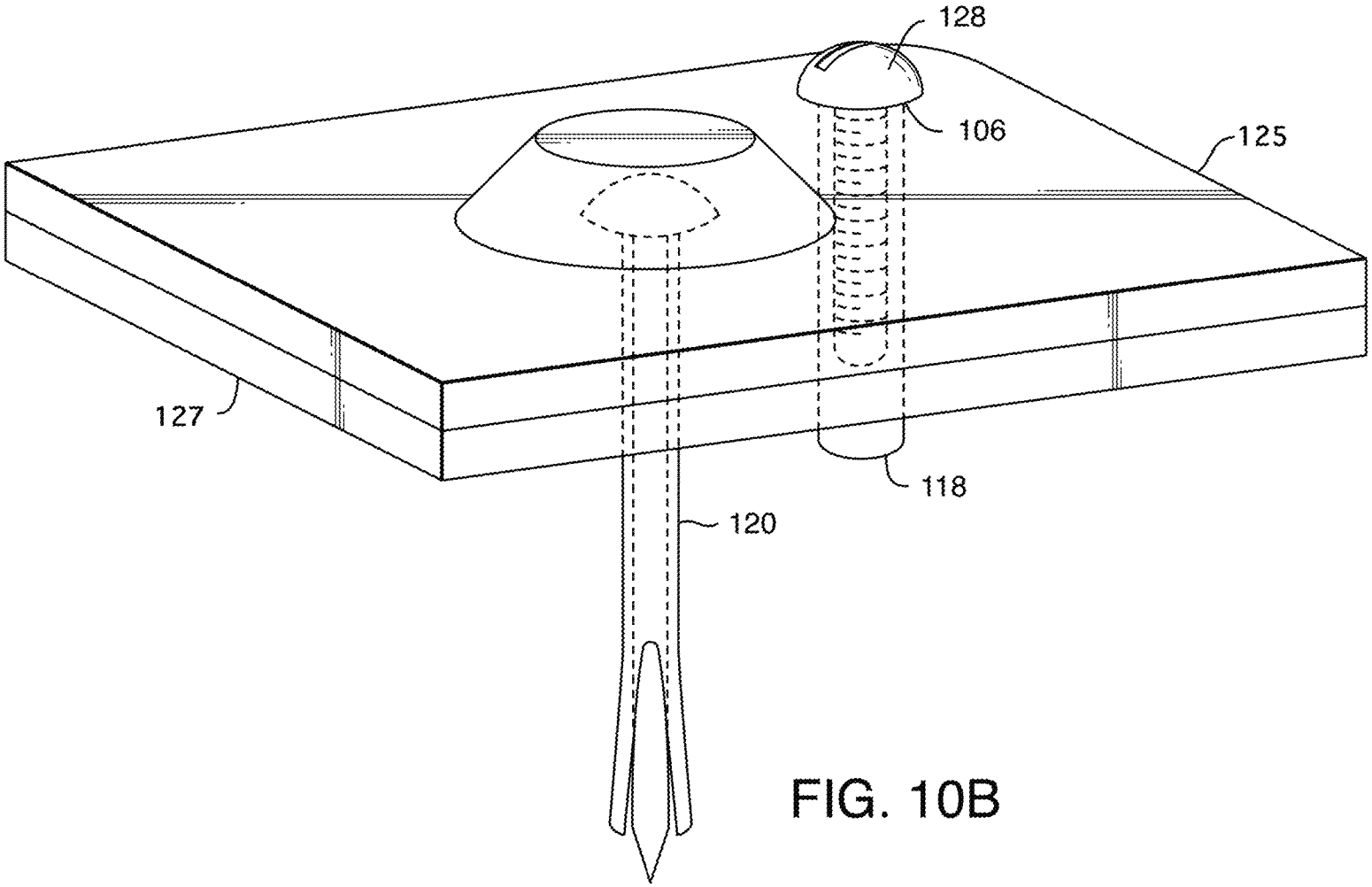
FIG. 10B illustrates the flush securement of the lower base plate onto the existing preformed ground surface and an upper tactile panel secured on top of the lower base plate.

In order to secure the double panel assembly, which includes an upper tactile panel and a lower base plate, the lower base plate must first be secured onto the existing preformed ground surface. FIG. 10A illustrates a lower base plate 127 secured to an existing preformed ground surface utilizing a nail drive expansion anchor 120 as well as illustrating a threaded receiver 118 mechanically attached to the lower base plate 127. FIG. 10B illustrates that once the lower base plate 127 has been secured onto the existing preformed ground surface, the upper tactile panel 125 is placed directly on top of the of the lower base plate 127 such that a threaded screw 128 is inserted through the round through-hole 106 in the upper panel 125 and rotationally torqued into the threaded receiver 118 in the lower base plate 127 in order to secure the two plates together. Accordingly FIG. 10B illustrates upper panel 125 and lower base plate 127 assembly in the secured condition.

Figure 11:
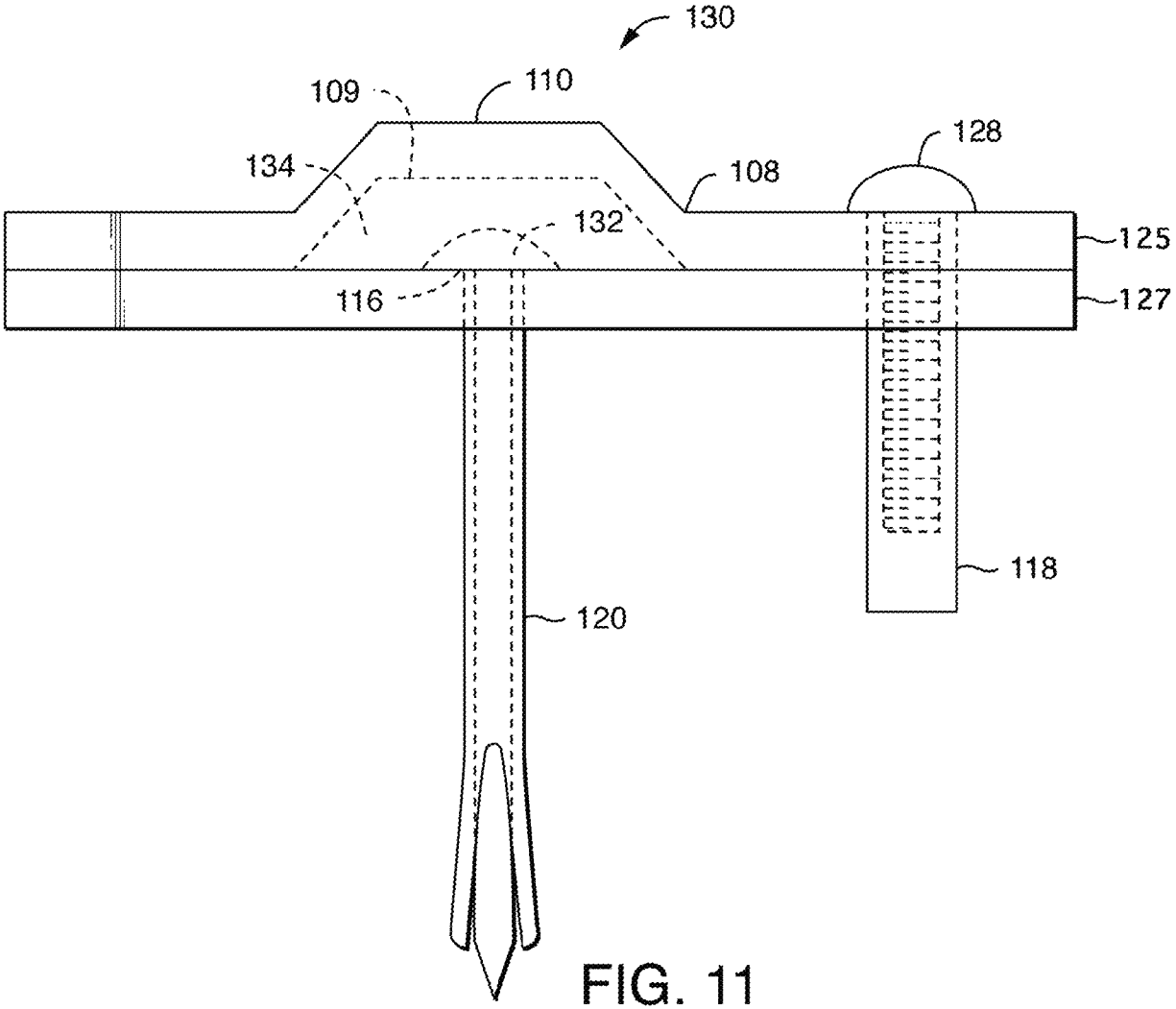
FIG. 11 illustrates a profile view of FIG. 10.

FIG. 11 illustrates a profile view of the secured double plate assembly 130 whereby the upper tactile panel 125 is secured to the lower base plate 127 utilizing threaded screws 128 secured into threaded receivers 118 (i.e., a securement member) whereby the entire double plate assembly 130 is secured to the existing ground surface by a nail drive expansion anchor 120 which are installed through the anchor-holes 116 in the lower base plate 127. This double plate system 130 works efficiently because there is a void cavity 134 created in the manufacturing of the upper plates 125 such that the upward projections FIG. 5A, 104 have an upper flat surface 110 and lower surface 109. This creates the void cavity 134 such that the head 132 of the nail drive expansion anchor 120 is aligned below the lower surface 109 of the upward projections FIG. 5A, 104.

Figure 12A:
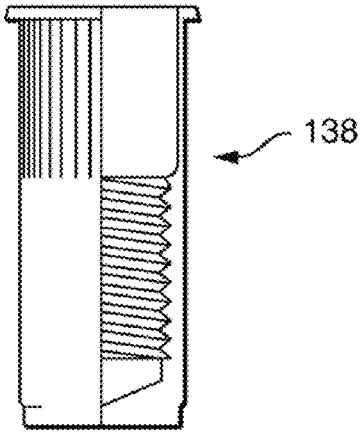
FIG. 12A illustrates an example of a one type of threaded receiver illustrating the internal threading of the receiver.
Figure 12B:
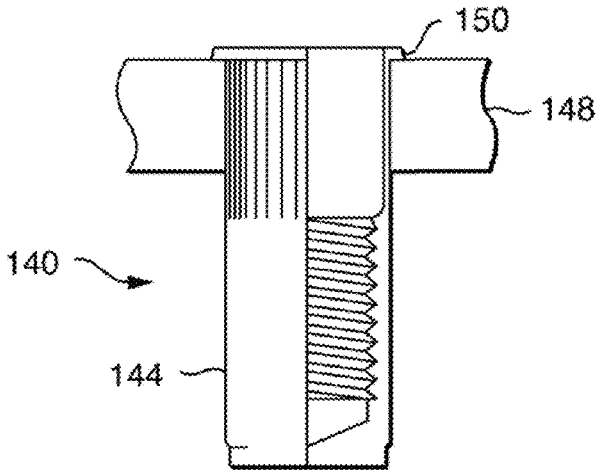
FIG. 12B illustrates a threaded receiver inserted through a hole in a plate.
Figure 12C:
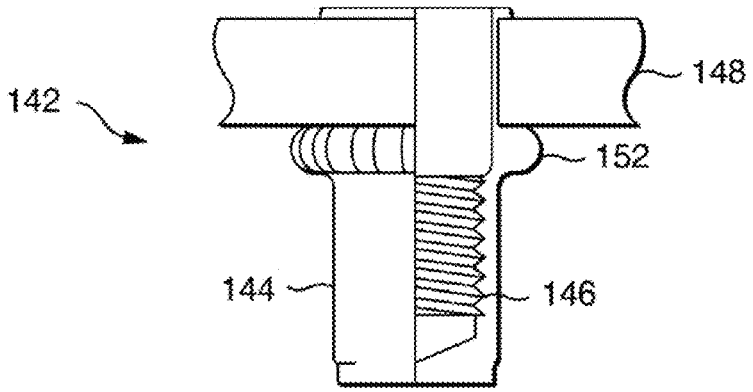
FIG. 12C illustrates a threaded receiver mechanically secured to a plate.

There are a number of different types of threaded receivers commercially available in the market that can be permanently affixed to a lower base plate that enable different types of fasteners to go into them in order to secure upper tactile panels to the lower base plates. FIG. 12A depicts one type of threaded receiver, called a rivnut (rivet nut) 138. Rivnuts 138 advantageously provide load-bearing threads in thin sheet materials too thin for a tapped thread. They can be installed in many different materials including steel, plastic and fiberglass and facilitate quick disassembly and reassembly of products and assemblies. They do not require welding to the base material, and will not damage prepainted material during the installation process. FIG. 12B illustrates the initial step in the installation of a rivnut assembly 140, the rivnut 144 is first inserted through a pre-drilled hole in a plate 148. The top of the rivnut 144 has a top flange 150 seating against the top surface of the plate 148, and an internally threaded shaft portion made of metal. After a rivnut has been inserted in the hole in the plate 148, a tool is applied to the rivnut exerting an upward force on the shaft sufficient to compress the shaft upwardly to form a flange FIG. 12C, 152 seating on the bottom surface of the plate 148, without disrupting the mechanical integrity of the internal threads FIG. 12C, 152. FIG. 12C illustrates the completed installation of the rivnut assembly 142 whereby the bottom portion of the rivnut 144 has been mechanically secured to the plate 148. A threaded fastener then secures the upper tactile panel to the plate utilizing the internal threading 146 of the installed rivnut assembly 142.

Figure 13C:
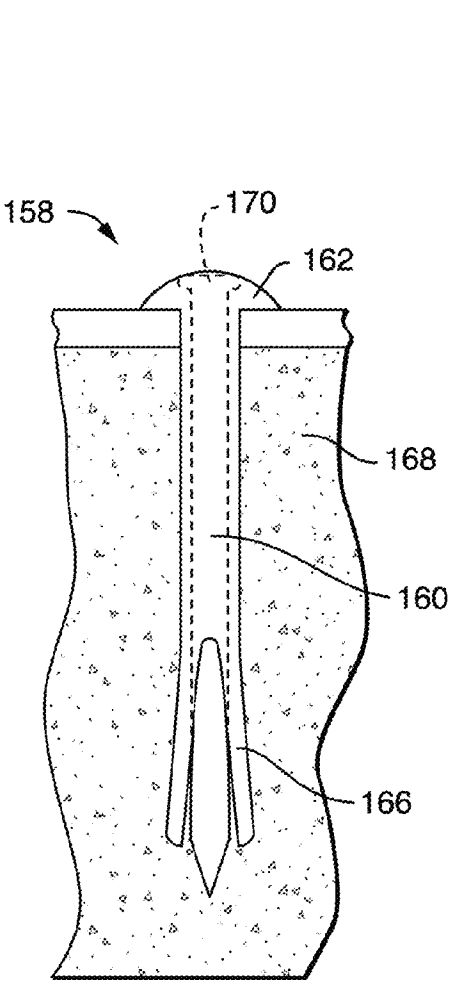
FIG. 13C illustrates a nail drive pin expansion anchor in the secured and/or expanded condition securing a plate onto an existing preformed ground surface.
Figure 13B:
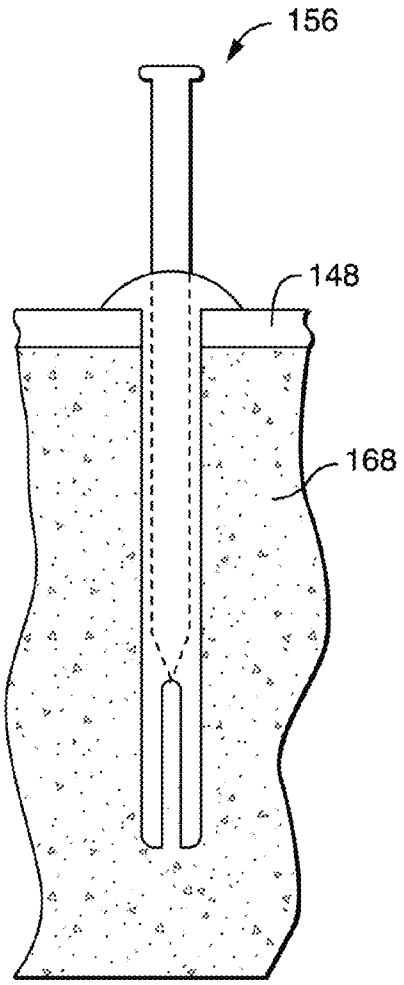
FIG. 13B illustrates a nail drive pin expansion anchor inserted through a plate down into a pre-drilled void cavity in an existing preformed ground surface.
Figure 13A:
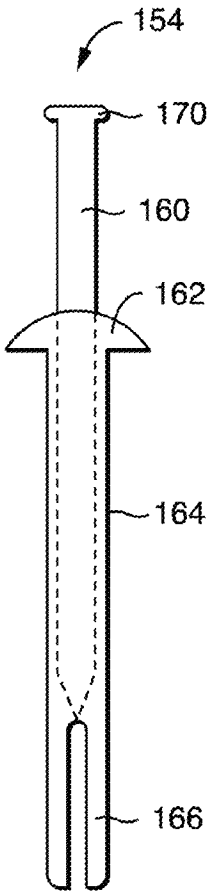
FIG. 13A illustrates an example of a nail drive pin expansion anchor.

To permanently affix a lower base plate to an existing preformed ground surface, the present invention can utilize many different styles of anchors. FIG. 13A, illustrates one style of an anchor which is called a nail drive expansion anchor 154. Nail drive expansion anchors 154 have a body section 164 incorporating an internal nail pin 160 with a flat head 170, a button top cap 162 and winged flanges 166 at the bottom. FIG. 13B illustrates an assembly 156 in which a nail drive expansion anchor has been inserted through a pre-drilled hole in a plate 148 down into a corresponding hole in the existing preformed ground surface 168. FIG. 13C illustrates that when the flat head 170 of the nail drive expansion anchor FIG. 13A, 154 is hammered downwardly, in the direction of the preformed ground surface 168 it causes the winged flanges 166 to expand thereby causing permanent expansion engagement of the winged flanges 166 to the walls of the pre-drilled cavity in the existing preformed ground surface 168 causing positive securement of the assembly.

Figure 14A:
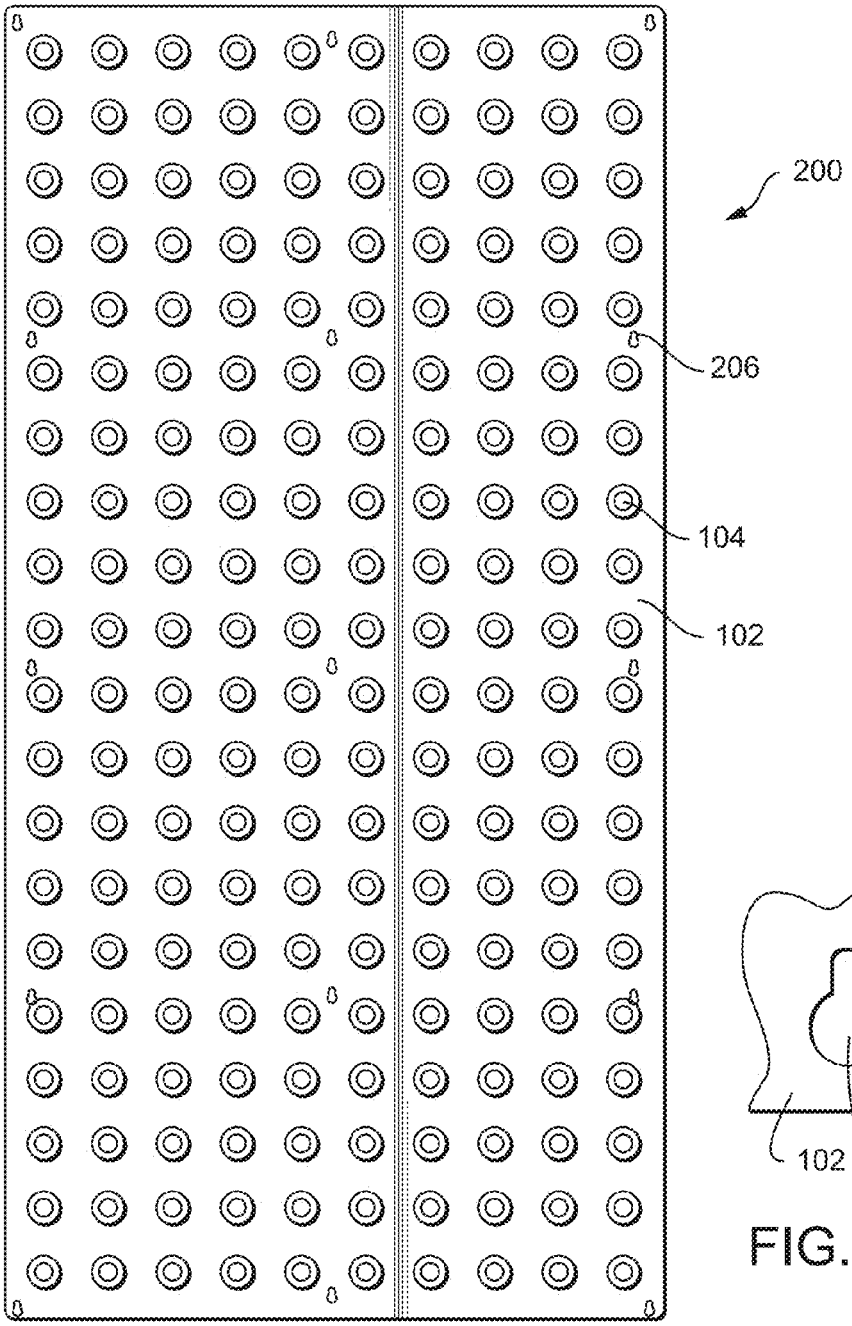
FIG. 14A illustrates a surface mount upper tactile panel consisting of a plurality of domes and a plurality of keyhole through-holes on the interior and around the perimeter.
Figure 14B:
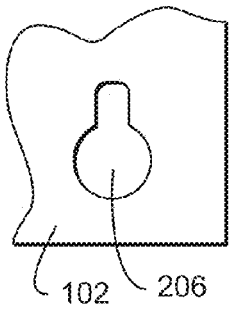
FIG. 14B illustrates the detail of a keyhole through-hole manufactured into an upper tactile panel.
Figure 15:
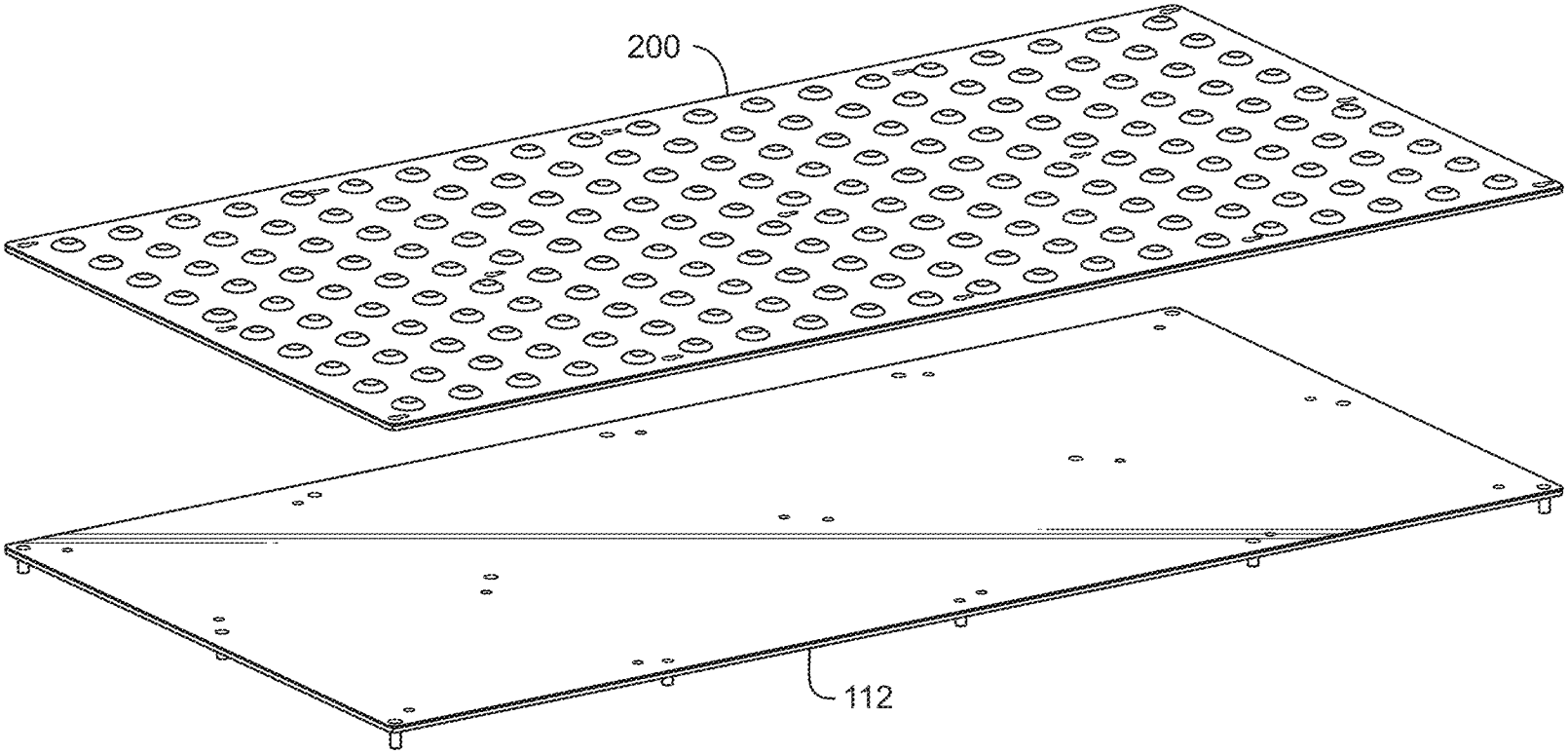
FIG. 15 illustrates a surface mount upper tactile panel consisting of a plurality of domes and keyhole through-holes and a lower base plate that has a plurality of threaded receivers and anchor-holes.
Figure 16:
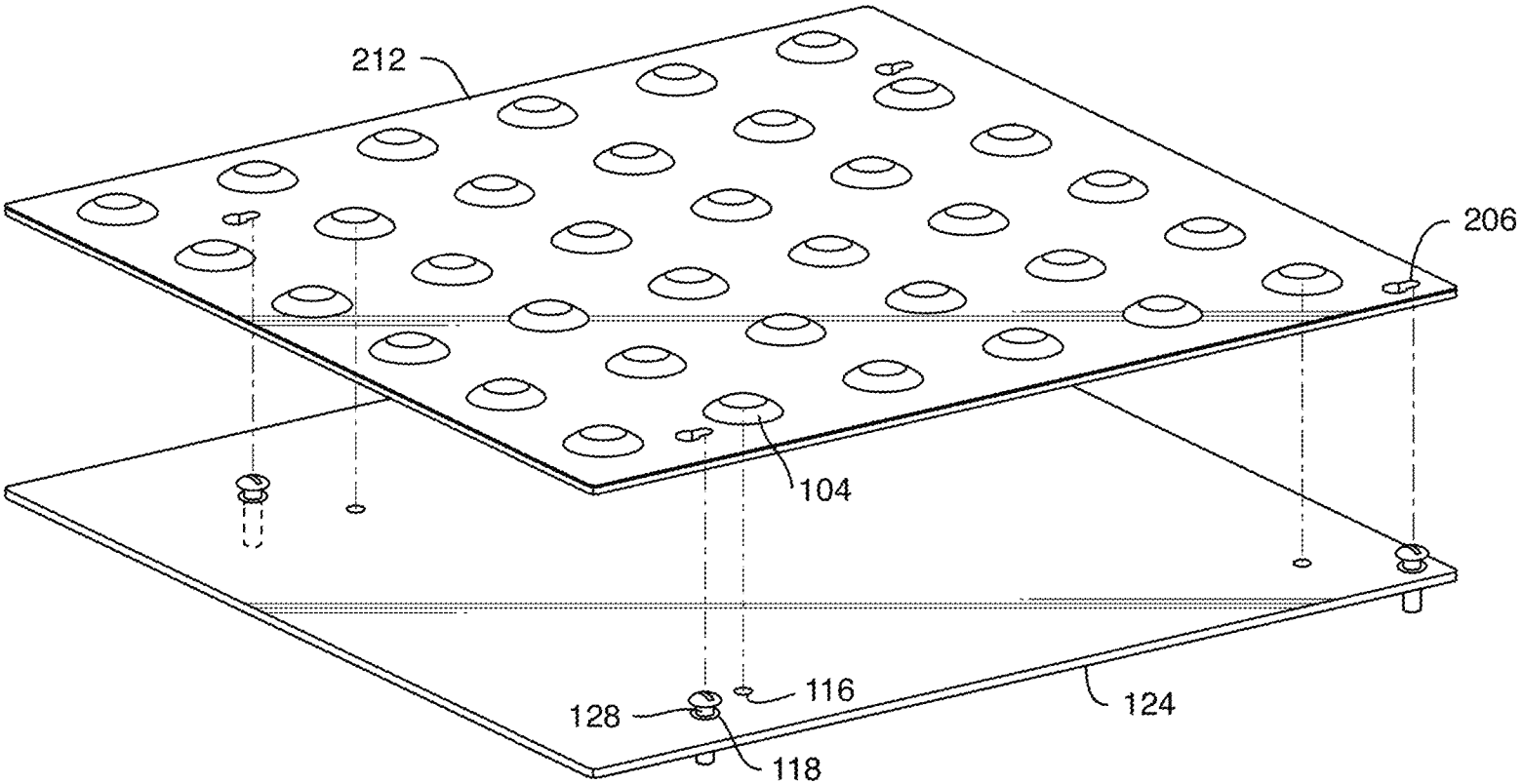
FIG. 16 illustrates a close up partial view of FIG. 15.
Figure 17:
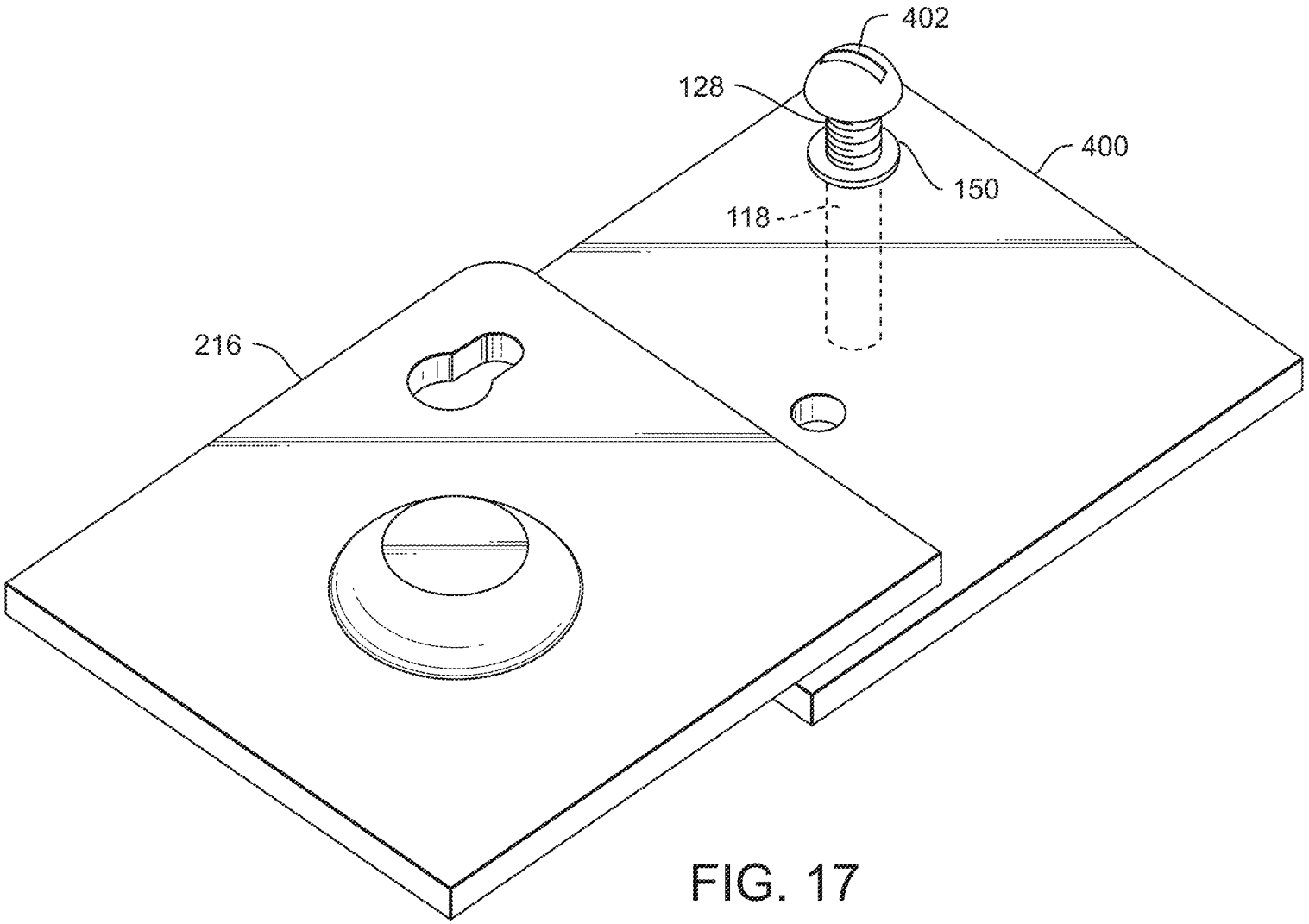
FIG. 17 illustrates an even closer view of the lower base plate and upper tactile panel assemblies.
Figure 18:
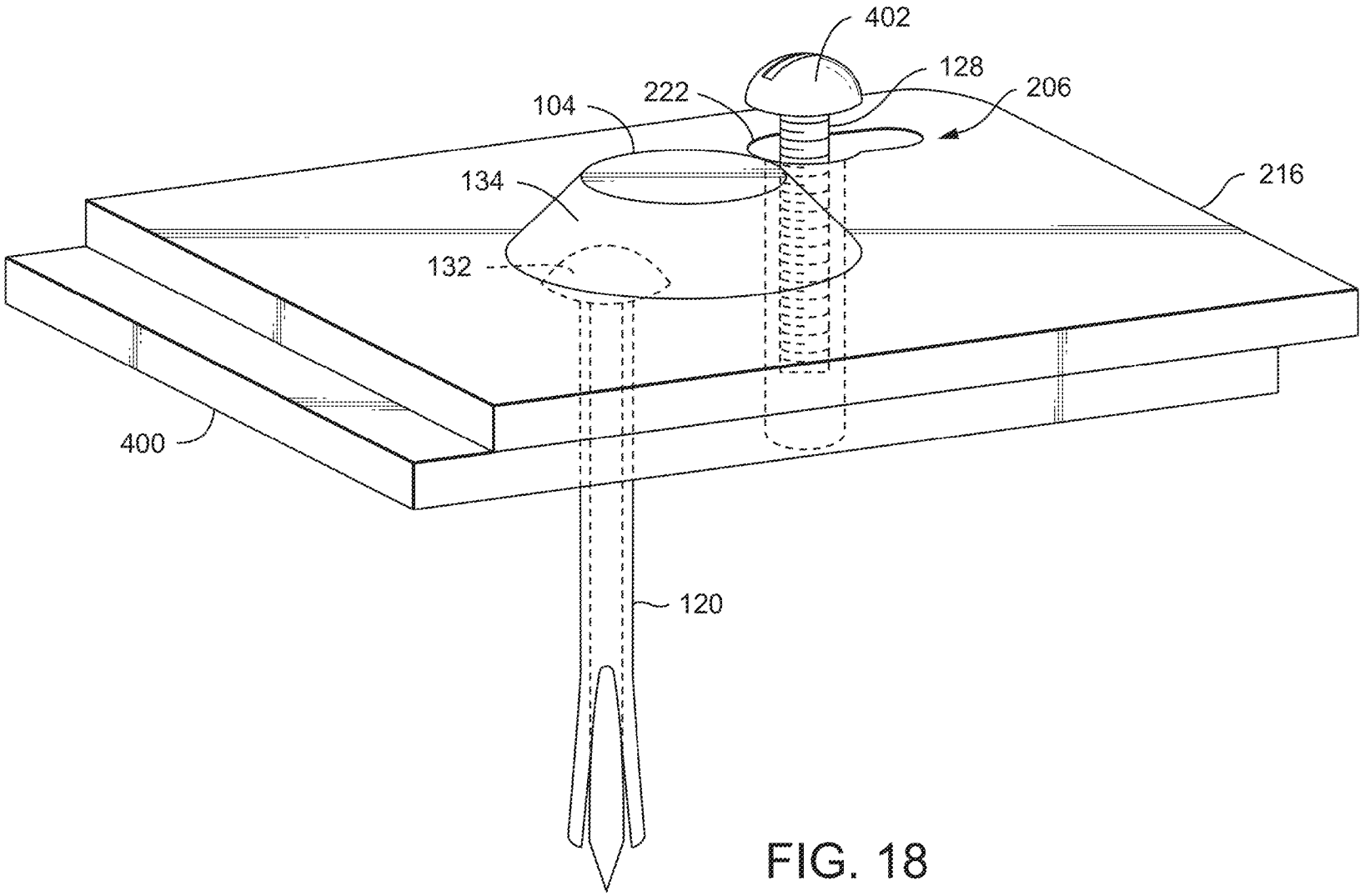
FIG. 18 illustrates the lower base plate secured to the existing preformed ground surface and an unsecured upper tactile panel flush on top of it.
Figure 19:
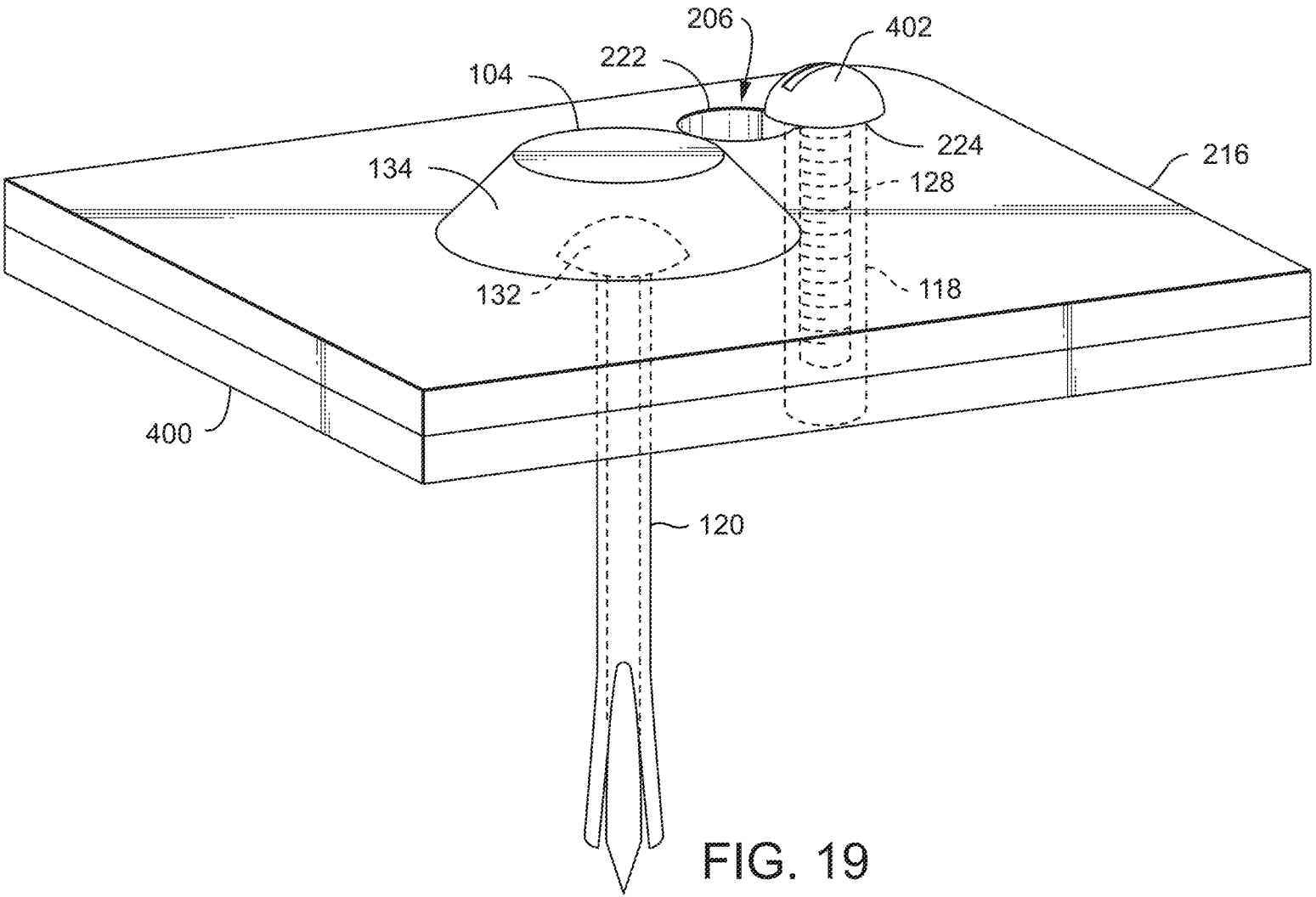
FIG. 19 illustrates the lower base plate secured to the existing preformed ground surface and an upper tactile panel in the secured on top of it.
Figure 20:
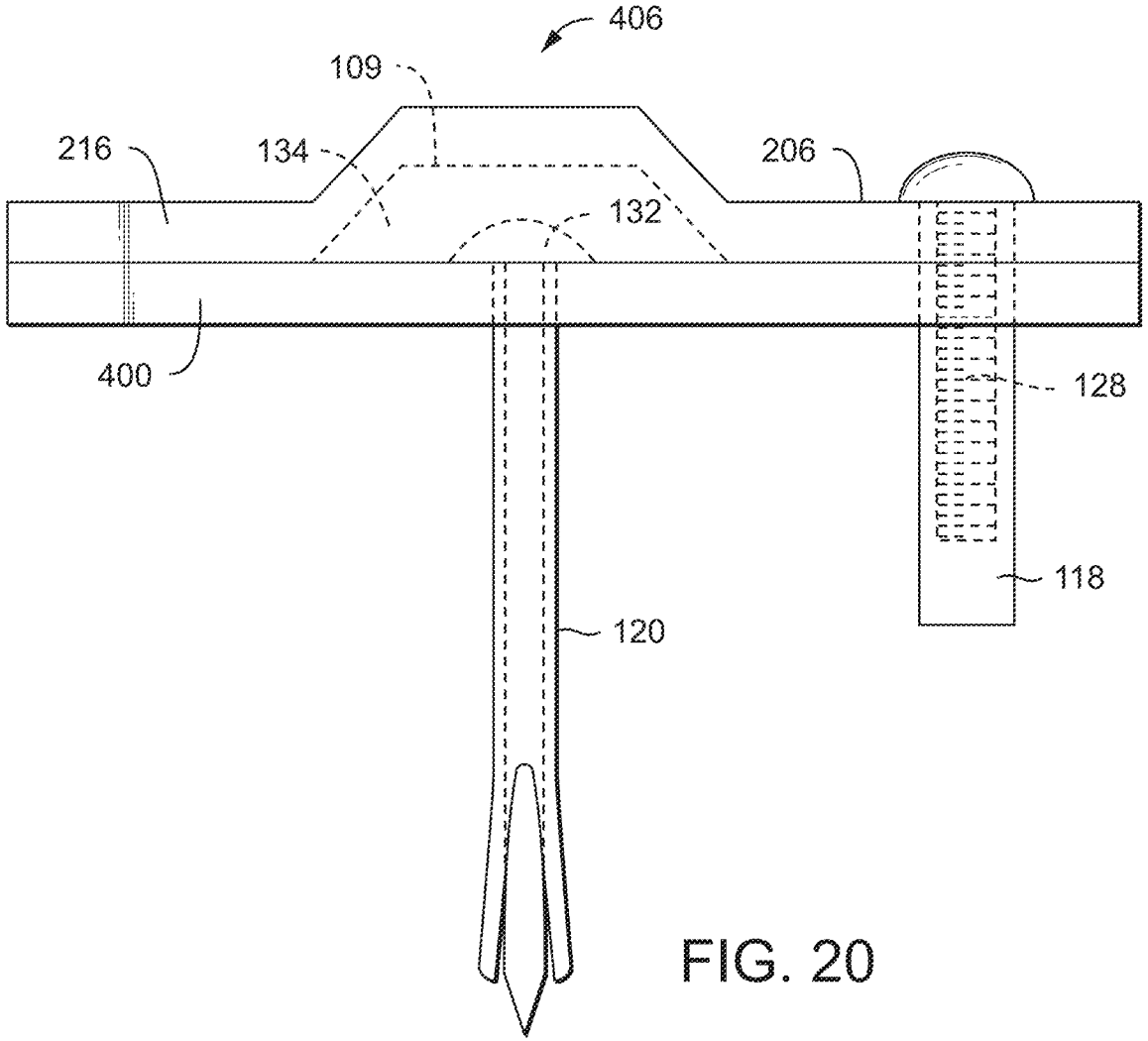
FIG. 20 illustrates a profile view of the double plate/panel assembly as described in FIG. 19.

The second embodiment for a tactile warning surface mount panel double panel assembly comprises an upper tactile panel as shown on FIG. 14A. FIG. 14A illustrates a tactile warning surface mount panel 200 incorporating an attention pattern on a solid substrate member 102. The upper tactile panel 200 contains a plurality of upward projections 104, extending upward from the surface of the solid member 102. Each upward projection 104 generally consists of a surface rising from a perimeter FIG. 11, 108 to a central top portion FIG. 11, 110. FIG. 14A illustrates the second design of the upper tactile panel 200, which utilizes a keyhole through-hole 206 design for the through-holes in the upper tactile panel 200. These keyhole through-holes 206 are used to secure the upper tactile panel 200 to the lower base plate. The keyhole through-holes 206 in the upper tactile panel 200 are an improvement over round through-holes and assist in the alignment of the upper tactile panel 200 through-holes with the receivers in the lower base plate. FIG. 14B illustrates that the design of this particular upper tactile panel FIG. 14A, 200 utilizes keyhole through-holes 206 manufactured in the solid member 102 which are used to secure upper tactile panel FIG. 14A, 200 to a lower base plate. FIG. 15 illustrates the upper tactile panel 200 positioned directly above a lower base plate 112. FIG. 16 illustrates an enlarged partial view of a small section of the upper tactile panel 212 and how the keyhole through-holes 206 in the upper tactile panel 212 align with the receivers 118 in the small section of the lower base plate 124. FIG. 16 also illustrates that the small section of the upper tactile panel 212 fits directly on top of the small section of the lower base plate 124 such that the upper tactile panel upward projections 104 align directly on top of the anchor-holes 116 in the lower base plate 124. The alignment of the anchor-holes 116 under in the void cavity FIG. 11, 134 of the upward projections 104 allows space for the head of the expansion fastener that are installed in the existing preformed ground surface. Similarly the keyhole through-holes 206 in the upper tactile panel 212 directly align with the threaded receivers 118 and threaded screws 128 in the lower base plate 124. FIG. 17 is a further enlarged view of the upper tactile panel 216 and the lower base plate 400. This tactile warning surface mount double plate assembly is designed such that threaded screws 128 have been inserted into the threaded receivers 118 and partially rotationally torqued such that the head 402 of the threaded screw 128 is still residing above the top flange 150 of the threaded receiver 118 prior to placing the upper plate 216 on top of it. In order to secure the upper tactile panel and lower base plate assembly together, the lower base plate 400 must first be secured to an existing preformed ground surface. An enlarged view of the upper tactile panel and lower base plate assembly is illustrated in FIG. 18. The tactile warning surface mount double panel assembly, FIG. 18, utilizes expansion anchors 120 to secure the lower base plate 400 to the existing preformed ground surface. Once the lower base plate 400 is secured to the existing preformed ground surface, the upper panel 216 is placed directly on top of the lower base plate 400 such that the head 402 of the threaded screw 128 is protruding up through the larger end 222 of the keyhole 206 on the upper tactile panel 216. When the upper tactile panel 216 is in the unsecured position the head 402 of the threaded screw 128 is positioned above the surface of the upper tactile panel 216 and residing in the larger end 222 of the keyhole through-hole 206. In addition, the head 132 of the expansion anchor 120 is offset in the void cavity 134 of the upward projection 104. Securement of the upper tactile panel to lower base plate is illustrated in FIG. 19. In order to secure the upper tactile panel 216 to the lower base plate 400 the upper tactile panel 216 is physically shifted laterally in the opposite direction of the larger end 222 of the keyhole 206 towards the smaller end 224 of the keyhole. The threaded screw 128 may then be further rotationally torqued into the threaded receiver 118 such that the head 402 of the threaded screw becomes flush with the upper panel 216 securing it and the lower base plate 400 assembly together. With laterally shifting of the upper panel 216, the head 132 of the expansion anchor 120 is now directly in the center of the void cavity 134 of the upward projection 104. FIG. 20 illustrates a profile view of the secured upper tactile panel 216 to lower base plate 400 comprising the double panel assembly 406. The upper tactile panel 216 is secured to the lower base plate 400 using a threaded screw 128 mated to the threaded receiver 118. The threaded screw is inserted and rotationally torqued through a keyhole through-hole 206 in the upper tactile panel 216. The diameter of the head FIG. 19, 402 of the threaded screw FIG. 19, 128 is larger than the diameter of the keyhole through-hole 206 at the small end FIG. 19, 224 thereof, but smaller than the diameter of the keyhole through-hole 206 at the large end FIG. 19, 224, thereby permitting the head FIG. 19, 402 of the threaded screw 128 to pass through the keyhole through-hole 206 in the unsecured position, but is restrained by the edges of the keyhole through-hole 206 in the secured position. In the figures the keyholes are shown in parallel orientation. However, the directionality is not important so long as the keyholes are bored precisely parallel to each other. The advantage conferred by this embodiment is that exchange of the upper panel 216 is facilitated by merely loosening the threaded screws 128, sliding the plate to the unsecured position, lifting off the upper panel 216 and replacing it with another such panel without removing the screws completely.

Figure 21A:
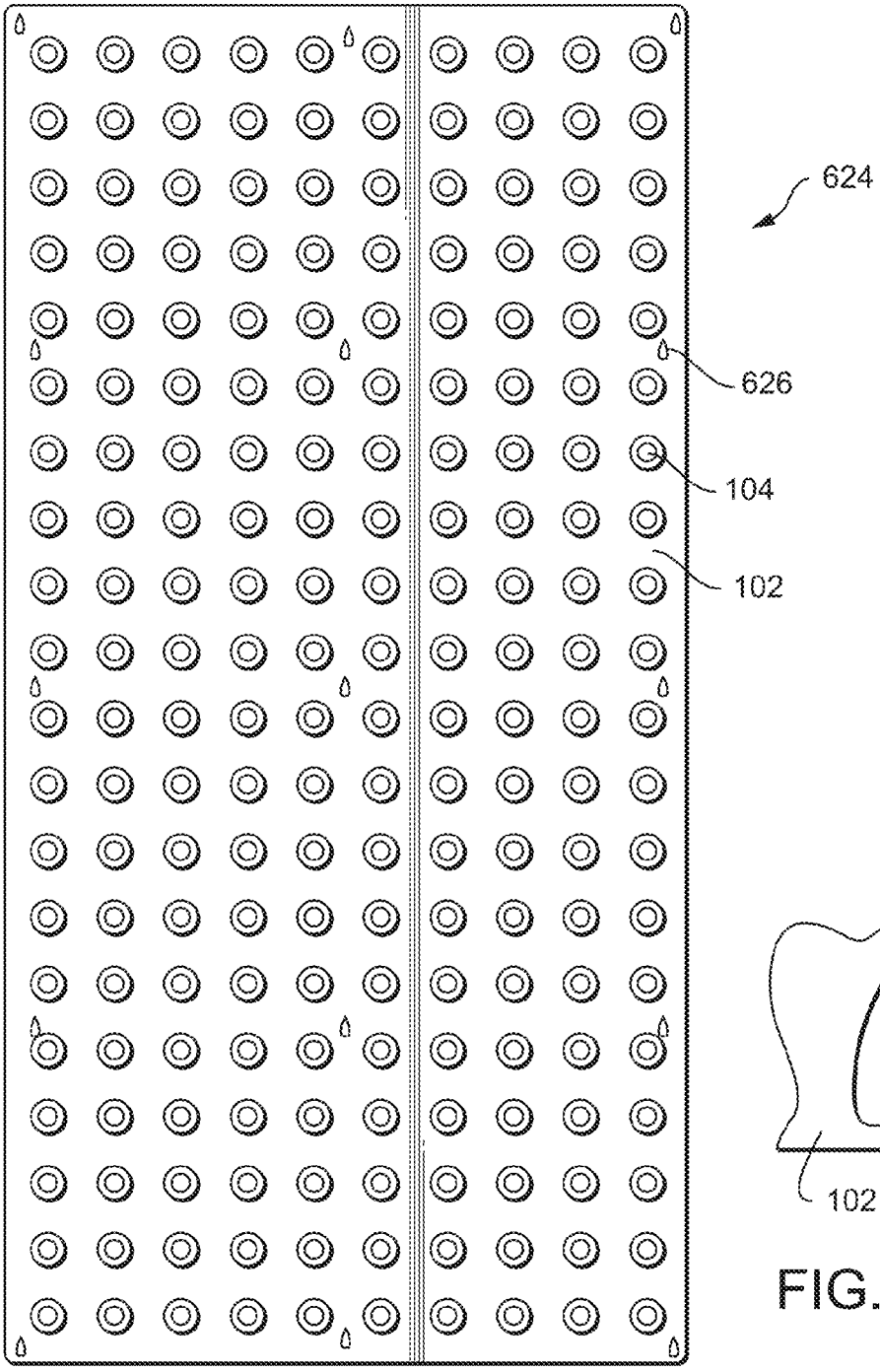
FIG. 21A illustrates a surface mount upper tactile panel consisting of a plurality of domes and a plurality of teardrop through-holes on the interior and around the perimeter.
Figure 21B:
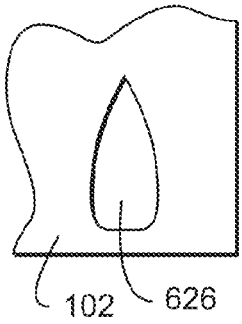
FIG. 21B illustrates a detail of a teardrop through-hole manufactured into an upper tactile panel.

The third embodiment for the tactile warning surface mount double panel assembly consists of an upper tactile panel as illustrated on FIG. 21A. FIG. 21A illustrates an upper panel 624 incorporating an attention pattern constructed of a solid substrate 102. The upper panel 624 contains a plurality of upward projections 104 extending upwards from the surface of the solid substrate 102. Each upward projection 104 generally consists of a surface rising from a perimeter FIG. 11, 108 to a central top portion FIG. 11, 110. FIG. 21A illustrates the third design of the upper panel, which utilizes teardrop through-holes 626 in the upper panel 624. These teardrop through-holes are used to secure the upper panel 624 to a lower base plate. The teardrop through-hole 626 in the upper panel 624 is an improvement over round through-holes FIG. 5A, 106 and assist in the alignment of the upper panel 624 teardrop through-holes 626 with the receivers in the lower base plate. FIG. 21B illustrates an enlarged view of the teardrop through-hole 626 design on the upper panel FIG. 21A, 102 of the solid substrate.

Figure 22A:
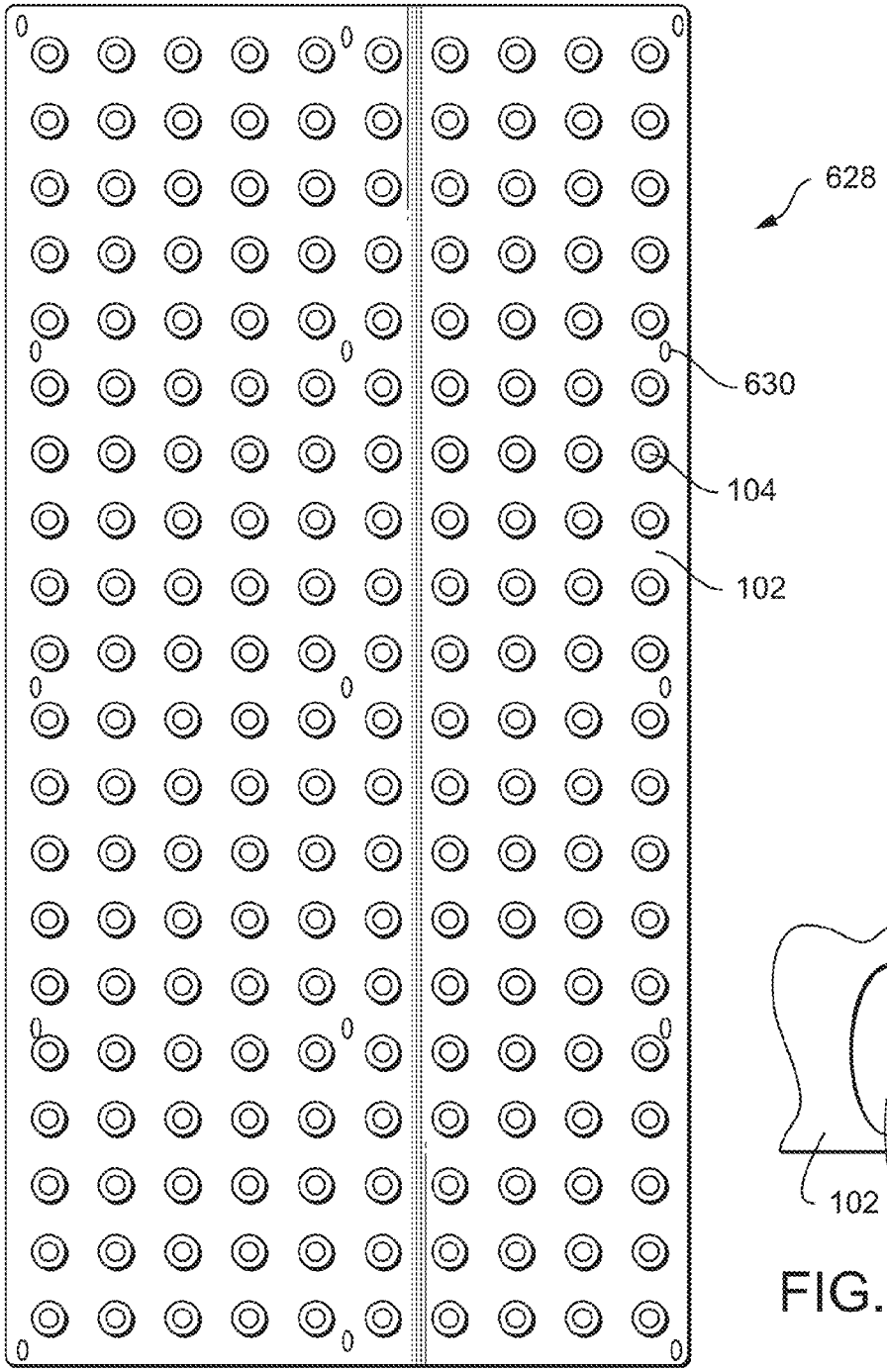
FIG. 22A illustrates a surface mount upper tactile panel consisting of a plurality of domes and a plurality of oblong through-holes on the interior and around the perimeter.
Figure 22B:
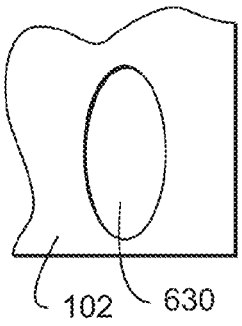
FIG. 22B illustrates the detail of an oblong through-hole manufactured into an upper tactile panel.

The fourth embodiment for the tactile warning surface mount double panel assembly consists of an upper panel as shown on FIG. 22A. FIG. 22A illustrates an upper panel 628 incorporating an attention pattern constructed of a solid member 102. The upper panel 628 contains a plurality of upward projections 104 extending upwards from the surface of the solid member 102. Each upward projection 104 generally consists of a surface rising from a perimeter FIG. 11, 108 to a central top portion FIG. 11, 110. FIG. 22A illustrates the fourth design of an upper panel 628, which utilizes an oblong through-hole 630 in the upper panel 628. These oblong through-holes 630 are used to secure an upper panel 628 to a lower base plate, and are configured similarly to the keyhole through-hole FIG. 14A, 206 in that the widest dimension of the oblong through-hole 630 permits passage of the head of a retaining screw, and at the narrower dimensions accommodates only the shaft of the screw. The oblong through-holes 630 in the upper tactile panel 628 assist in the alignment of the upper tactile panel with the receivers in the lower base plate. FIG. 22B illustrates an enlarged view of a teardrop through-hole 630 design on the upper tactile panel FIG. 22A, 628 on the solid substrate 102.

Figure 23A:
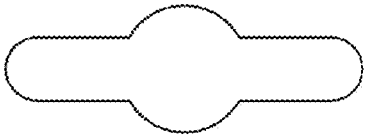
FIG. 23A illustrates a through-hole design that has a larger round middle area and two oblong ends on both the easterly and westerly of the round middle area.
Figure 23B:
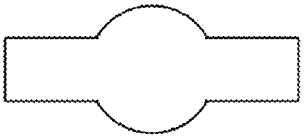
FIG. 23B illustrates a through-hole design that has a larger round middle area and two rectangular ends on both the easterly and westerly of the round middle area.
Figure 23C:
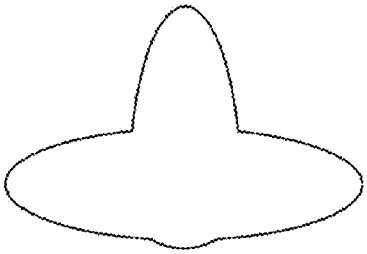
FIG. 23C illustrates a through-hole design that has a larger round middle area and three oblong sections one pointing northerly, one pointing easterly and one pointing westerly.
Figure 23D:
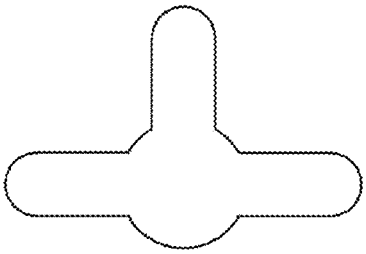
FIG. 23D illustrates a through-hole design that has a larger round middle area and three oblong sections one pointing northerly, one pointing easterly and one pointing westerly.
Figure 23E:
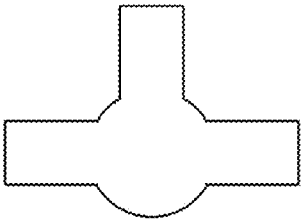
FIG. 23E illustrates a through-hole design that has a larger round middle area and three rectangular sections one pointing northerly, one pointing easterly and one pointing westerly.
Figure 23F:
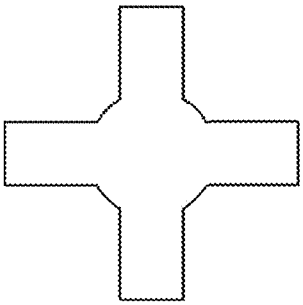
FIG. 23F illustrates a through-hole design that has a larger round middle area and four rectangular sections one pointing northerly, one pointing southerly, one pointing easterly and one pointing westerly.
Figure 23G:
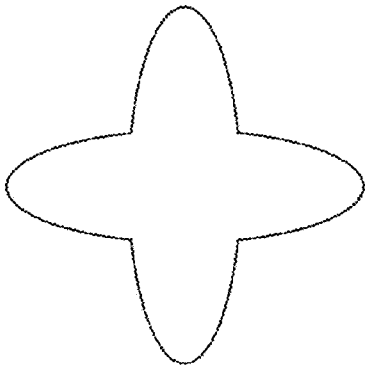
FIG. 23G illustrates a through-hole design that has four oblong sections one pointing northerly, one pointing southerly, one pointing easterly and one pointing westerly.
Figure 23H:
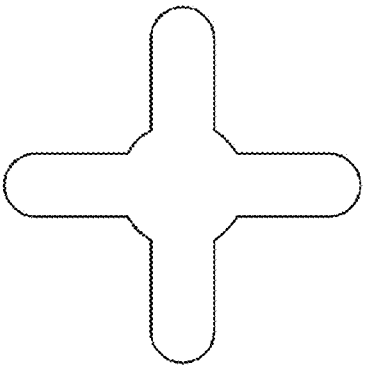
FIG. 23H illustrates a through-hole design that has a larger round middle area and four oblong sections one pointing northerly, one pointing southerly, one pointing easterly and one pointing westerly.

There are numerous other through-hole designs on upper panels that could be used, or any combination thereof, for through-holes that can be used to achieve upper panel to lower base plate securement. Examples of different through-hole designs are shown on FIGS. 23A, 23B, 23C, 23D, 23E, 23F, 23G and 23H. Thus, there are many configurations of apertures that embody the present invention. The common requirements are that each have at least one aperture section capable of receiving the widest structure of the securing fastener, and at least one or a plurality shaft passage routes not large enough to release the fastener head, all oriented in the same parallel configuration. All of these particular designs have a round hole in the center to accept the lower base plate attached threaded receivers or standoff studs. Which through-hole design is utilized depends on the ability of the receiver on the lower base plate to align with the through-hole in the upper panel. FIG. 23A illustrates a through-hole design that has a larger middle round area and two oblong ends on both the easterly and westerly sides of the through-hole. FIG. 23B illustrates a through-hole design that has a larger round area in the middle and two rectangular ends on both the easterly and westerly sides of the through-hole. FIG. 23C illustrates a through-hole design that has a larger round area in the middle and three oblong sections one pointing northerly, one pointing easterly and one pointing westerly. FIG. 23D illustrates a through-hole design that has a larger middle round area and three oblong sections one pointing northerly, one pointing easterly and one pointing westerly. FIG. 23E illustrates a through-hole design that has a larger middle round area and three rectangular sections one pointing northerly, one pointing easterly and one pointing westerly. FIG. 23F illustrates a through-hole design that has a larger middle round area and four rectangular sections one pointing northerly, one pointing southerly, one pointing easterly and one pointing westerly. FIG. 23G illustrates a through-hole design that has a larger round area in the middle and four oblong sections one pointing northerly, one pointing southerly, one pointing easterly and one pointing westerly. FIG. 23H illustrates a through-hole design that has a larger middle round area and four oblong sections one pointing northerly, one pointing southerly, one pointing easterly and one pointing westerly.

Figure 24A:
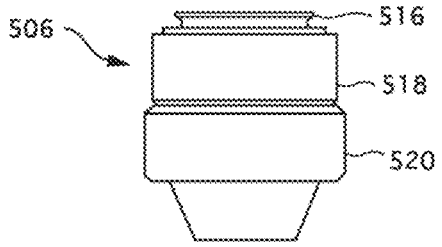
FIG. 24A illustrates a profile view of a quick release fastener.
Figure 24B:
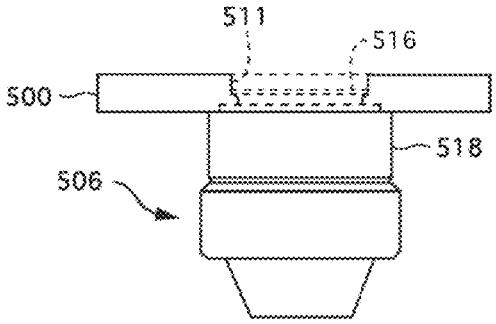
FIG. 24B illustrates a profile view of a quick release fastener mechanically secured to a lower base plate.
Figure 24C:
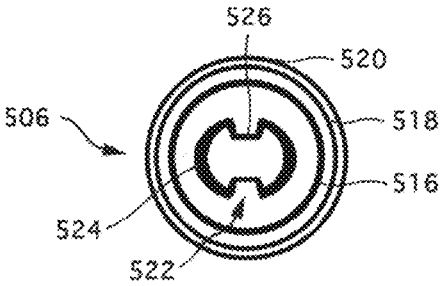
FIG. 24C illustrates a plan view of a quick release fastener.
Figure 24D:
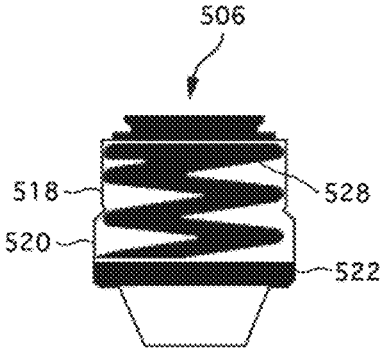
FIG. 24D illustrates a profile cut away view of the internal components of a quick release fastener.
Figure 24E:
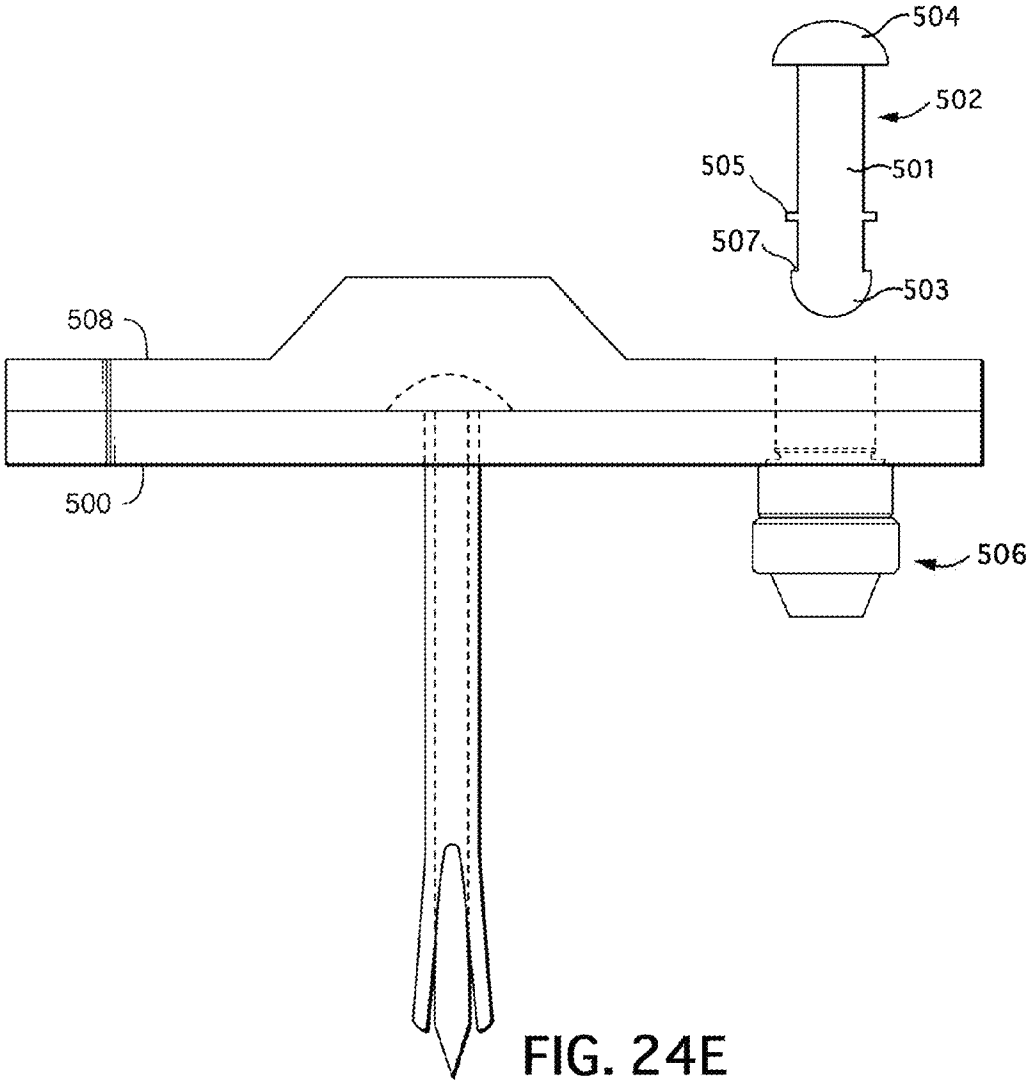
FIG. 24E illustrates a profile view of flush securement of a lower base plate onto an existing preformed ground surface and an upper tactile panel unsecured and placed on top it.
Figure 24F:
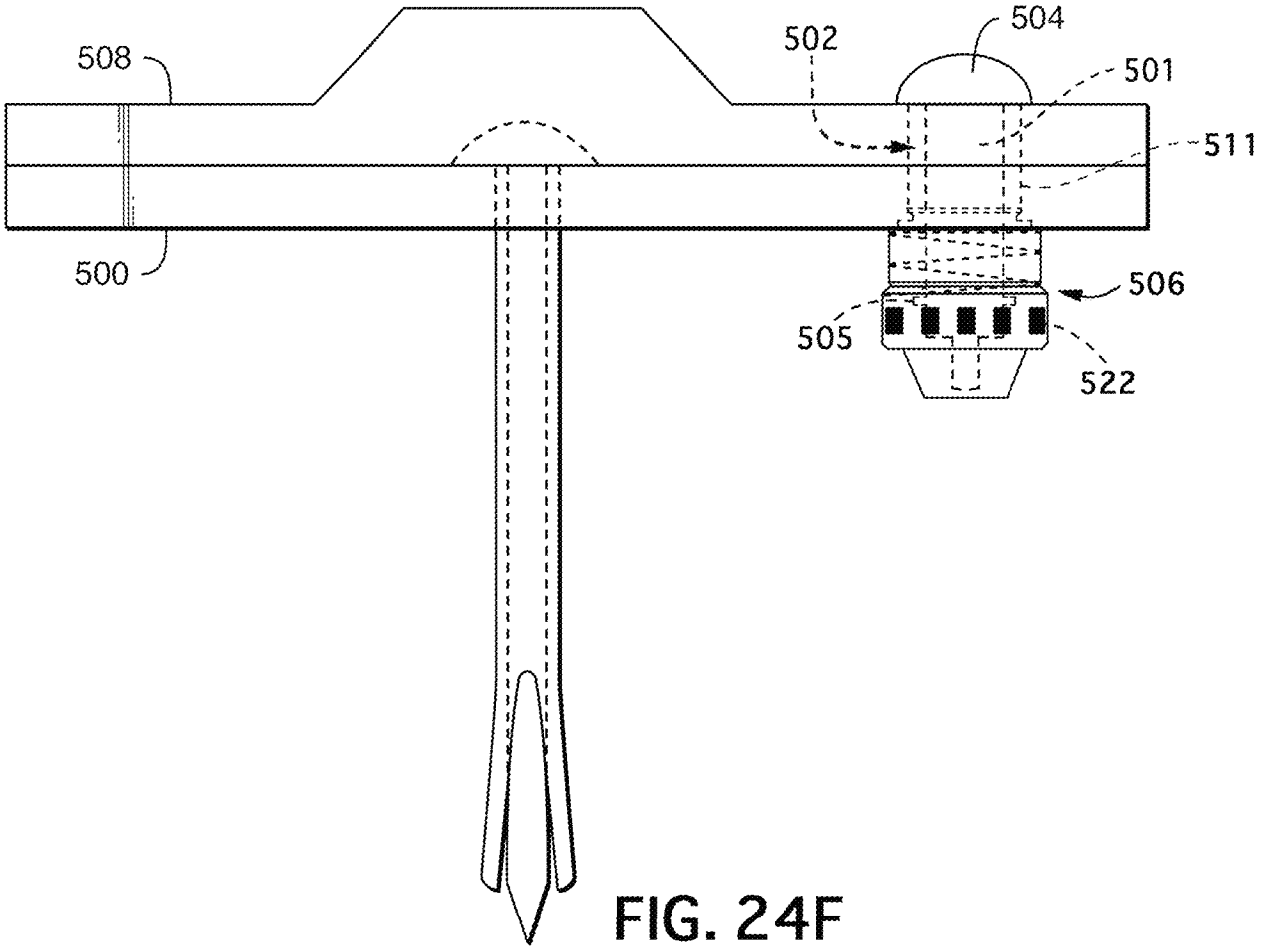
FIG. 24F illustrates an unsecured quick release stud that has been inserted through a round through-hole in the upper tactile panel and into a quick release receiver on the lower base plate.
Figure 24G:
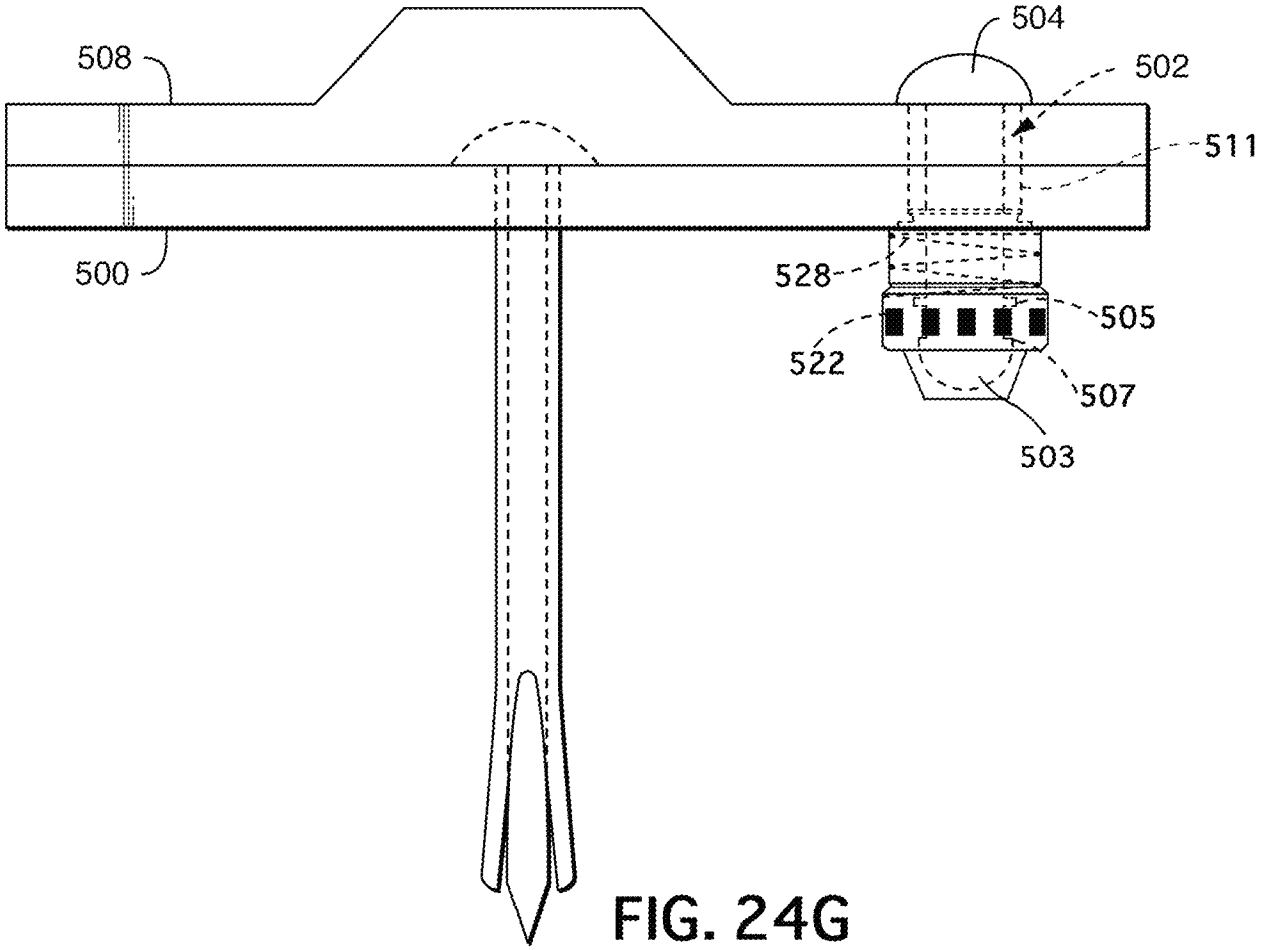
FIG. 24G illustrates a secured quick release stud into the quick release receiver on the lower base plate securing the upper plate and lower base plate assembly.

There are a many different types of receivers that can be permanently affixed to the lower base plate. Threaded receivers require loosening of a mated threaded screw to remove and replace the upper tactile panel from the lower base plate. Accordingly, such removal and replacement of the upper tactile panel is even more convenient and efficient, when the lower base plate receiver is a quick release receiver securing an upper panel with a quick release fastener. One type of quick release receiver and fastener system is a quarter turn fastener assembly, manufactured by Southco, Inc in Concordville, Pa., as depicted in FIG. 24A, FIG. 24B, FIG. 24C and FIG. 24D. This type of quarter turn receiver 506, shown in the uninstalled condition is illustrated in FIG. 24A and generally consists of a securement flange 516, an upper body 518 and a body cap 520. FIG. 24B illustrates the quarter turn receiver 506 mechanically pressed-in or clinch secured to a lower base plate 500. Prior to securing a quarter turn receiver 506 to the lower base plate 500, round through holes 511 are manufactured into the lower base plate 500 that enable the quarter turn receivers 506 securement flange 516 to be pressed-in or clinch secured to the lower base plate 500 achieving permanent securement of the assembly. FIG. 24B depicts the quarter turn fastener 506 secured to the lower base plate 500 whereby the material of the lower base plate 500 has cold-flowed into the securement flange 516 during mechanical securement. Additionally it illustrates the condition where the top of the upper body 518 of the quarter turn fastener 506 is seated against the bottom side of the lower base plate 500. FIG. 24C illustrates a plan view of the quarter turn fastener 506 whereby the exterior components are depicted as the securement flange 516, the upper body 518 and the body cap 520 while the internal components of the quarter turn receiver 506 consist of a fastener retainer 522 which has wider rounded sections 524 on two sides and a trapezoidal reduction 526 on the two adjacent sides and a spring FIG. 24D, 528. FIG. 24D is cut through detail of the quarter turn receiver 506 showing the retainer 522 and spring 528 of which are encapsulated within the upper body 518 and the body cap 520 of the quarter turn receiver 506. FIG. 24E illustrates a quarter turn receiver 506 mechanically affixed to a lower base plate 500 on top of which a tactile upper plate 508 is placed in the unsecured condition. FIG. 24E further illustrates a quarter turn fastener 502 and the components parts thereof. The component parts of the quarter turn fastener include a button head 504, a shaft section 501 which includes a designed rim stop 505, and a 90 degree corner 507 at the top of the button screw style base section 503. FIG. 24F illustrates the first step in securing an upper tactile plate 508 to a lower base plate 500 utilizing a quarter turn fastener 502 and quarter turn receiver 506 (i.e., a securement member). One must first insert the quarter turn fastener 502 through the round through hole FIG. 5A, 106 in the upper tactile panel 500 and the round through hole 511 in the lower base plate down into the quarter turn receiver 506. Once the quarter turn fastener 502 is fully inserted into the quarter turn receiver 506, the rim stop 505 will be directly against the fastener retainer 522 and the button head 504 will be seated on top of the upper tactile plate 508 and ready for securement. The final step to secure the upper tactile panel to the lower base plate 500, as illustrated in FIG. 24G, is to press down slightly on the button head 504 while at the same time rotationally torqueing the button head 504 one quarter turn. The downward force loosens the spring 528 allowing the retainer 522 to also loosen within the quarter turn receiver 506 assembly and allows the button style base section 503 to rotate from the wider rounded sections, FIG. 24C, 524 to the trapezoidal reduction FIG. 24C, 526 portions of the retainer 522. Also in doing so the retainer 522 in the quarter turn receiver 502 engages the designed rim stop 505 and the 90 degree corner 507 on the button style screw section 503 securing the quarter release fastener 502 into the quarter turn receiver 506. Once the downward pressure on the button head 504 is released the spring is released back into full tension further securing the quarter turn fastener 502 into the quarter turn receiver 506.

Figure 25:
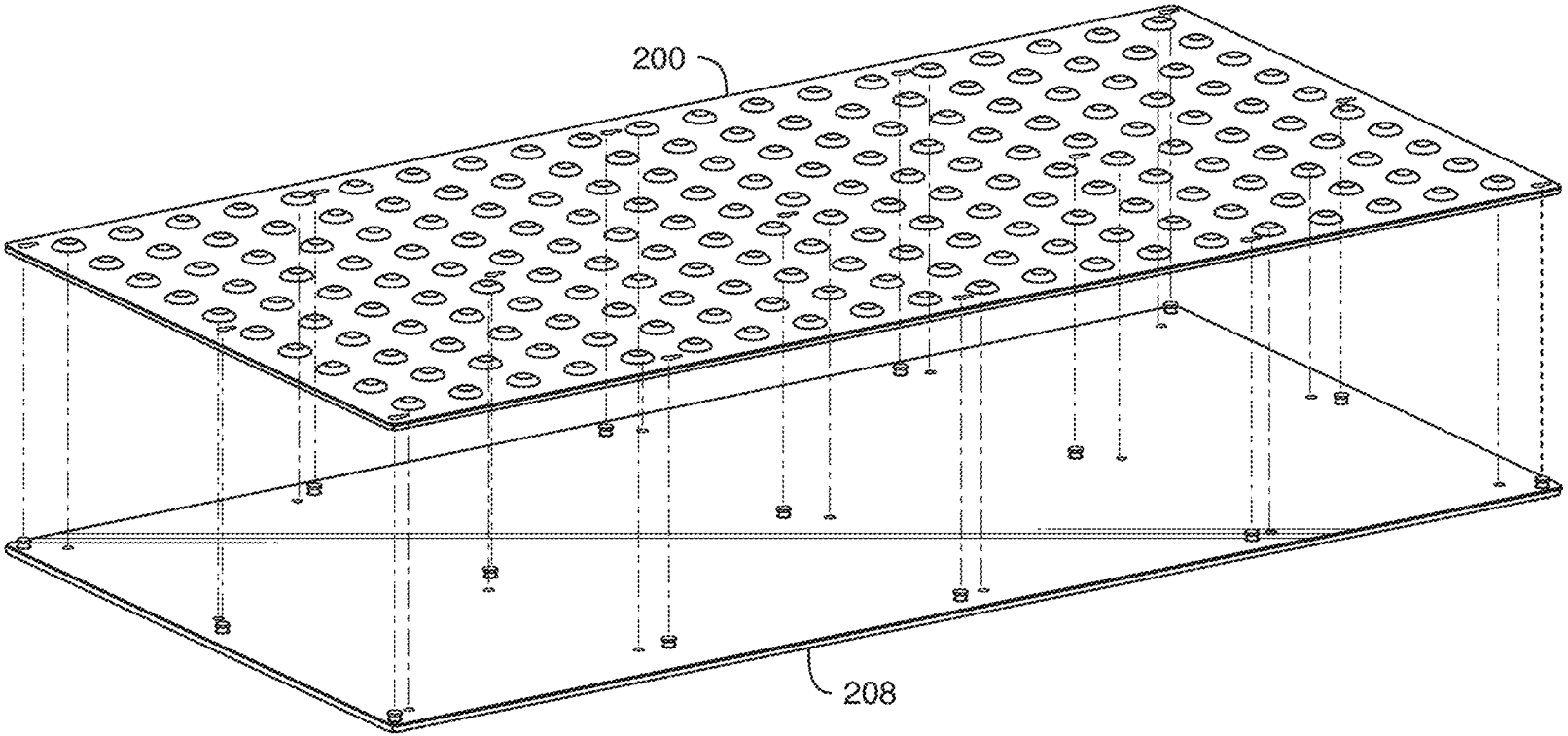
FIG. 25 illustrates a lower base plate with a plurality of anchor-holes and an associated plurality of standoff studs on the lower base plate. It also illustrates an upper tactile panel with a plurality of domes and a plurality of keyhole through-holes that line up with the standoffs studs on the lower base plate.

The fifth embodiment for the tactile warning surface mount panel double panel assembly consists of an upper tactile panel FIG. 14A, 200 with a plurality of keyholes through-holes FIG. 14B, 206 around the perimeter and interior of the upper tactile panel 200. The upper tactile panel 200 with keyhole through-holes 206 is used to facilitate securement of the surface mount double plate assembly to a lower base plate FIG. 25, 208.

Figure 26:
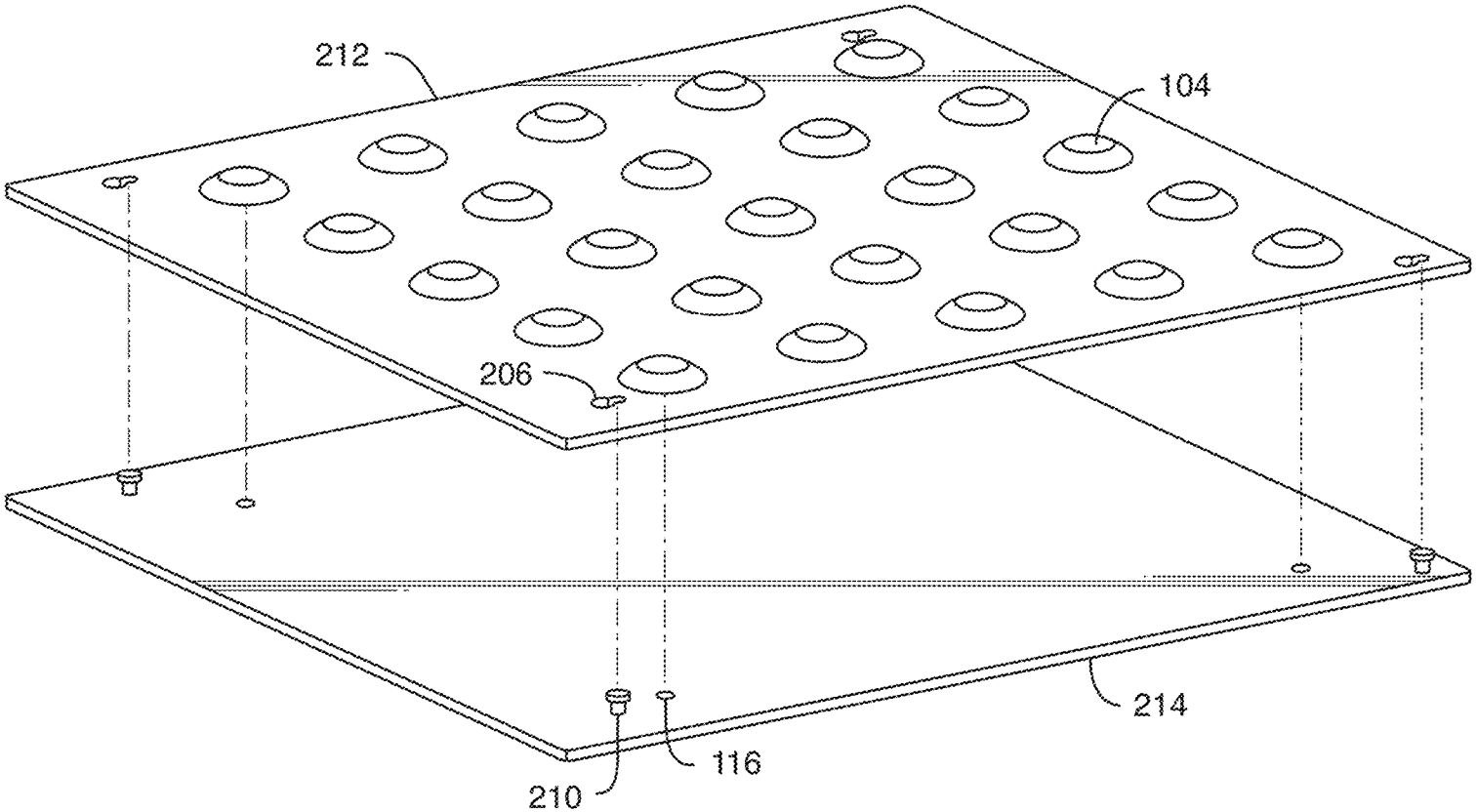
FIG. 26 illustrates an expanded/close up partial section of FIG. 25.
Figure 27:
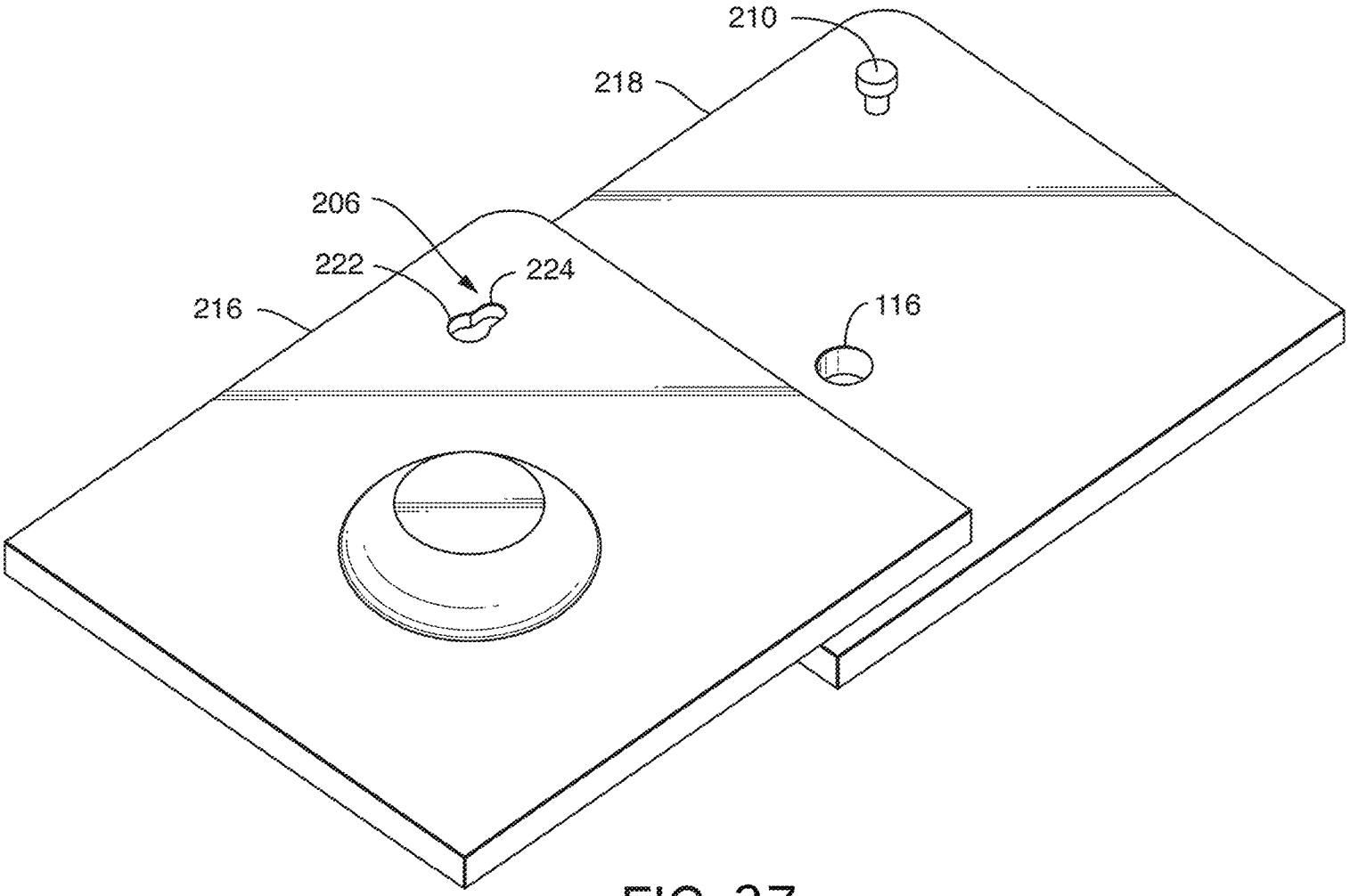
FIG. 27 illustrates a closer view of the lower base plate and upper tactile panel assembly.

FIG. 26 illustrates an enlarged partial view of the upper tactile panel 212 directly above a lower base plate 214. The upper tactile panel 212 fits directly on top of the lower base plate 214 such that the upper tactile panel upward projections 104 align directly on top of the anchor-holes 116 in the lower base plate 214. Similarly the keyhole through-holes 206 in the upper tactile panel 212 directly align with standoff studs 210 on the lower base plate 214. FIG. 27 illustrates a closer enlarged view of the upper tactile panel 216 and lower base plate 218 assembly. This design incorporates an upper tactile panel 216 with keyhole through-holes 206 that have a larger end 222 and a smaller end 224 and a lower base plate 218 with round anchor-holes 116 and standoff studs 210 that are mechanically fastened to the lower base plate 218.

Figure 28:
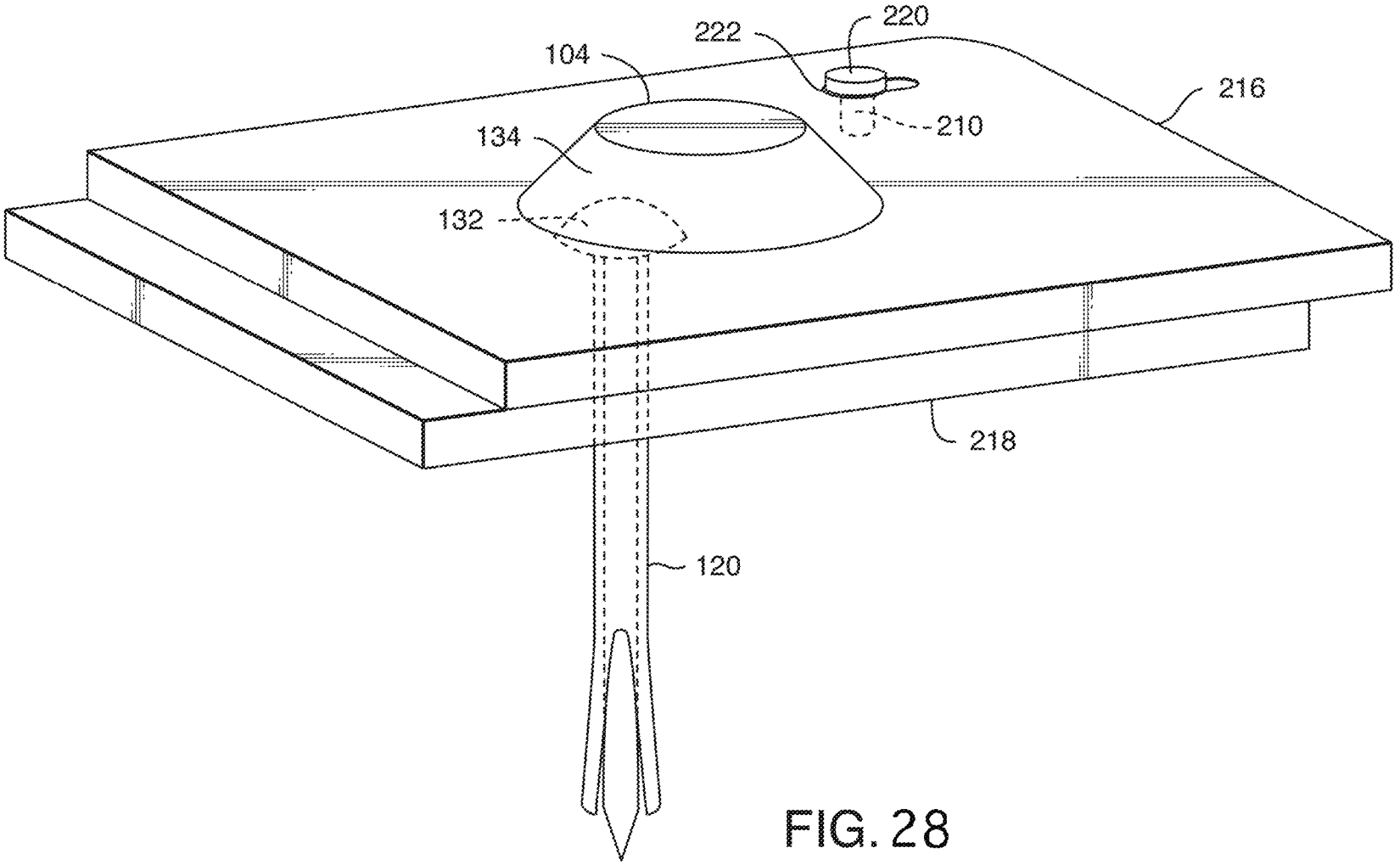
FIG. 28 illustrates the lower base plate in the secured condition onto the existing preformed ground surface and the upper tactile panel in the unsecured condition on top of it.
Figure 29:
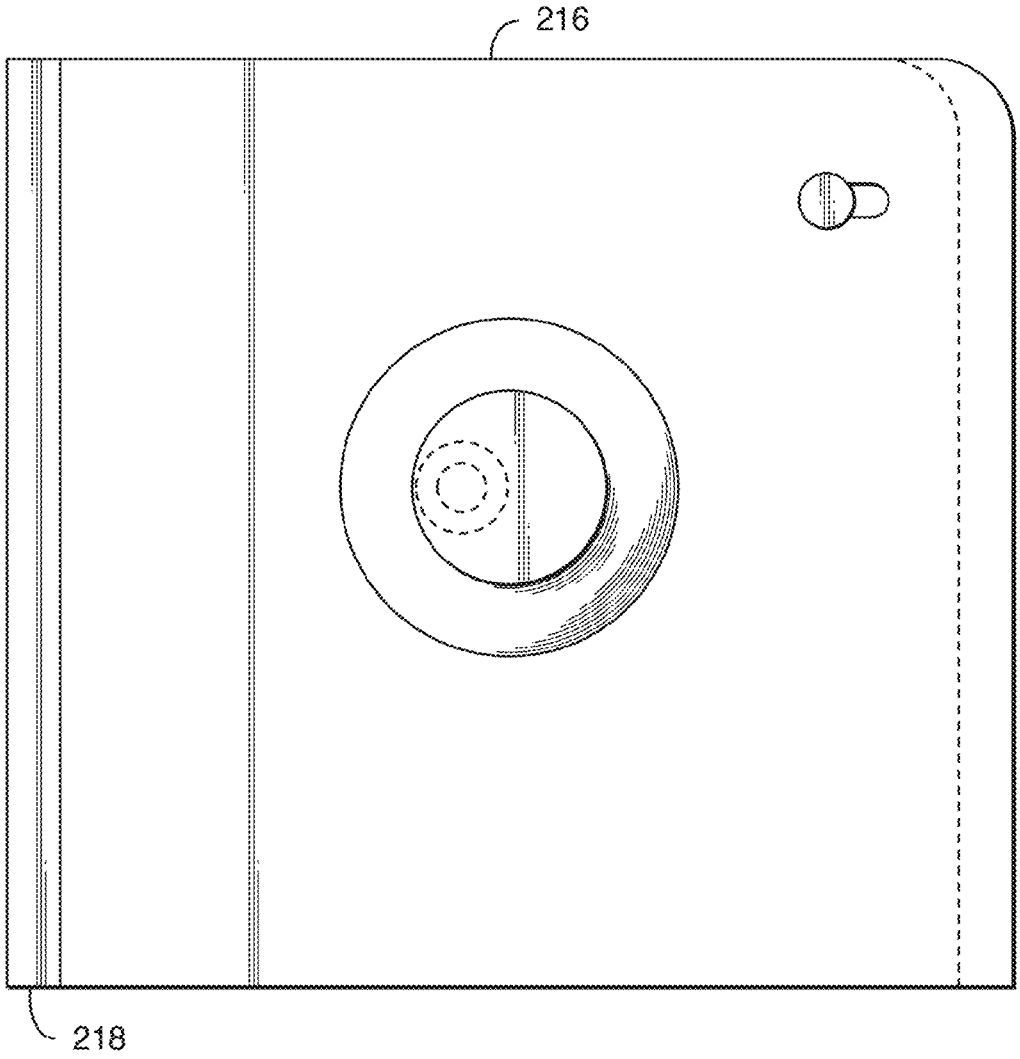
FIG. 29 illustrates a plan view of FIG. 28.
Figure 30:
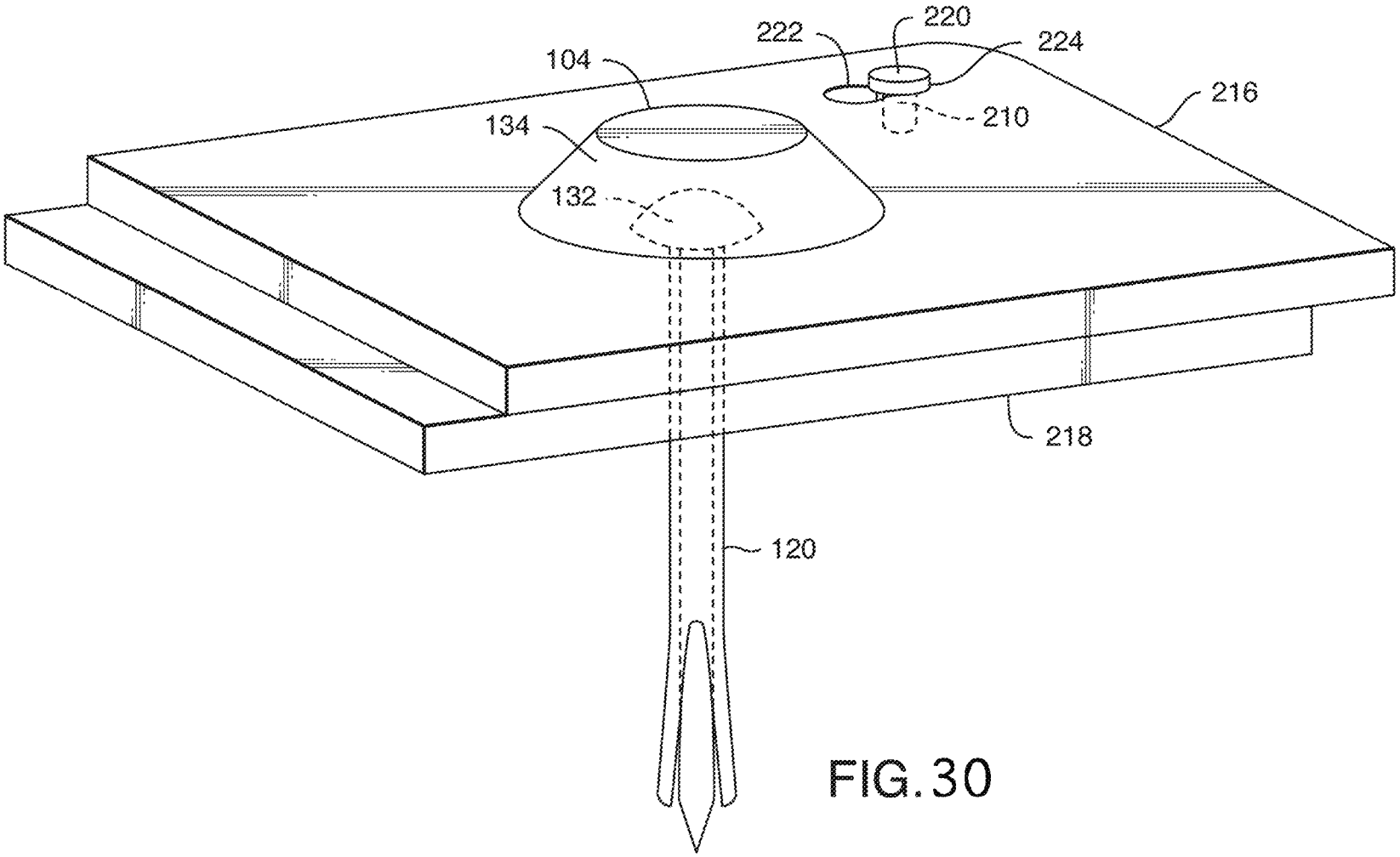
FIG. 30 illustrates a side view of the lower base plate secured onto the existing preformed ground surface and the upper tactile panel in the secured position on top of the lower base plate.
Figure 31:
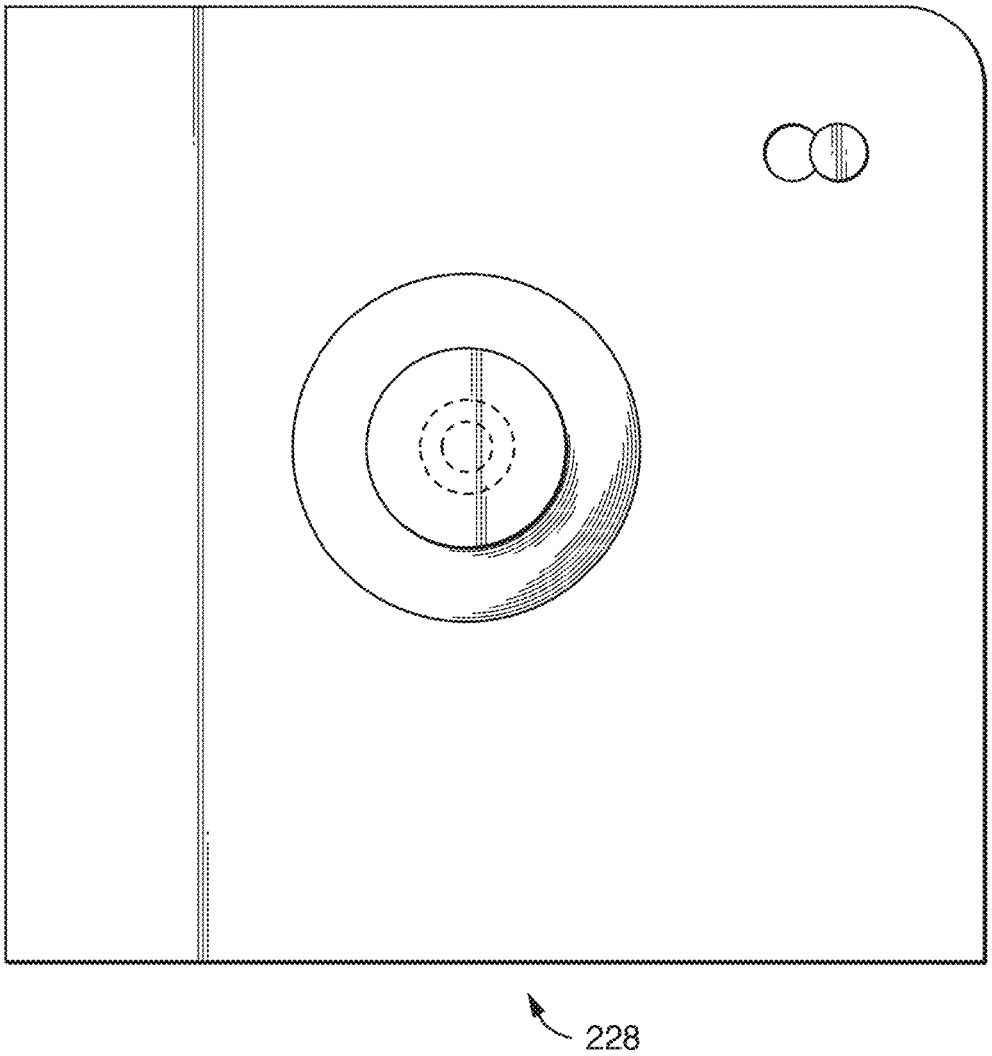
FIG. 31 illustrates a plan view of FIG. 30.

FIG. 28 illustrates the lower base plate 218 which is first secured to the existing preformed ground surface, not shown, using expansion anchors 120. After the lower base plate 218 has been secured to the existing preformed ground surface an upper plate 216 is placed directly on top of the lower base plate 218 such that the head 220 of the standoff stud 210 is protruding up through the larger 222 end of the keyhole through-hole, FIG. 27, 206. In FIG. 28 the upper tactile panel 216 is offset from the lower base plate 218 such that the head 132 of the expansion anchor 120 is off set in the void cavity 134 of the upward projection 104. FIG. 29 illustrates a plan view of the unsecured assembly shown in FIG. 28 whereby the upper tactile panel 216 is offset from the lower base plate 218. The upper tactile panel now needs to be laterally shifted from this position where the standoff stud head FIG. 28, 220 of the standoff stud 210 is in the larger end 222 of the keyhole, FIG. 27, 206 towards the direction of the smaller end FIG. 27, 224 of the keyhole FIG. 27, 206 in order to achieve upper panel 216 to lower base plate 218 securement. FIG. 30 illustrates the assembly in the secured position whereby the head 132 of the nail drive expansion anchor 120 is positioned directly in the center of the void cavity 134 of the upward projection 104. Also shown in FIG. 30 is that the head of the standoff stud 220 has been laterally shifted from the larger end 222 of the keyhole FIG. 27, 206 to the smaller end 224 of the keyhole FIG. 27, 206. FIG. 31 illustrates a plan view of the secured assembly 228 whereby the upper tactile panel is seated on top of the lower base plate in the secured condition.

Figure 32:
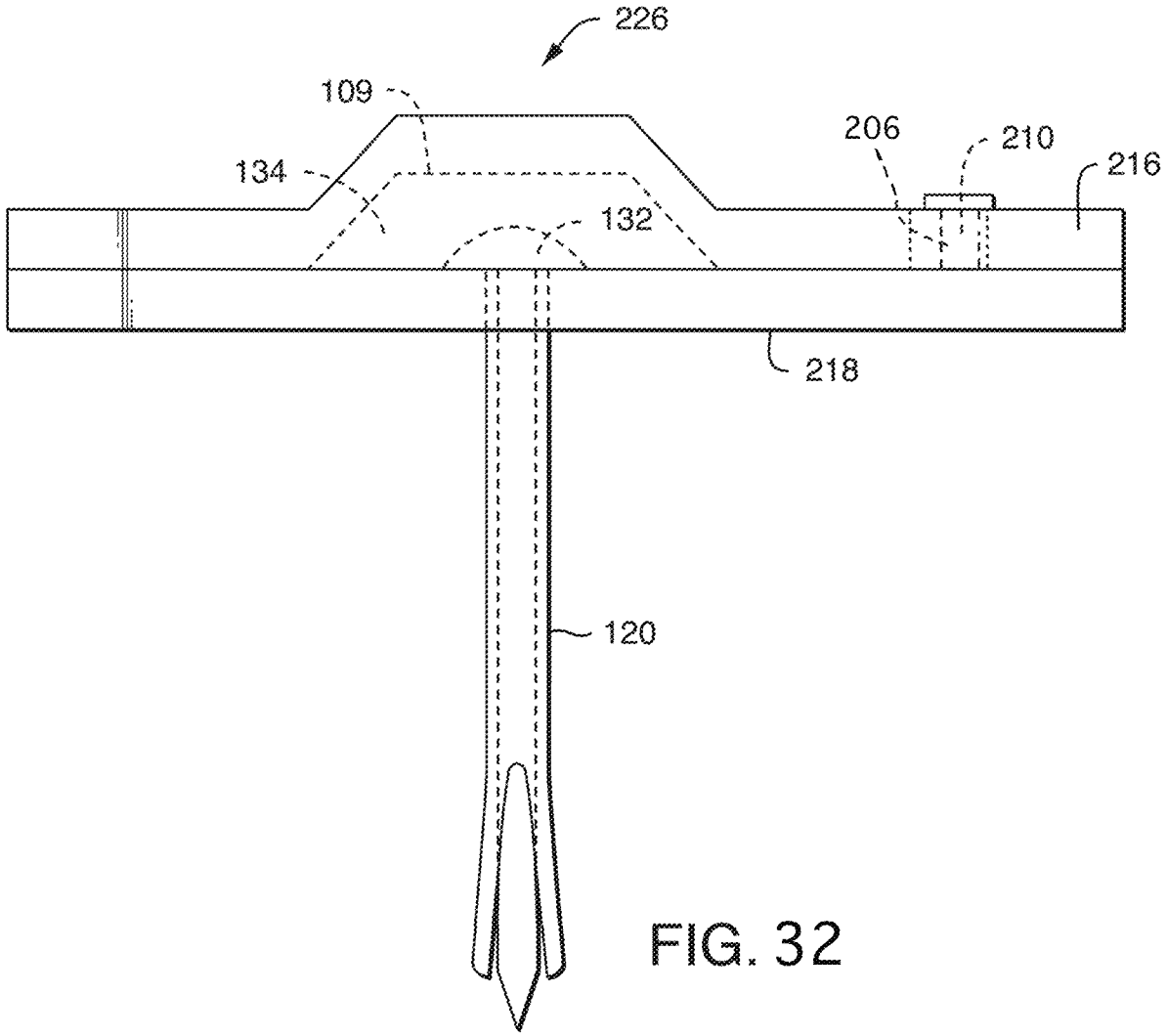
FIG. 32 illustrates a profile view of the secured assembly shown in FIG. 30.

FIG. 32 illustrates a profile view of the secured upper tactile panel 216 to the lower base plate assembly 218 using standoff studs 210 which are secured to the lower base plate 218 projecting upward through the keyhole through-hole 206 in the upper tactile panel 216. The design feature that makes this assembly work efficiently is the head 132 of the expansion anchor 120 is protruding into the void cavity 134 on the underside upward projections 109 on the upper panel 216. The use of standoff studs is considered less ideal than the use of a threaded screw because of the narrow tolerances in manufacturing required for a standoff stud head at a precise height to clear the upper panel while still maintaining secure engagement of the upper panel to the lower base plate. The advantage of the standoff stud is that it eliminates the requirement of drilling holes in the existing preformed ground surface to accommodate receivers.

Figure 33:
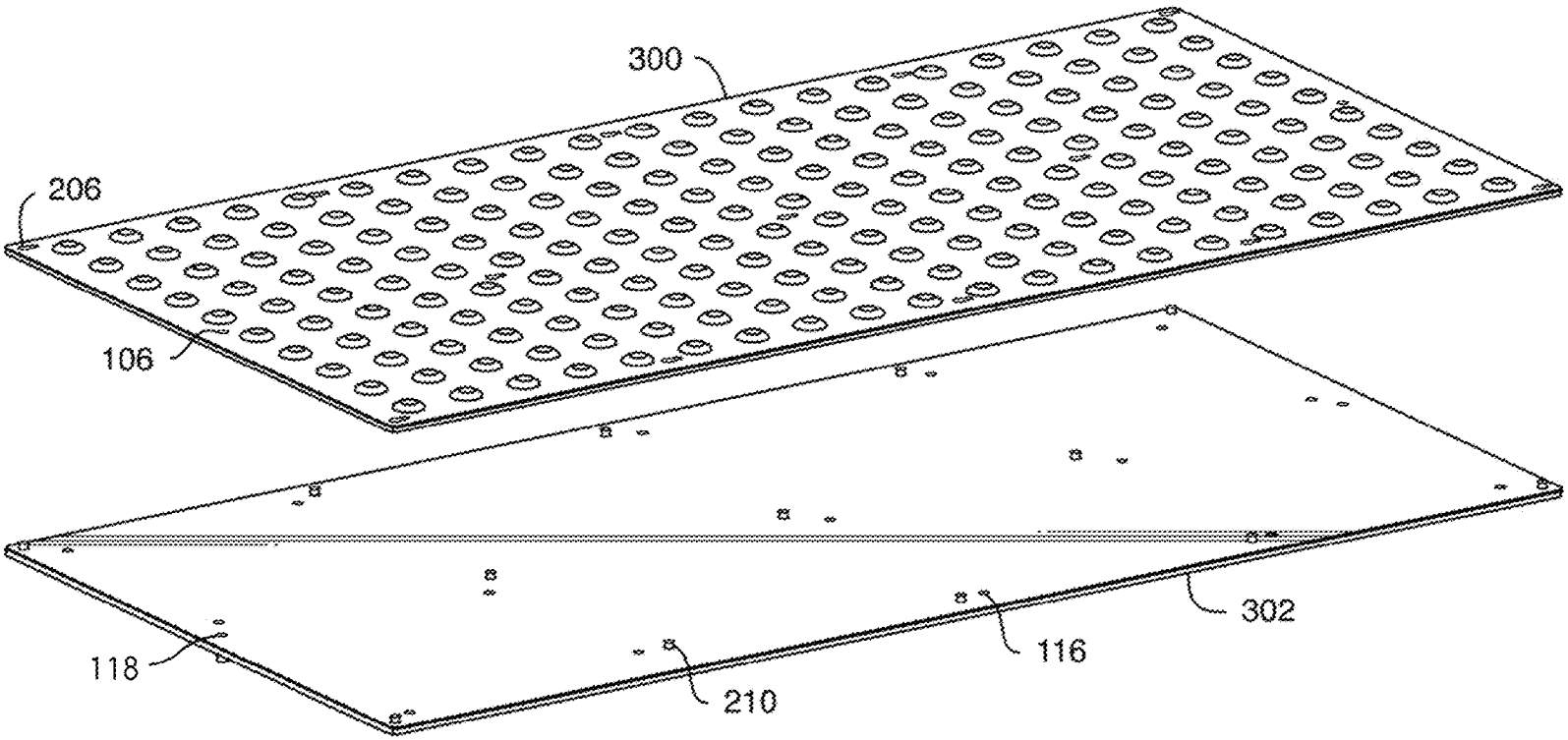
FIG. 33 illustrates an upper tactile panel with a plurality of upward projections, a limited number of round through-holes and a plurality of keyhole through-holes. It also illustrates a lower base plate with a limited number of threaded receivers and a plurality of standoff studs on the lower base plate.
Figure 34:
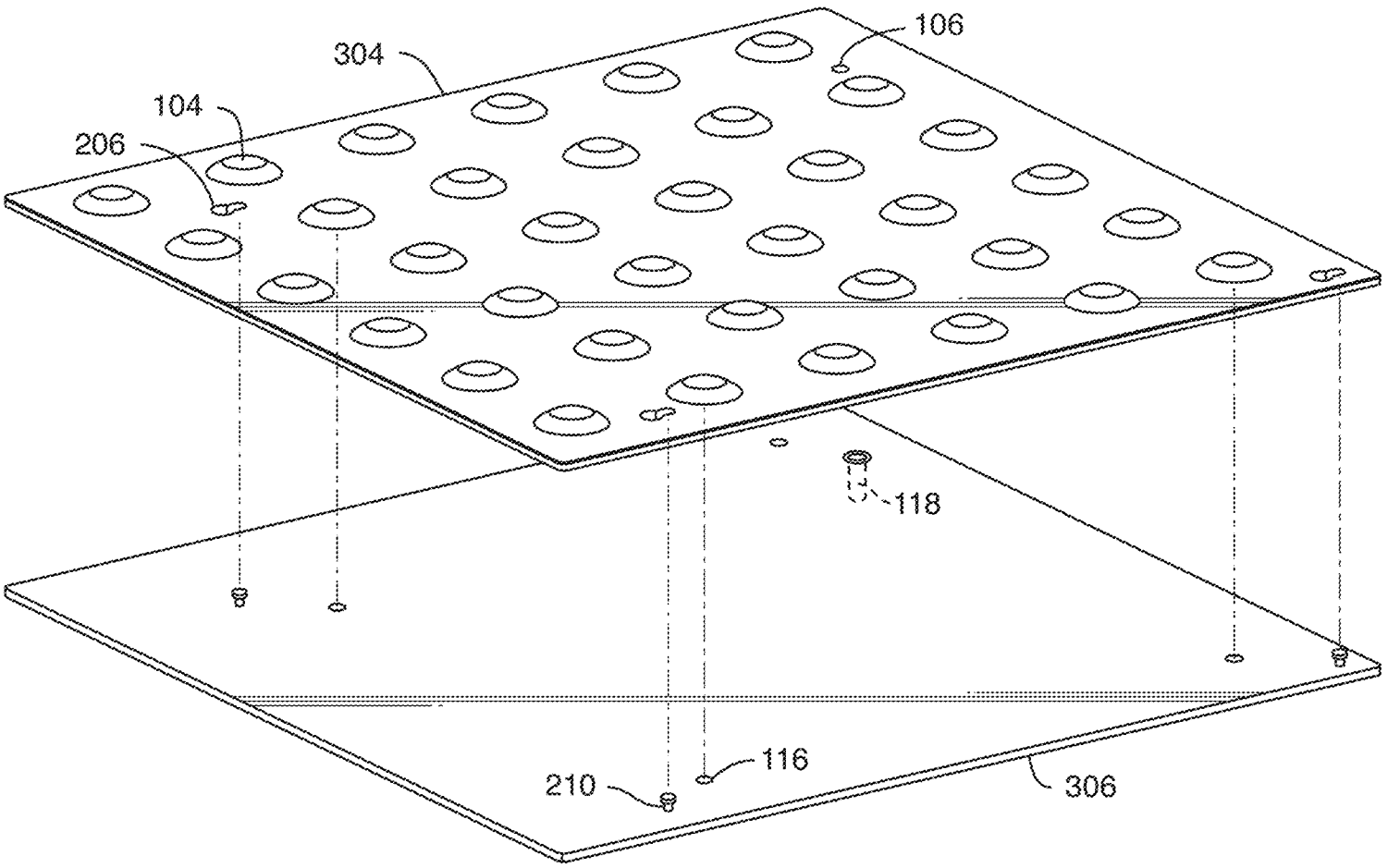
FIG. 34 illustrates an expanded/close up partial section of FIG. 33.
Figure 35:
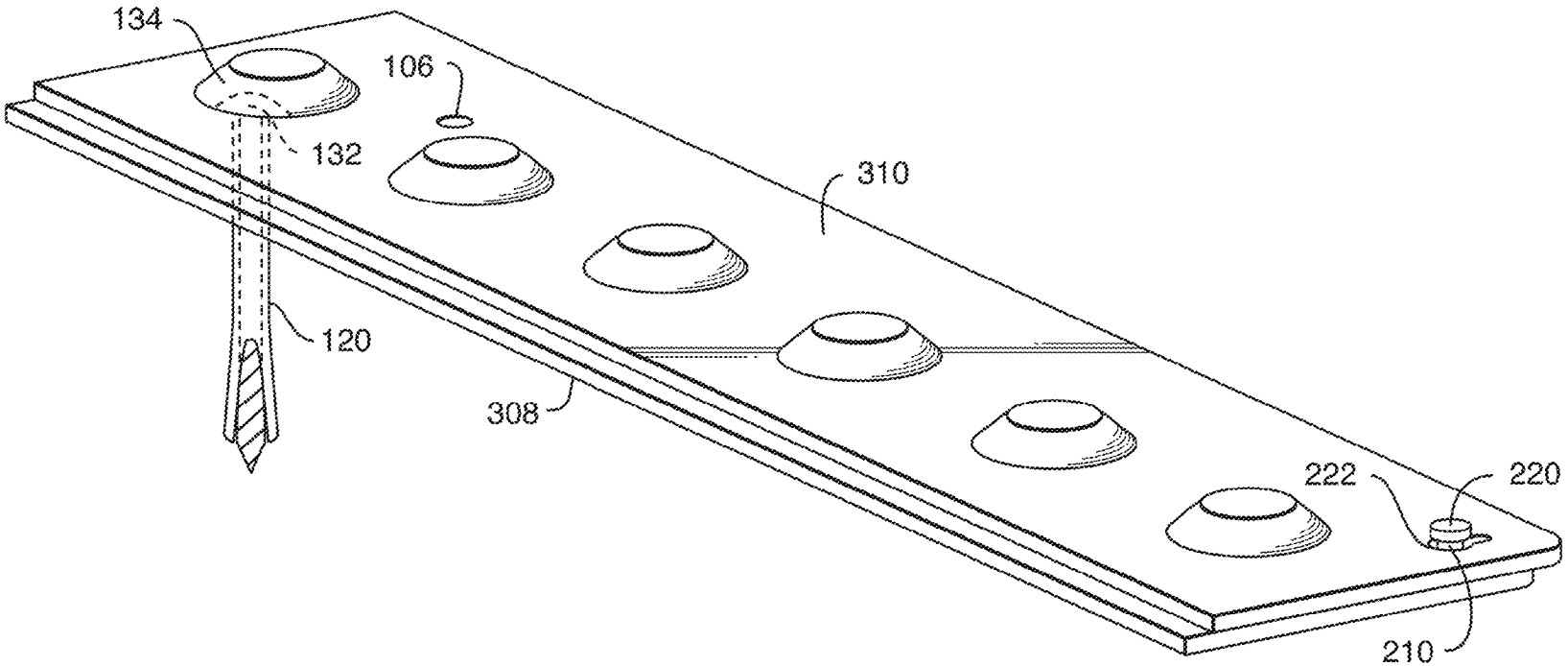
FIG. 35 illustrates close up partial view of the condition when the upper tactile panel has been placed directly on top of the lower base plate in the unsecured condition to the lower base plate. Additionally it illustrates the lower base plate in the secured position onto the existing preformed ground surface.
Figure 36:
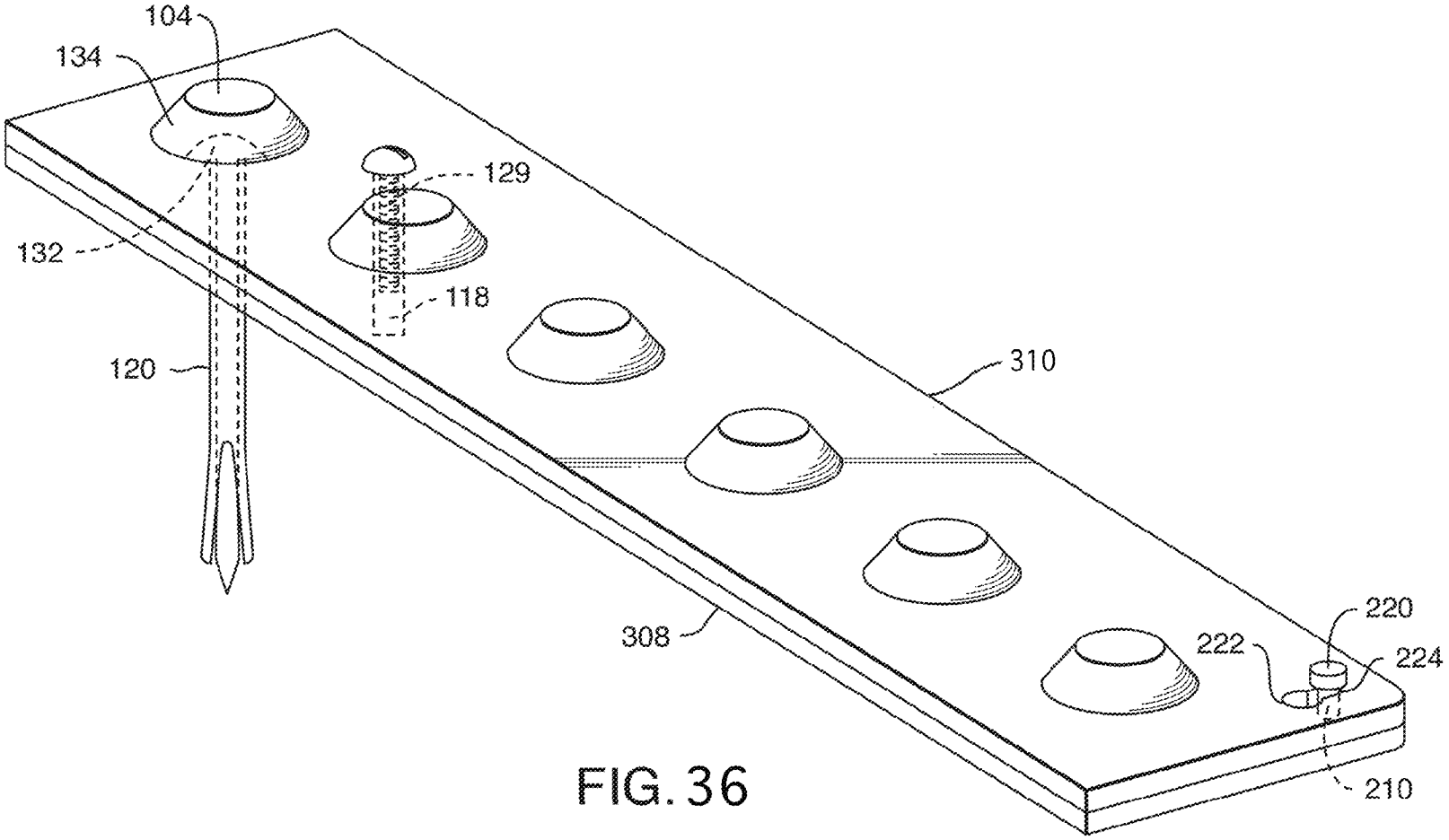
FIG. 36 illustrates a close up partial view of the condition when the upper plate/panel is in the secured condition on top of the lower base plate. Additionally it illustrates the lower base plate in the secured position onto the existing preformed ground surface.

A sixth embodiment for the tactile warning surface mount double plate assembly is a combination of designs previously discussed. FIG. 33 illustrates an upper tactile panel 300 utilizing a plurality of through-hole keyholes 206 around the perimeter and interior and a limited number of round through-holes 106. This design utilizes a lower base plate 302, which has both a plurality of standoff studs 210, and a plurality of threaded receivers 118 as well as anchor-holes 116 for securement to the existing preformed ground surface. FIG. 34 illustrates an enlarged partial view of the design assembly seated directly on top of one another. This close-up detail illustrates that the upper tactile panel 304 lines up with the lower base plate 306 such that the keyhole through-holes 206 in the upper panel 304 line up directly over the lower base plate 306 standoff studs 210 affixed to the lower plate. Additionally the anchor-holes 116 in the lower base plate 306 align directly underneath the center of the upward projections 104 in the upper tactile panel 304 while the threaded receivers 118 in the lower base plate 306 align with the round through-holes 106 in the upper panel 304. FIG. 35 illustrates an even closer view of a section of the surface mount double plate assembly with the lower base plate 308 and upper tactile panel 310 in the unsecured condition. The lower base plate 308 is secured to the existing preformed ground surface using expansion anchors 120 and the upper tactile panel 310 is seated directly on top of the lower base plate 308 such that the heads 220 of the keyhole standoffs 210 on the lower base plate 308 are protruding up through the larger hole 222 of the keyhole through-holes, FIG. 27, 206 in the upper tactile panel 310. This alignment also results in the round through-holes 106 in the upper plate 310 being offset from the threaded receivers FIG. 34, 118 in the lower base plate 308 as well as the head 132 of the expansion anchor 120 being offset from the center of the upward projection 104 in the upper tactile panel 310. FIG. 36 illustrates the upper tactile panel 310 in the secured position whereby the upper tactile panel 310 has been shifted laterally such that the upper tactile panel 310 moves from the larger end 222 of the keyhole, FIG. 27, 206 towards the smaller end 224 of the keyhole through-hole FIG. 27, 206. Shifting the upper tactile panel 310 in this manner causes the standoff stud head 220 on the lower base plate 308 to be located in the smaller end 224 of the keyhole through-hole, FIG. 14B, 206, and the round through-hole, FIG. 35, 106 directly aligned with the threaded receiver FIG. 34, 118 in the lower base plate 308. A threaded fastener FIG. 36, 129 has been inserted and rotationally torqued further securing the upper tactile panel 310 to the lower base plate 308. Further, in this condition the head 132 of the expansion anchor 120 is now located directly underneath the center of the void cavity 134 of the upward projection 104 on the upper tactile panel 310. This results in the upper tactile panel 310 being firmly secured to the lower base plate 308, which in turn is secured to the existing preformed ground surface utilizing expansion anchors 120.

Figure 37A:
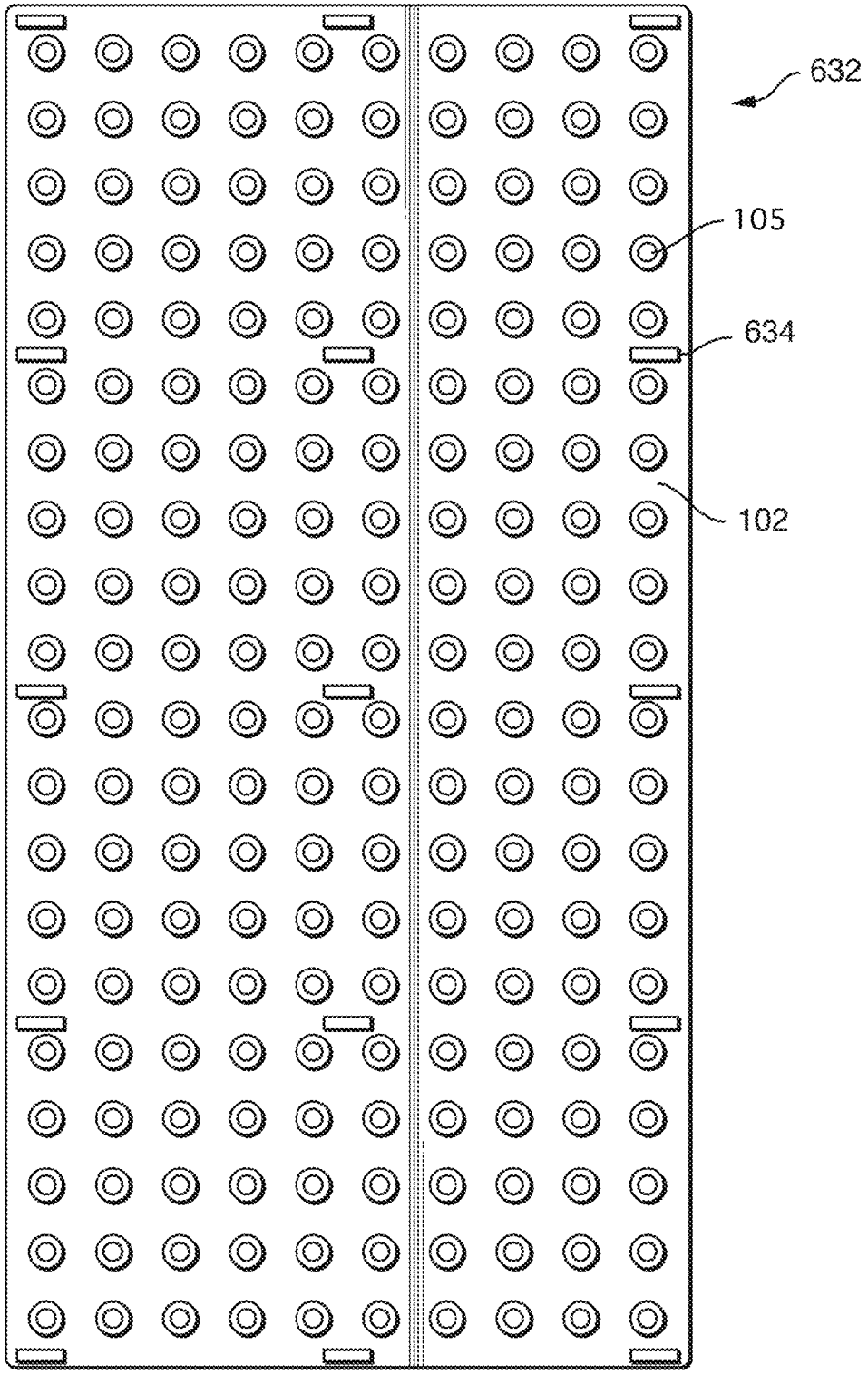
FIG. 37A illustrates the bottom side of a upper panel consisting of a plurality of domes and a plurality of strips of 3M dual lock reclosable fasteners on the interior and around the perimeter of the upper panel.
Figure 37B:
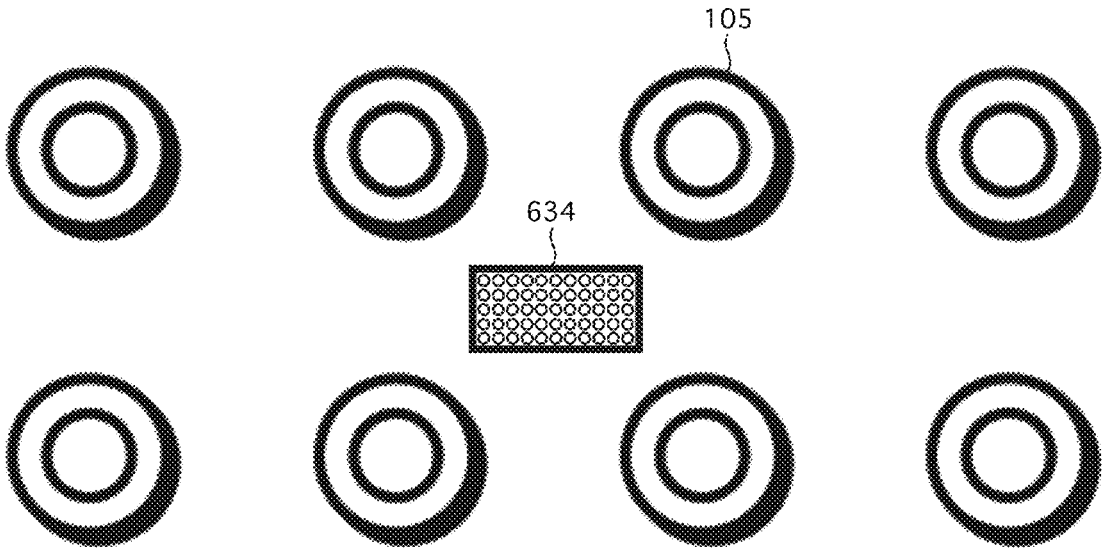
FIG. 37B illustrates a close-up view of the 3M dual lock reclosable fasteners that have been attached to the bottom side of the upper panel.
Figure 38:
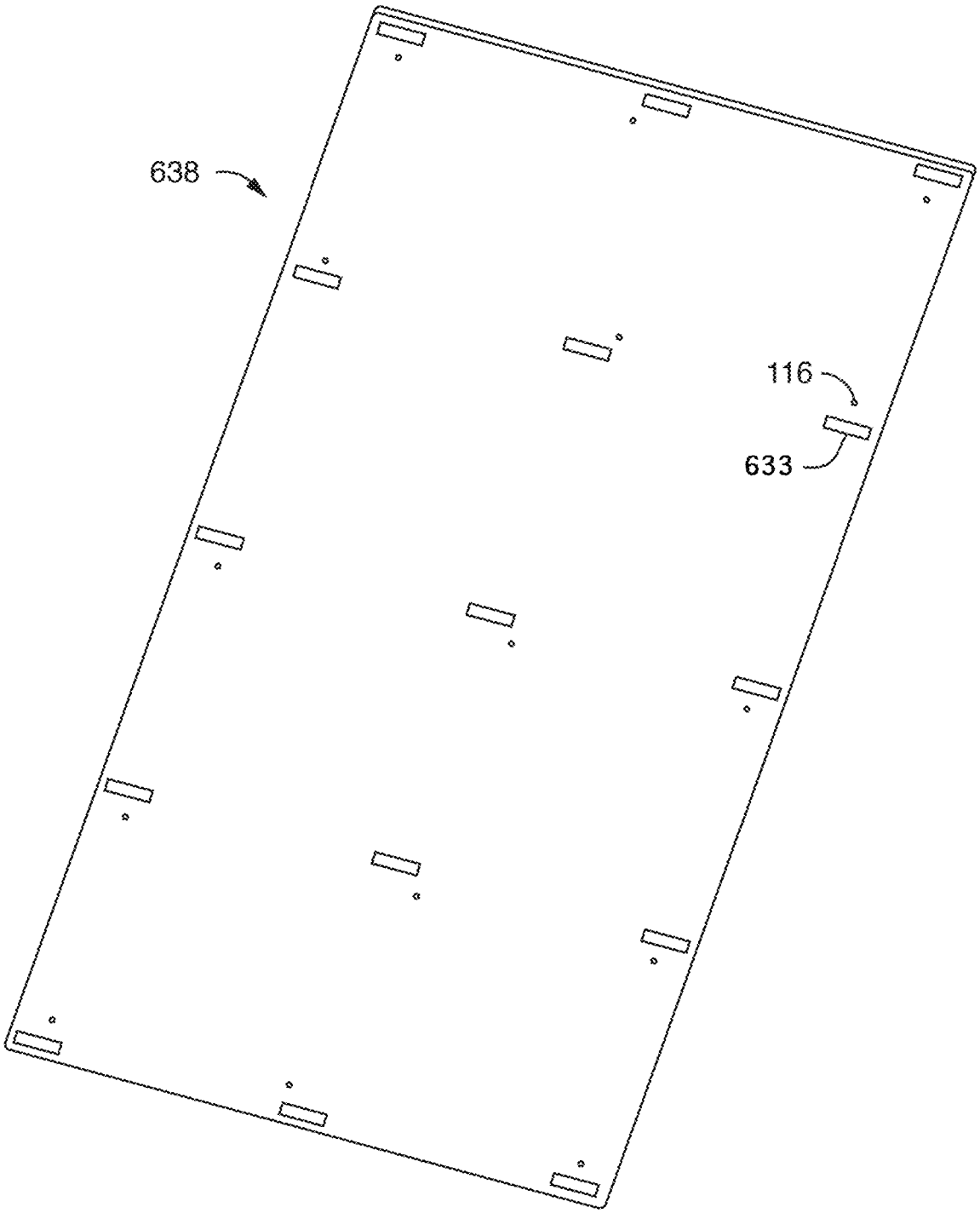
FIG. 38 illustrates a lower base plate with a plurality of anchor-holes and a plurality of rectangular strips of 3M dual lock reclosable fasteners secured to the topside of the lower base plate.
Figure 39A:
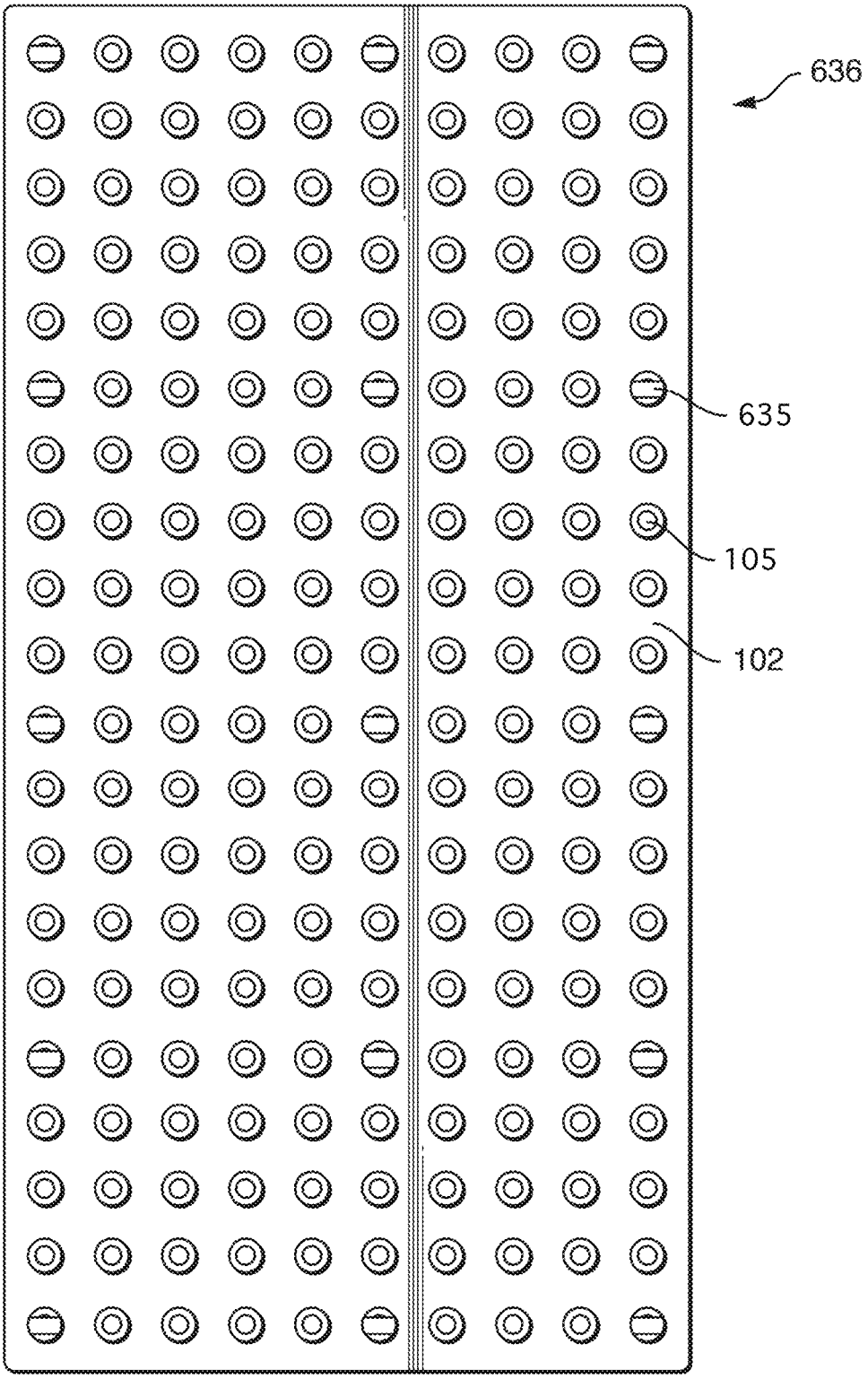
FIG. 39A illustrates the bottom side of a upper panel consisting of a plurality of domes and a plurality of round and/or wafer cut 3M dual lock reclosable fasteners located in the void cavities of the domes on the interior and around the perimeter of the upper panel.
Figure 39B:
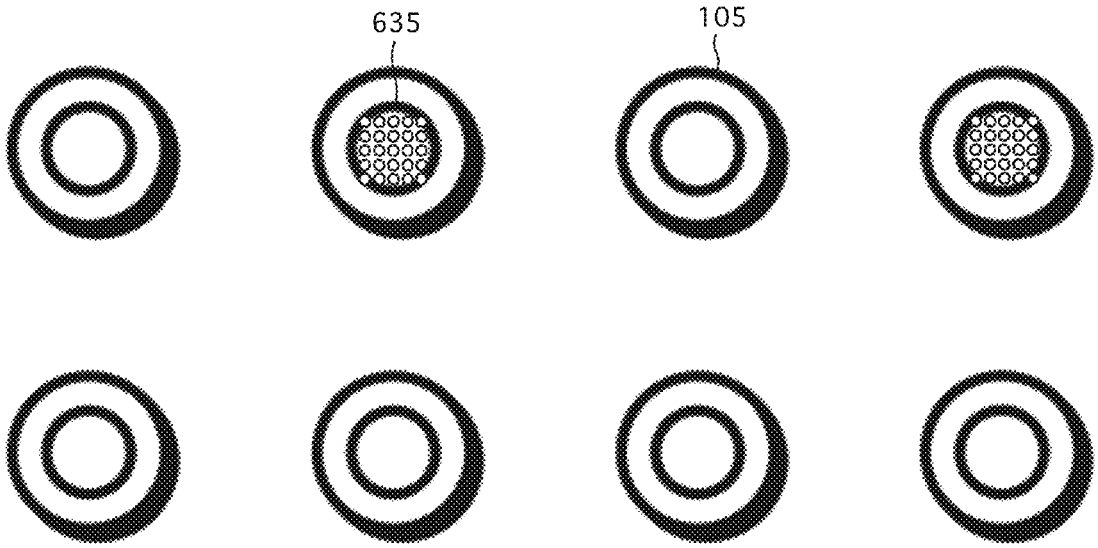
FIG. 39B illustrates a close-up view of the 3M dual lock reclosable fasteners that have been attached to the bottom side in the void cavities of the domes on the upper tactile panel.
Figure 40:
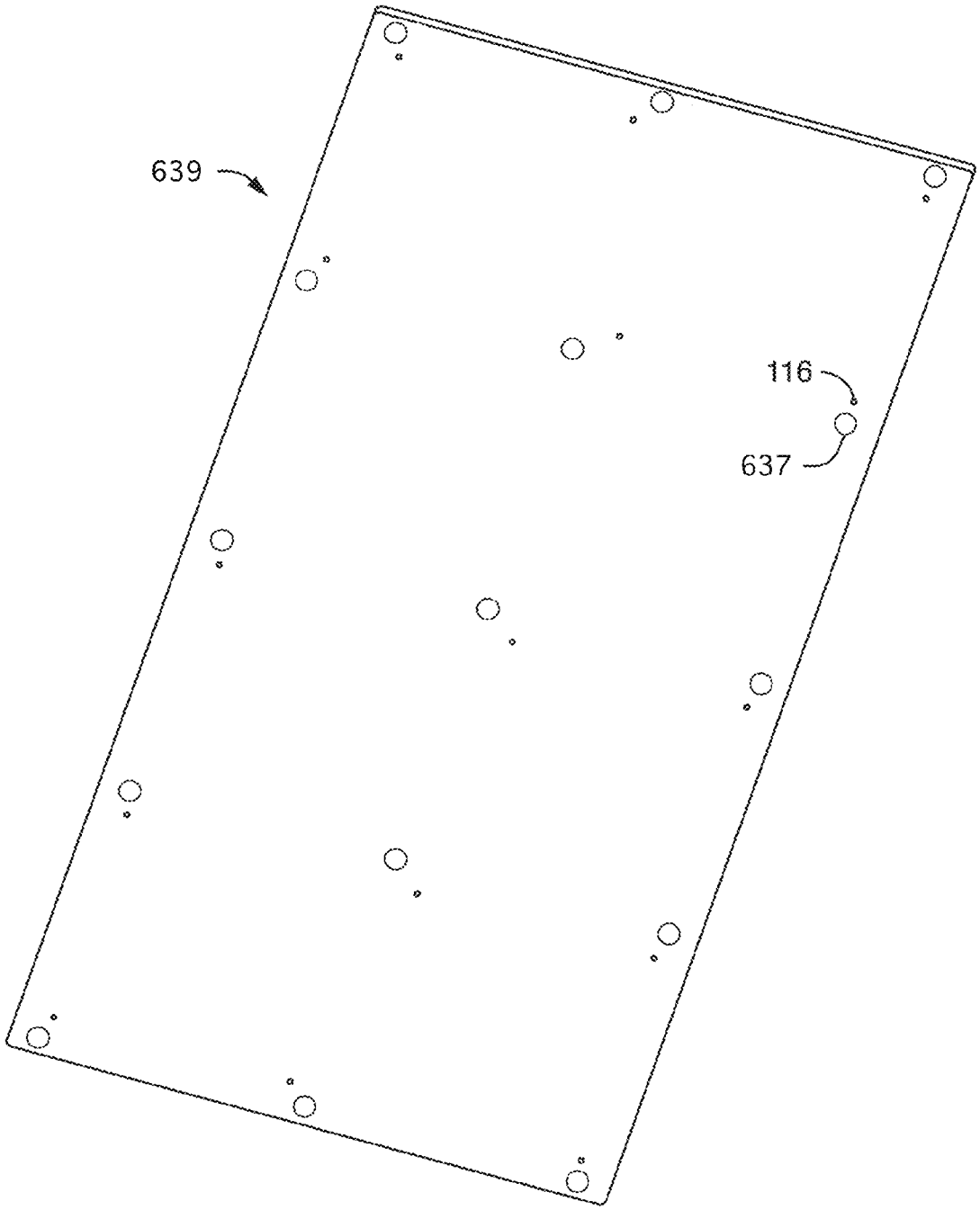
FIG. 40 illustrates a lower base plate with a plurality of anchor-holes and an associated plurality of round and/or water cut 3M dual lock reclosable fasteners secured to the topside of the lower base plate.
Figure 41A:
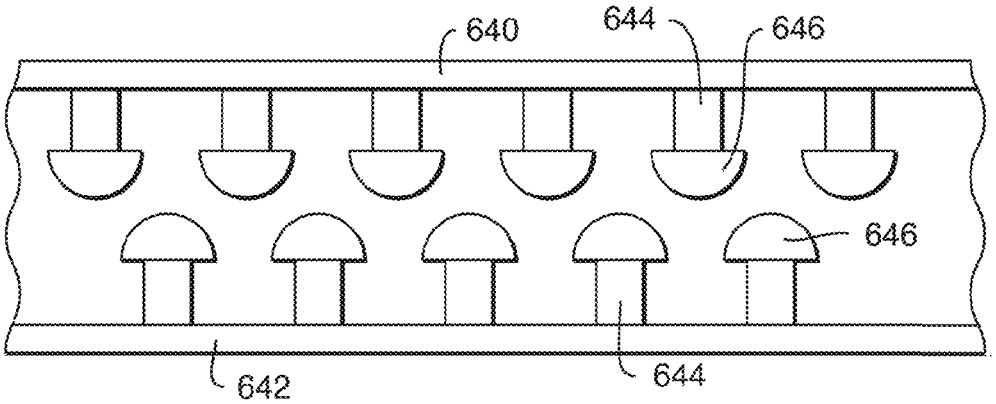
FIG. 41A illustrates a close up detail of the 3M dual lock reclosable fasteners loose in an unsecured condition.
Figure 41B:
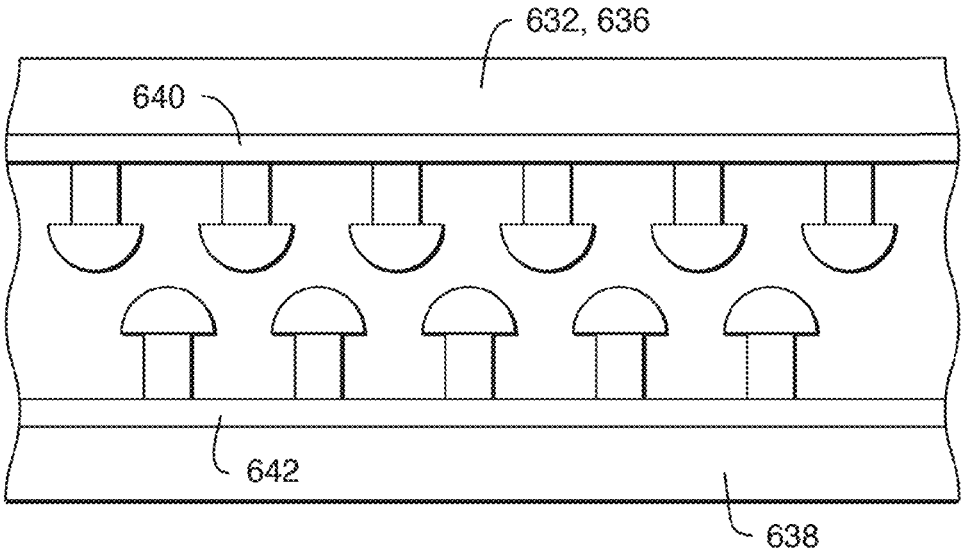
FIG. 41B illustrates a close up detail of the 3M dual lock reclosable fasteners in the unsecured position adhesively adhered to a lower base plate and upper panel.
Figure 42A:
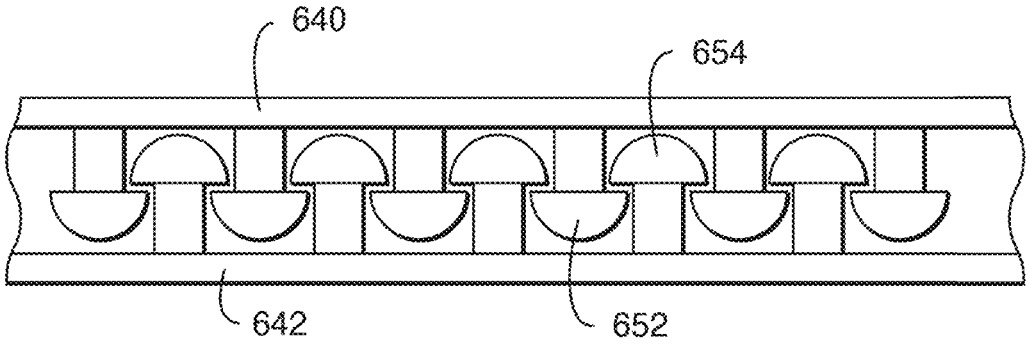
FIG. 42A illustrates a close up detail of 3M dual lock reclosable fasteners in the secured position.
Figure 42B:
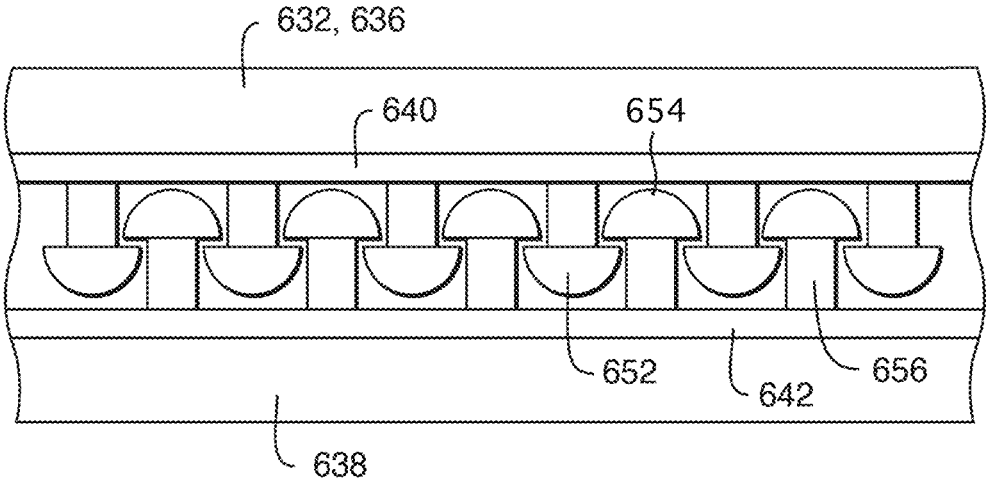
FIG. 42B illustrates a detailed view of the 3M dual lock reclosable fastener in the secured position adhesively adhered onto a lower base plate and upper panel.
Figure 42C:
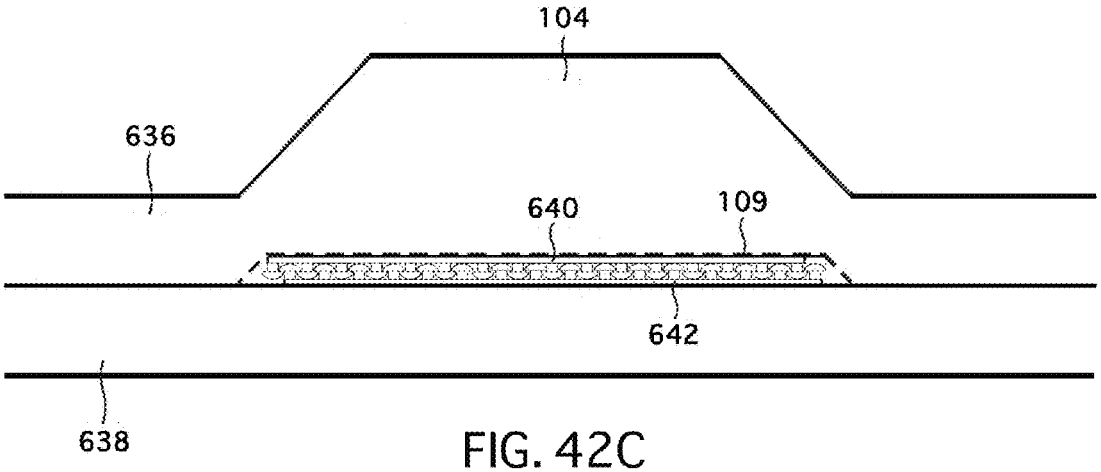
FIG. 42C illustrates a detailed view of the upper panel secured to the lower base plate where the 3M dual lock reclosable fasteners have been installed in the bottom side void cavities of the domes on the upper panel and on the top surface of the lower plate.

A seventh embodiment of the tactile warning surface mount double plate assembly is shown in FIG. 37A, FIG. 38 and FIG. 39A. This design consists of an upper tactile panel FIG. 37A, 632 and FIG. 39A, 636 incorporating a plurality of different shaped strips of 3M Dual Lock™ reclosable fasteners shown on FIG. 37A, 634 and FIG. 39A, 635. These reclosable fasteners are manufactured by 3M™ in St. Paul, Minn. The 3M Dual Lock reclosable fasteners are attached around the perimeter and interior of the upper tactile panel FIG. 37A, 632 and FIG. 39A, 636. The 3M Dual Lock reclosable fasteners are mushroom-shaped projections composed of flexible plastic and spaced uniformly from each other at a distance equal to the diameter of the mushroom head. When two facing strips are pressed together they interlink as shown in enlarged drawings FIG. 41A and FIG. 41B. FIG. 37A illustrates the design where a plurality of small rectangular or square strips of 3M Dual Lock reclosable fasteners 634 are placed onto the back of the upper tactile panel 632 in between the underside upward projections 105 around both the perimeter and interior of the upper tactile panel 632. These reclosable fasteners 634 are manufactured such that they are firmly secured to the solid surface 102 upper tactile panel 632 with pre-adhered adhesives from the manufacturer. FIG. 37B provides a close up view of these small rectangular 634 or square strips placed on the bottom of the upper tactile panel FIG. 37A, 632 in between the underside of the upward projections 105 and around the perimeter of the panel. FIG. 38 illustrates the rectangular 634 3M Dual Lock reclosable fasteners installed on the top of the lower base plate 638. The lower base plate 638 has anchor-holes 116 in order to secure the lower base plate 638 to the existing preformed ground surface. Securement of the upper tactile panel shown in FIG. 37A, 632 to a lower base plate FIG. 38, 638 is illustrated in FIG. 42C. The lower base plate FIG. 38, 638 has reclosable fasteners 634 adhered to the lower base plate 638 such they align directly underneath the reclosable fasteners 634 on upper panel FIG. 37A, 632 in order to secure the surface mount double plate assembly together. This lower base plate FIG. 38, 638 is secured to the existing preformed ground surface utilizing a plurality of anchor-holes 116 and expansion pin anchors. The second variation of this design is reflected in FIG. 39A, whereby round wafer strips of 3M Dual Lock reclosable fasteners 635 have been placed onto the upper tactile panel 636 such that they are located in the underside of the upward projections 105 in order to achieve a flush assembly when the upper tactile panel FIG. 39A, 636 is placed on the lower base plate. FIG. 40 illustrates the round wafer strips 637 of 3M Dual Lock reclosable fasteners are installed on the top of the lower base plate 639. The lower base plate 639 has anchor holes 116 in order to secure the lower base plate to the preformed ground surface. Securement of the upper tactile panel FIG. 39A, 636 and FIG. 40, 639 a lower base plate is illustrated in FIG. 42C. The lower base plate FIG. 40, 639 has reclosable fasteners 637 adhered such that they align directly underneath the reclosable fasteners 635 on upper panel FIG. 39A, 636 in order to secure the surface mount double plate assembly together. The lower base plate FIG. 40, 639 is secured to the existing preformed ground surface utilizing a plurality of anchor-holes 116 and expansion anchors FIG. 32, 120. FIG. 41A illustrates a detailed view of the 3M Dual Lock Reclosable Fastener whereby a loose upper strip 640 is shown directly above a loose lower strip 642 in the unsecured position. The loose upper strip 640 and the loose lower strip 642 both have identical fastener studs 644 projecting up from the base and have a mushroom cap 646 at the end of them. FIG. 41B illustrates the condition when an upper strip 640 has been adhered with adhesive to an upper tactile panel 632 or 636 and a lower strip 642 has been adhered with adhesive to a lower base plate 638. FIG. 41A and FIG. 41B show the dual lock reclosable fasteners in the unsecured condition. FIG. 42A illustrates a detailed view of dual lock reclosable fasteners in the secured condition whereby the upper strip 640 and lower strip 642 are secured by the interlinking of the mushroom heads 652 on the upper strip 640 and the lower strip 642. FIG. 42B illustrates the secured condition whereby an upper strip 640 has been adhered to an upper tactile panel FIG. 37A, 632 and a lower strip 642 has been adhered to a lower base plate FIG. 38, 638. Also shown in FIG. 42B is the secured interlinking of the mushroom heads 652 and 654 on the upper strip 640 and the lower strip 642. FIG. 42C further illustrates the interconnection of the dual lock reclosable fasteners when incorporated on to an upper panel 636 and a lower base plate 638. This figure further illustrates that during upper panel 636 manufacturing there is a lower surface 109 of the upward projections 104 whereby an upper strip 640 has been adhesively applied to the bottom side of the lower surface 109 of the upward projection and a lower strip 642 has been applied to the lower base plate 638. With the two sides of the dual lock reclosable fasteners interconnected between the upper panel 636 and lower base plate 638 the assembly is secured.

Figure 49:
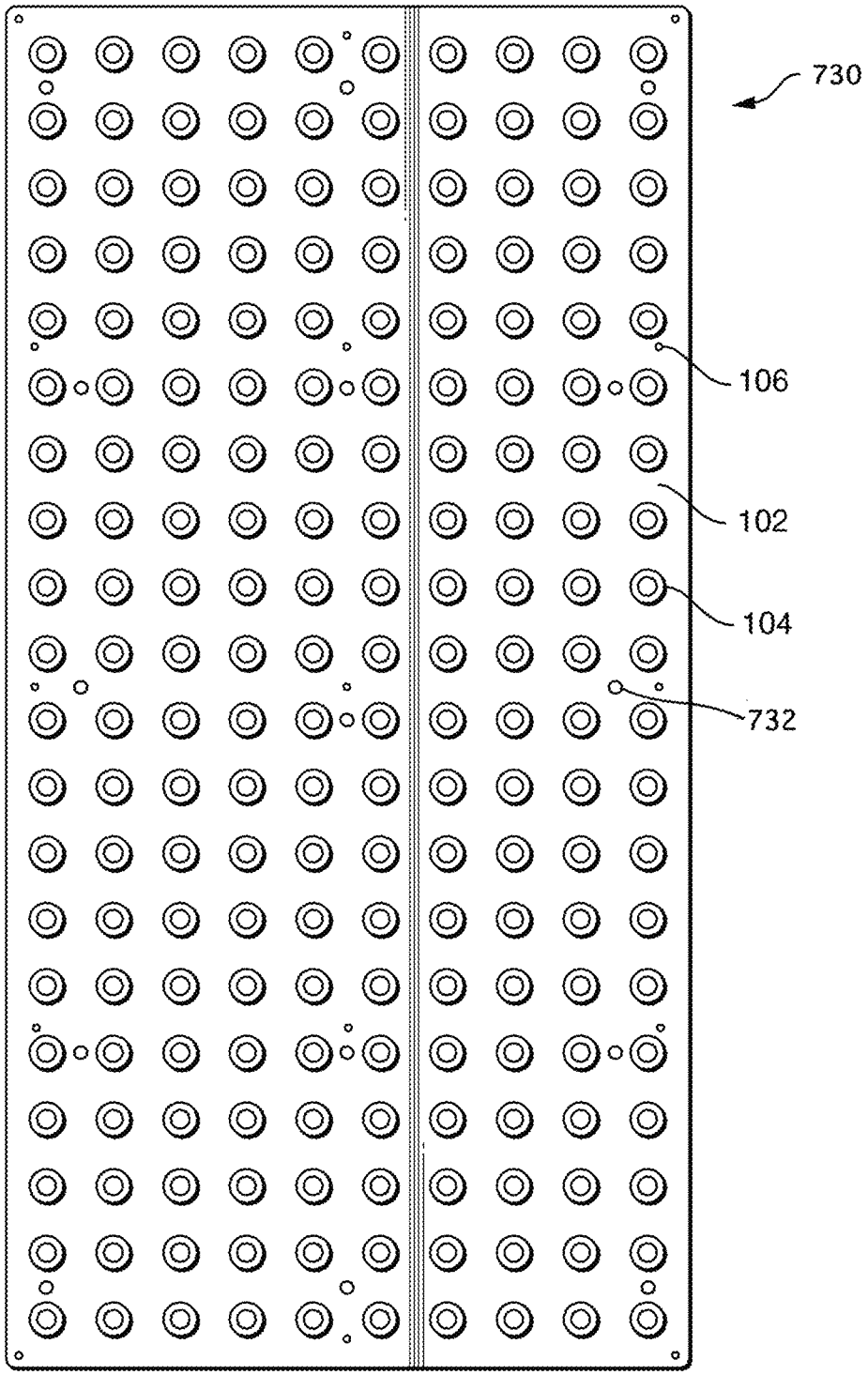
FIG. 49 illustrates a plan view of an ADA compliant upper tactile panel, consisting of a plurality of domes and a plurality of round through-holes on the interior and around the perimeter of the upper panel, and a second set of larger round through-holes on the interior and perimeter of the upper panel.
Figure 50:
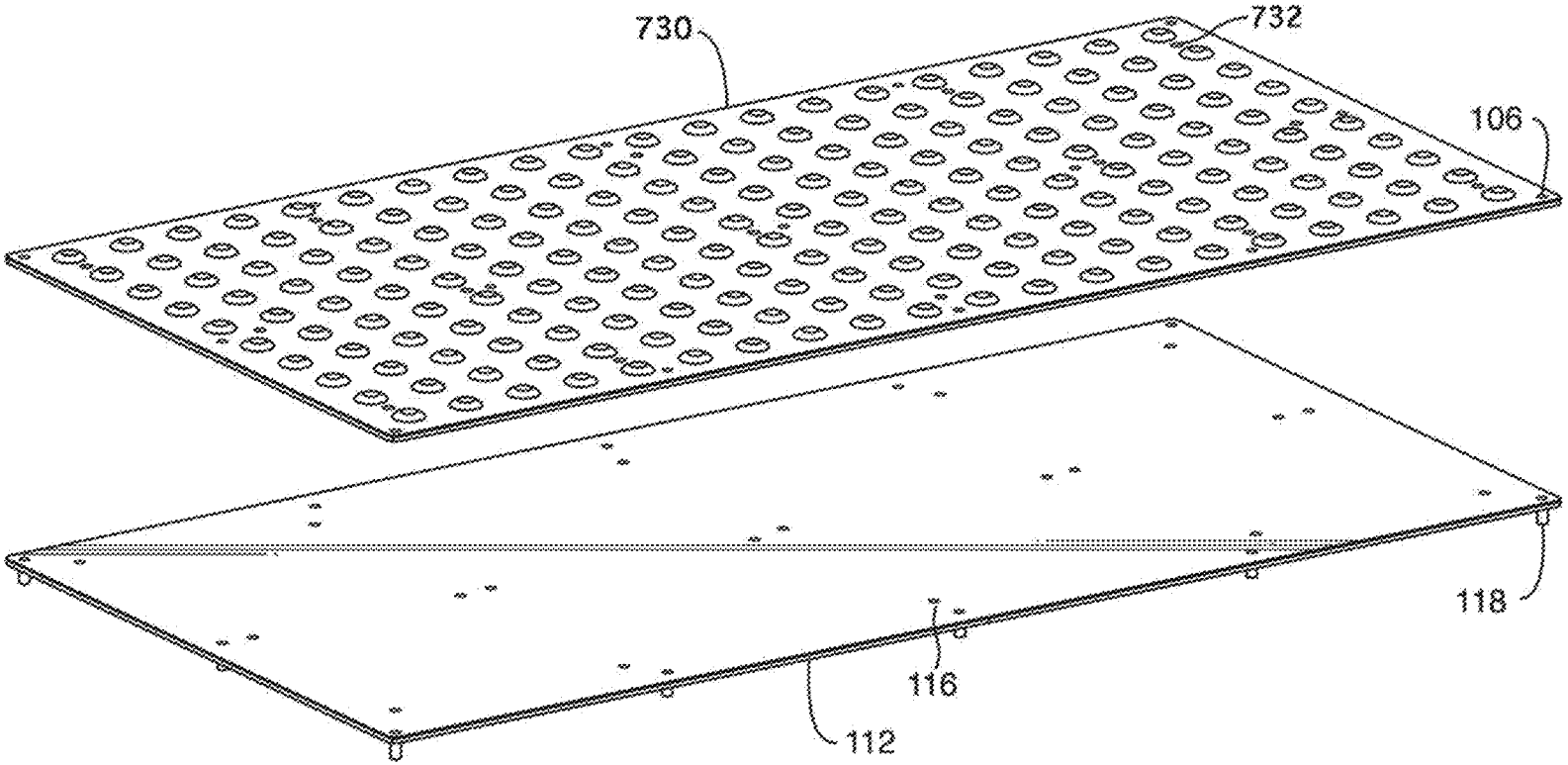
FIG. 50 illustrates a lower base plate, with a plurality of round anchor-holes and an associated plurality of receivers secured to the lower base plate. Also illustrated is an upper tactile panel, with a plurality of domes, a plurality of round through-holes and a second set of larger round through-holes.
Figure 51:
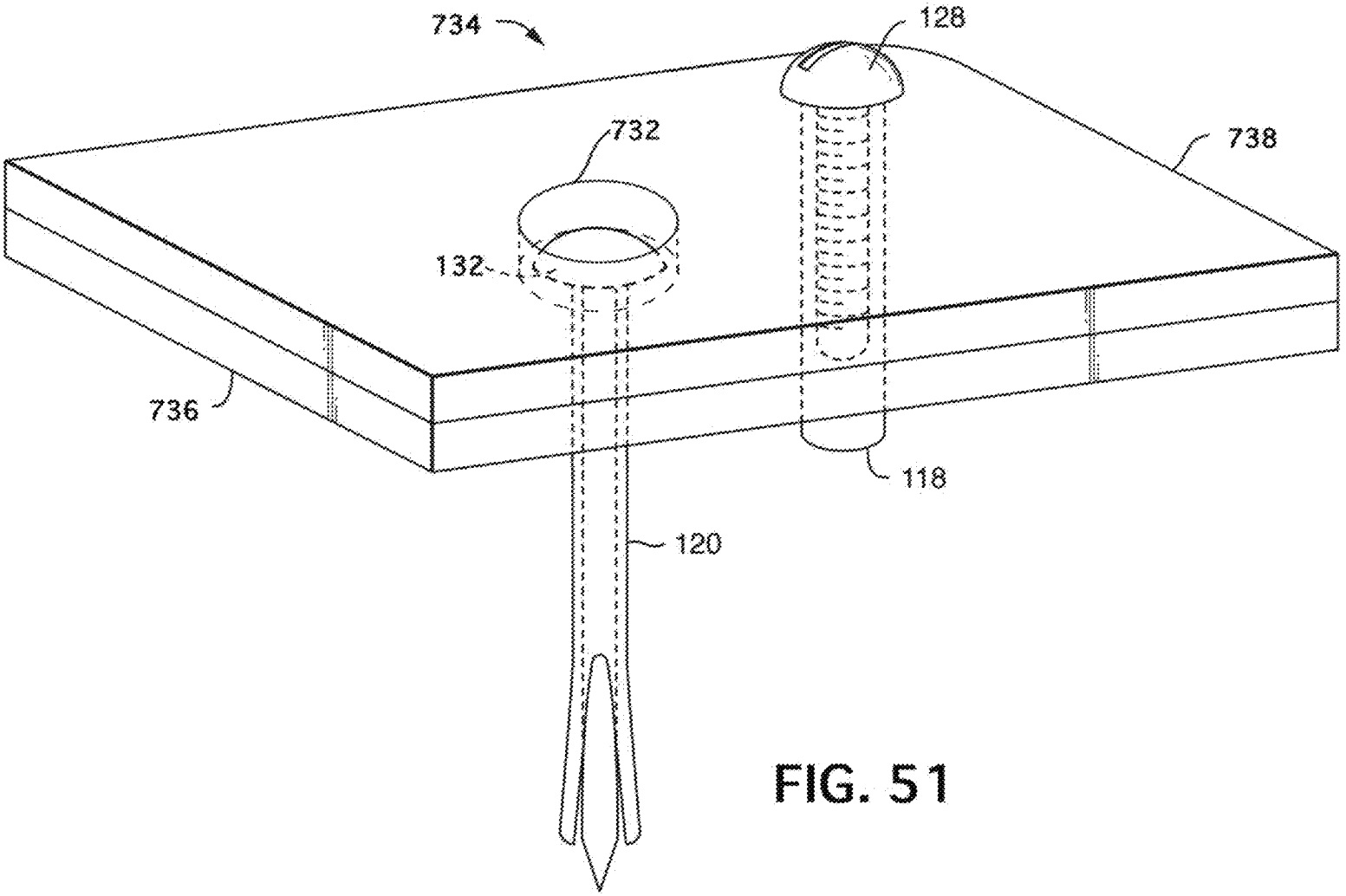
FIG. 51 illustrates an upper panel with large through-holes that align up with the anchor-holes in the lower base plate.
Figure 52:
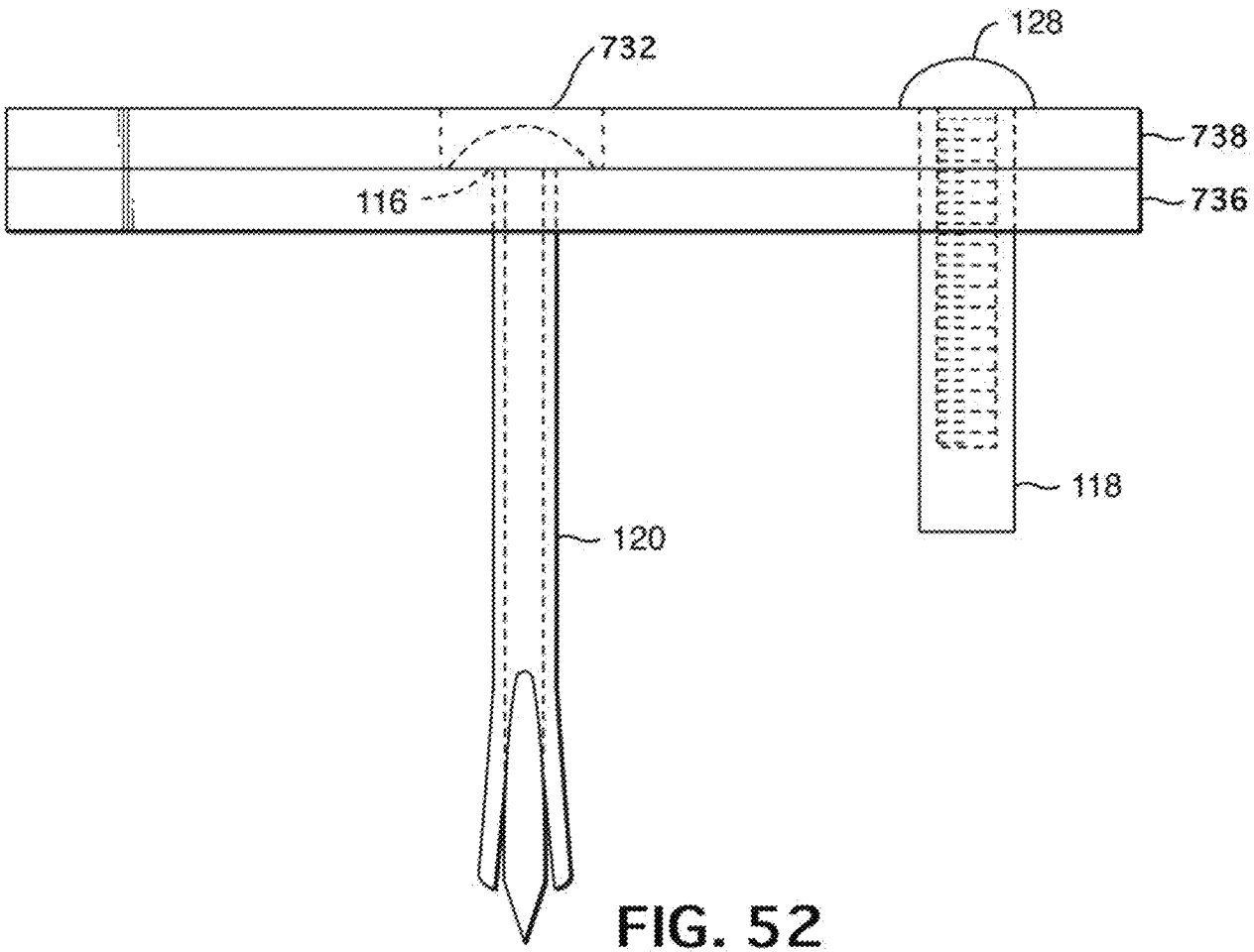
FIG. 52 illustrates an profile view of a upper panel with large through-holes that align up with the anchor-holes in the lower base plate.

An eighth embodiment of the tactile warning surface mount double plate assembly is shown in FIG. 49. This figure illustrates an upper panel 730 containing a plurality of upward projections 104 extending upwards from the surface of the solid member substrate 102 and a number of round through-holes 106. Upper panel 730 also has a plurality of larger round through-holes 732 on the interior and around the perimeter of the upper panel 730. These large round through-holes 732 are positioned so that the anchor heads that attach the lower base plate to the preformed ground surface can be exposed through the upper panel so that it sits flat on top of the lower base plate. FIG. 50 illustrates upper panel 730, placed directly above a lower base plate 112. Also illustrated in FIG. 50 are round through-holes 106 in the upper tactile panel 730 aligning with the receivers 118 in the lower base plate 112, and larger round through holes 732 in the upper panel 730 which are directly in alignment with the anchor-holes 116 which are used to anchor the lower base plate 112 to the existing preformed ground surface. FIG. 51 illustrates an enlarged section view 734 of the assembly with the upper panel 738 secured to the lower base plate 736. The design illustrated in FIG. 51 depicts the lower base plate 736 secured to the existing preformed ground surface utilizing expansion pin anchors 120 and having threaded receivers 118 mechanically affixed to it. The upper panel 738 is then placed directly on top of the lower base plate 736 such that the round through holes, FIG. 49, 106 line up directly with the threaded receiver 118 in the lower base plate 736 while at the same time the head 132 of the expansion pin anchor 120 align directly with the large round through-holes 732 in the upper panel 738. With the upper panel 738 and lower base plate 736 in alignment a threaded screw 128 can be inserted into the threaded receiver 118 and rotational torqued to achieve securement of the upper panel 738 to the lower base plate 736. FIG. 52 illustrates a profile view of the secured upper tactile panel 738 to the lower base plate assembly 736 utilizing large round through-holes 732 which allow the head 116 of the expansion anchor 120 to protrude upward into this large round through-hole 732. The upper panel in FIG. 52 does not have truncated domes (void under dome) and the design feature that makes this assembly work efficiently is the head 116 of the expansion anchor 120 is protruding into the large round through-hole 732.

Figure 53:
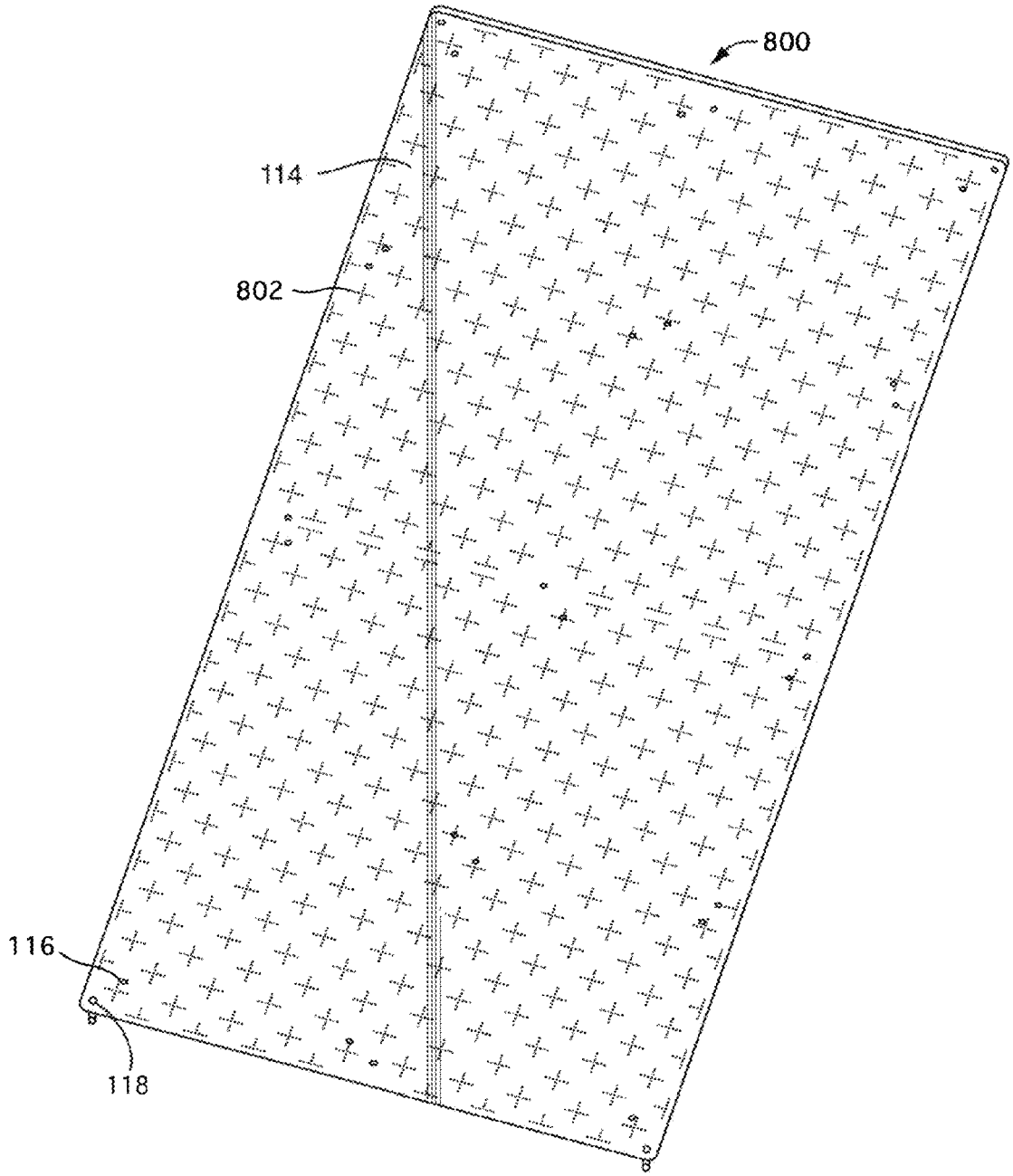
FIG. 53 illustrates a lower base plate with micro-texturing.

The ninth embodiment of the tactile warning surface mount double plate assembly is shown in FIG. 53. This figure shows a lower base plate 800 that has micro-texturing 802 on the surface 114 of the lower base plate 800. This lower base plate 800 also has anchor-holes 116 and receivers 118 attached to the lower base plate 800. The lower base plate FIG. 53, 800 is designed so that the upper panel FIG. 7, 100 can be removed and the lower base plate 800 still has the required slip resistance and can be used without an upper panel FIG. 7, 100.

Figure 54:
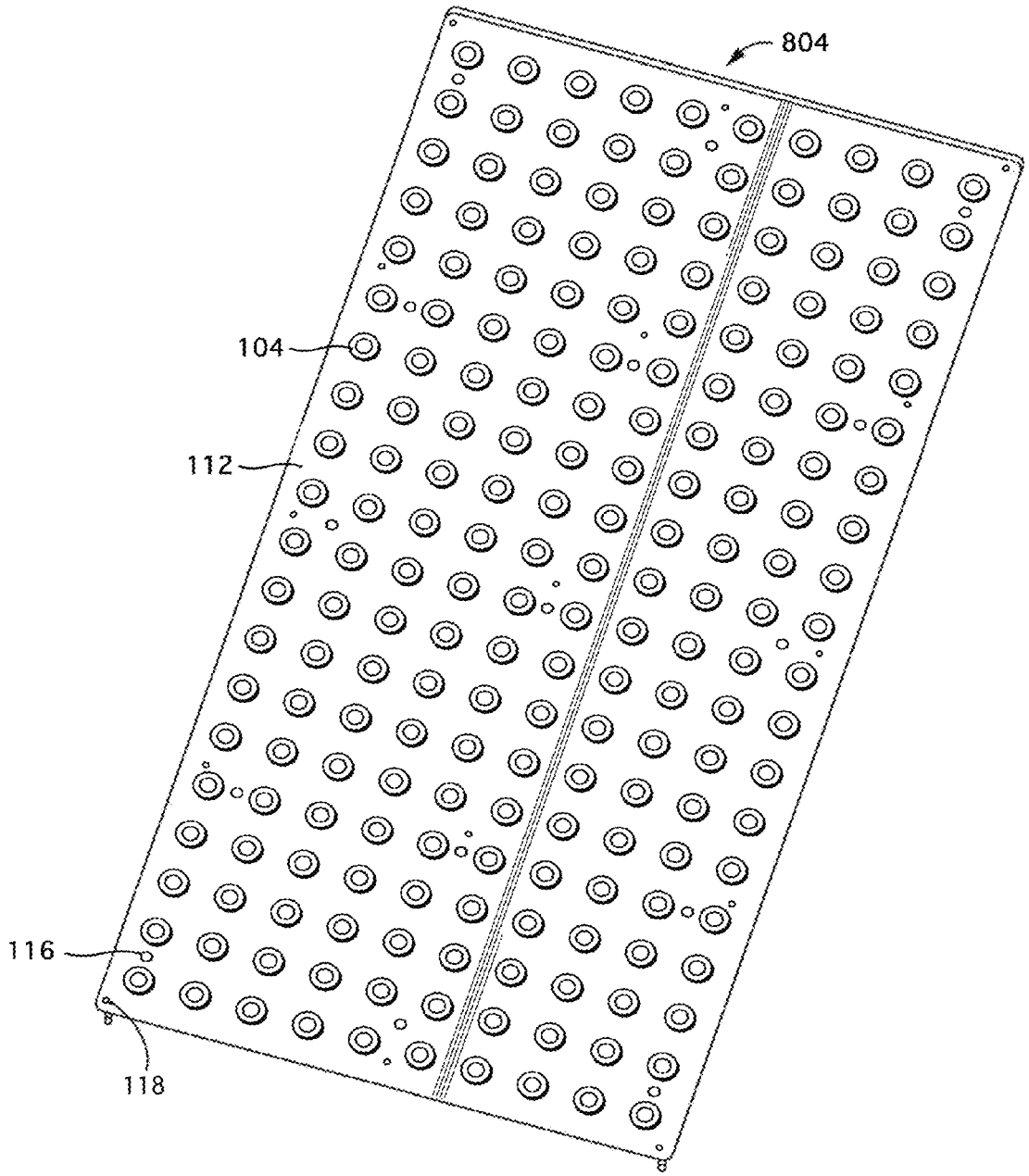
FIG. 54 illustrates a lower base plate with truncated domes.

The tenth embodiment of the tactile warning surface mount double plate assembly is shown in FIG. 54. This figure shows a lower base plate 804 that has truncated domes 104 on the surface 112 of the lower base plate 804. This lower base plate 804 also has anchor-holes 116 and receivers 118 attached to the lower base plate 804. The lower base plate FIG. 54, 804 is designed so that the upper panel FIG. 7, 100 can be removed and the lower base plate 804 still meets all the requirements of an ADA compliant TWSP and can be used without an upper panel FIG. 7, 100.

Figure 55:
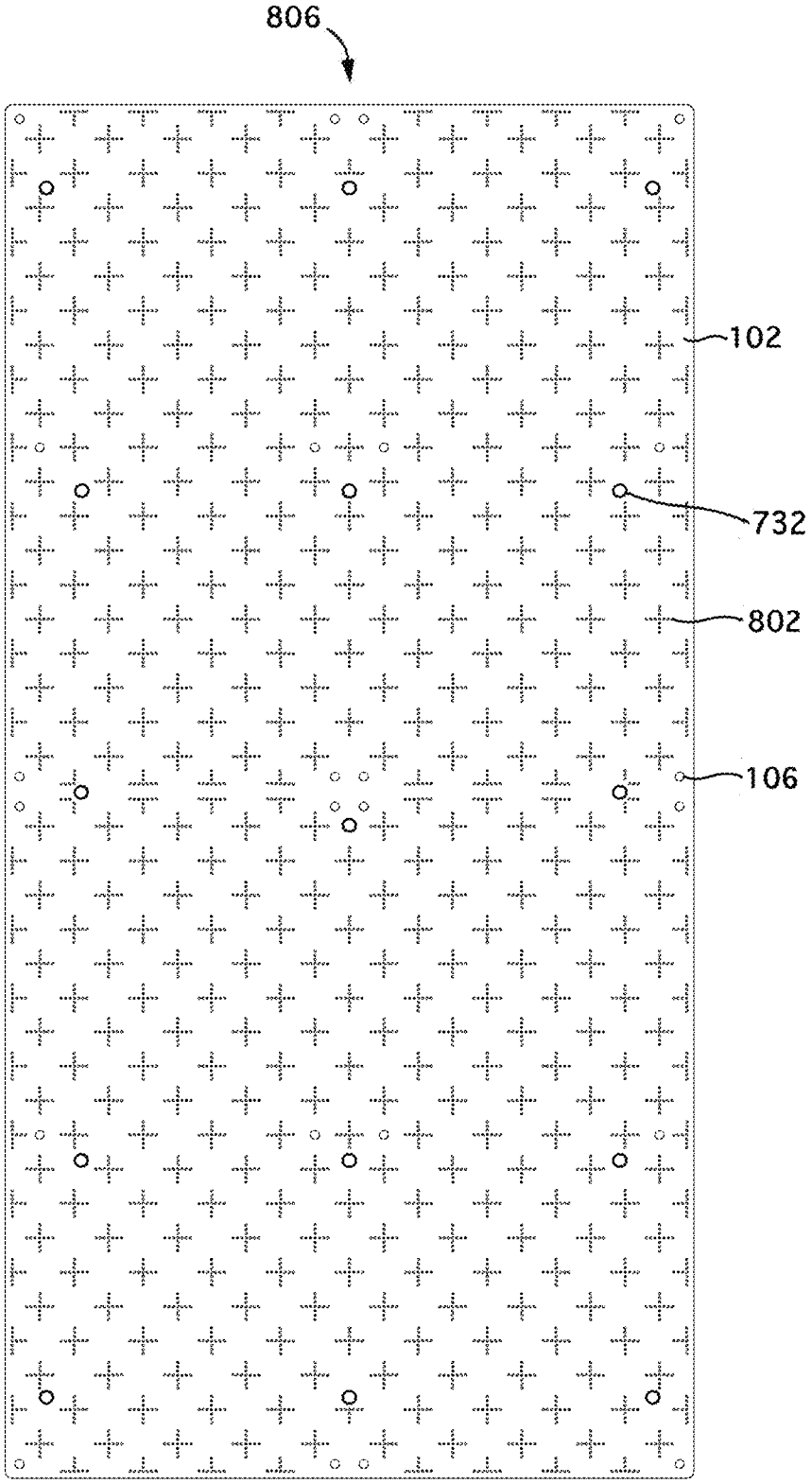
FIG. 55 illustrates a upper panel with micro-texturing and large round through-holes.

The eleventh embodiment of the tactile warning surface mount double plate assembly is shown in FIG. 55. This figure shows a upper panel 806 that has micro-texturing 802 on the surface 102 of the flat upper panel 806. This upper panel 806 also has round through-holes 106. These round through-holes 106 enable the upper panel 806 to be attached to the receivers FIG. 50, 116 in the lower base plate. In addition, this upper panel 806 with micro-texturing 802 also has large round through-holes 732. These large round through-holes as shown in FIG. 52, 732 allow the hole or void, FIG. 52, 732 for the head of the anchor fastener, FIG. 52, 120 on the lower base plate, FIG. 50, 112.

Figure 43A:
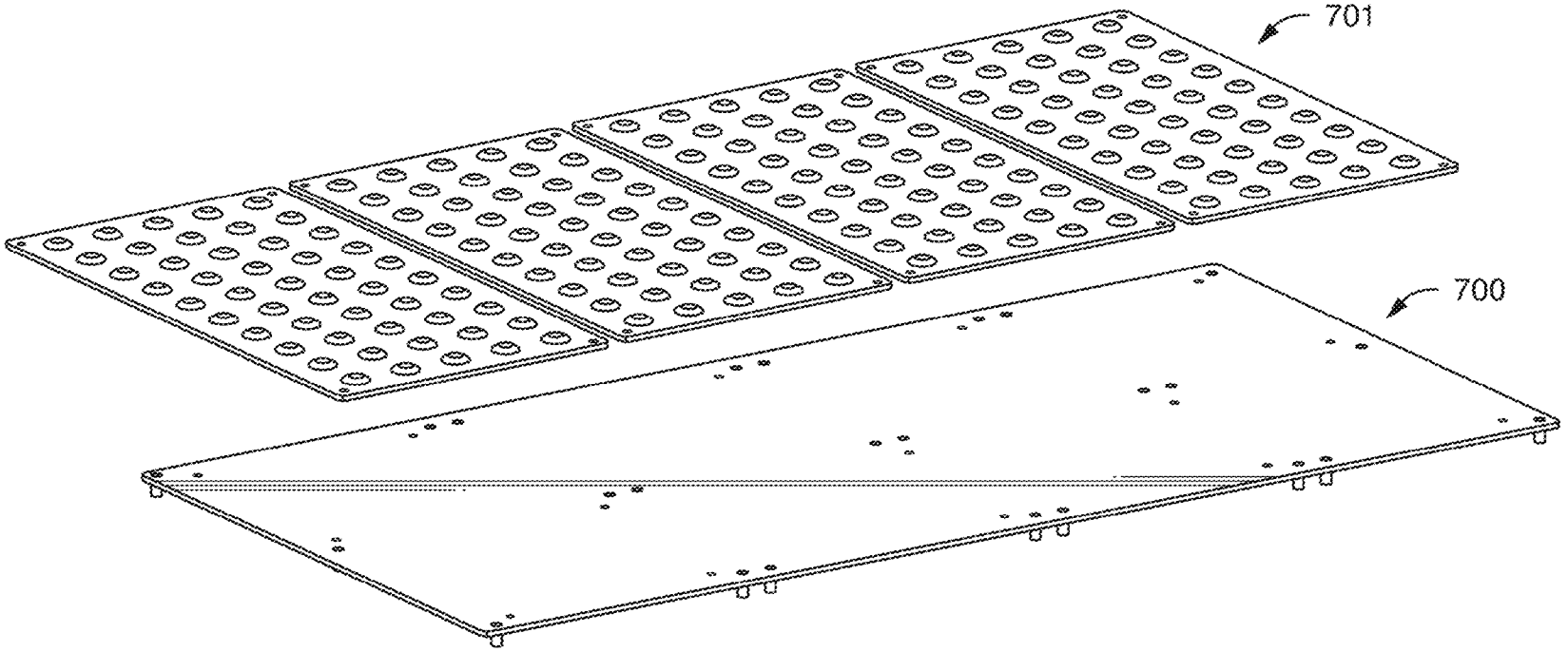
Figure 43B:
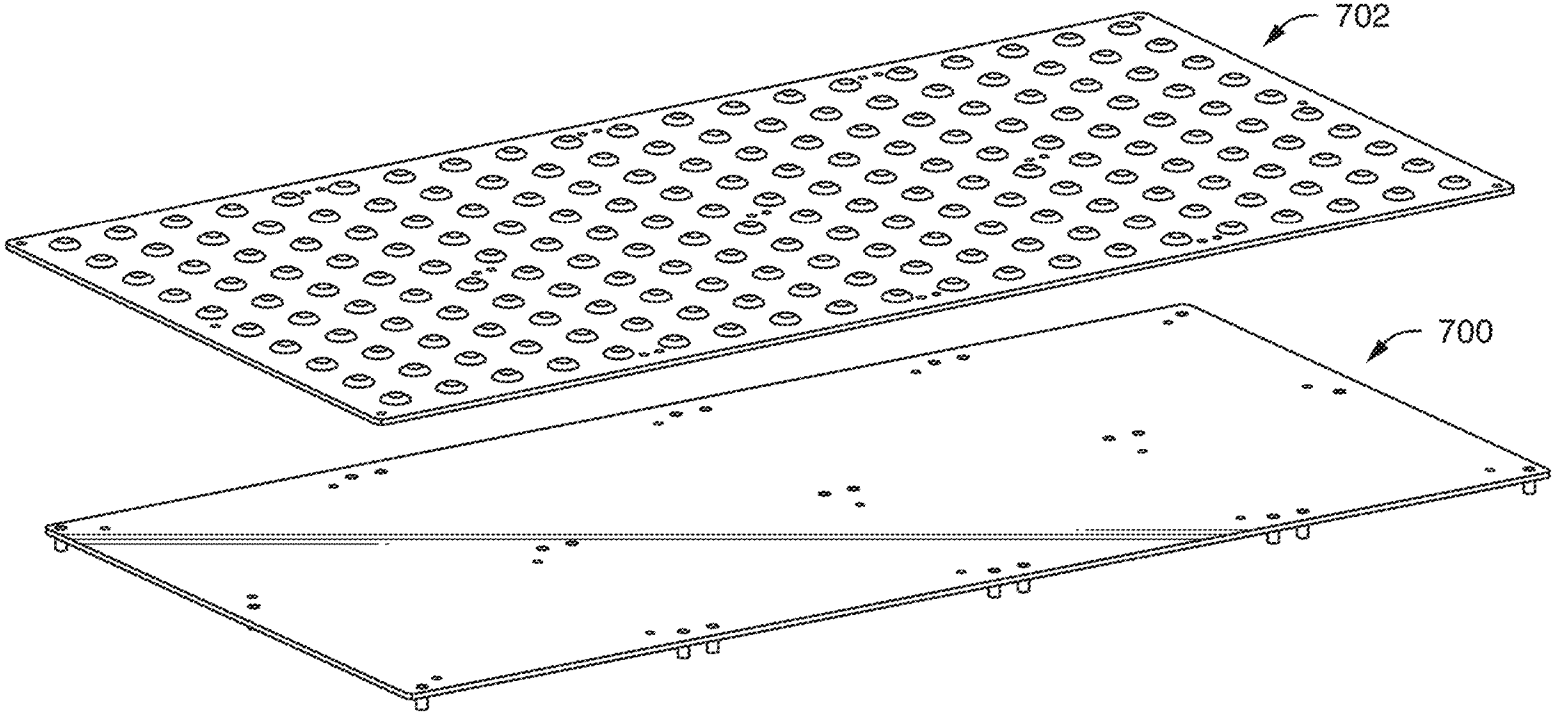
Figure 44A:
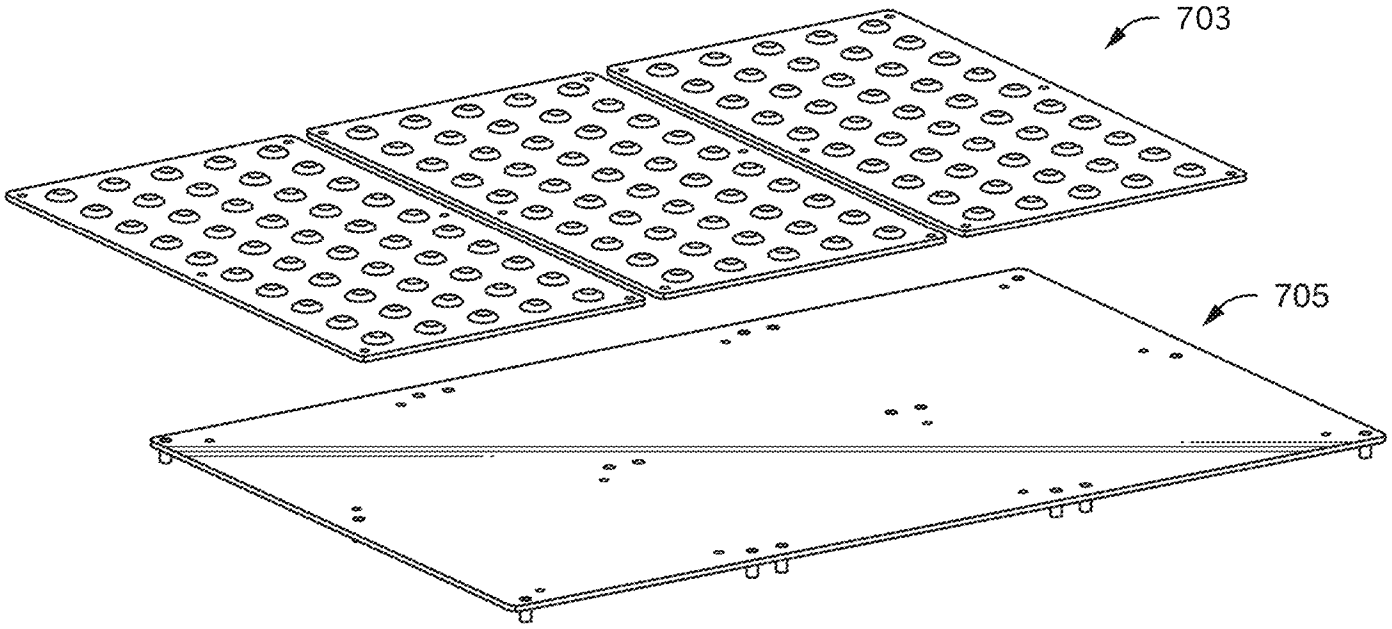
Figure 44B:
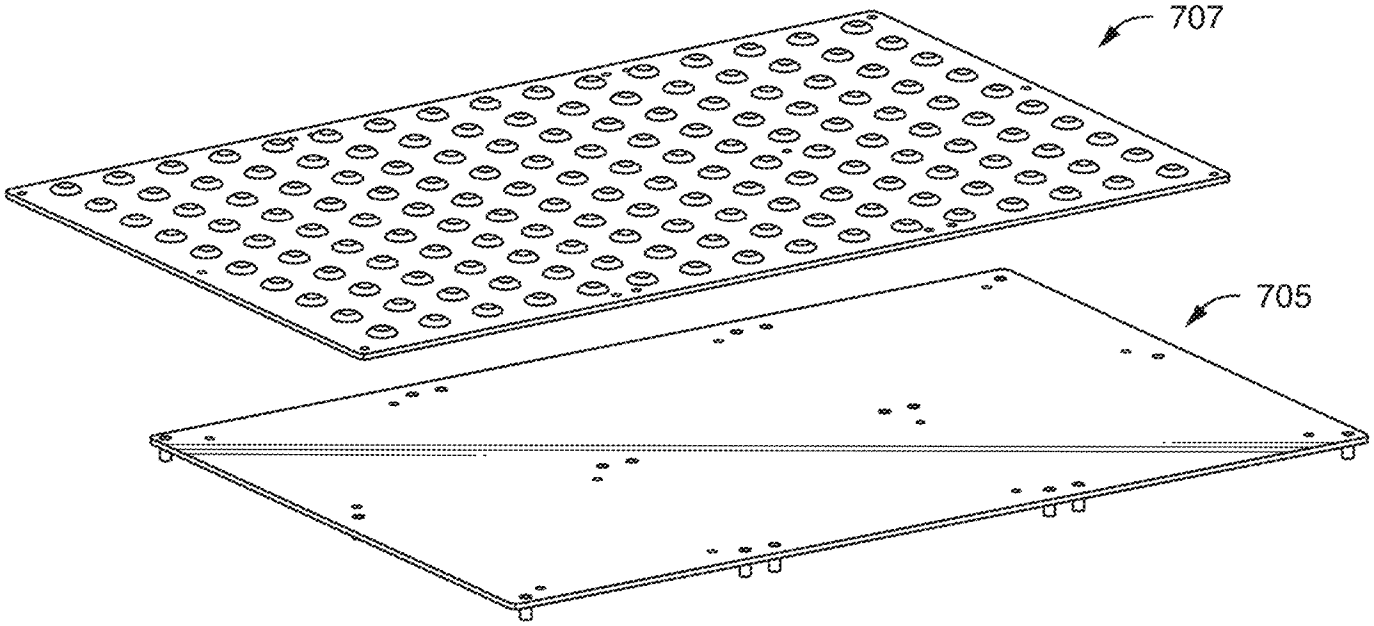
Figure 45A:
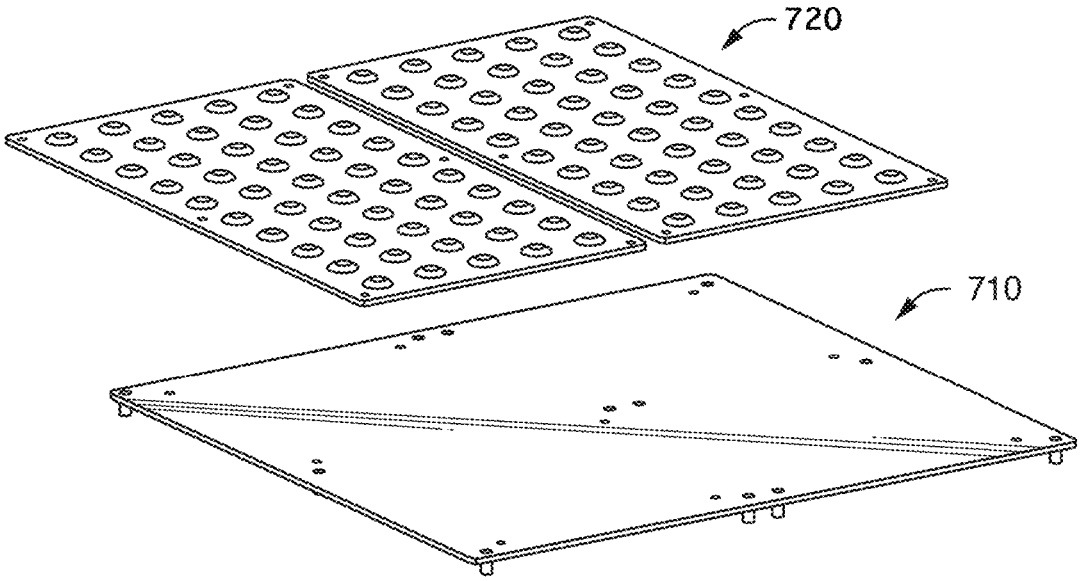
Figure 45B:
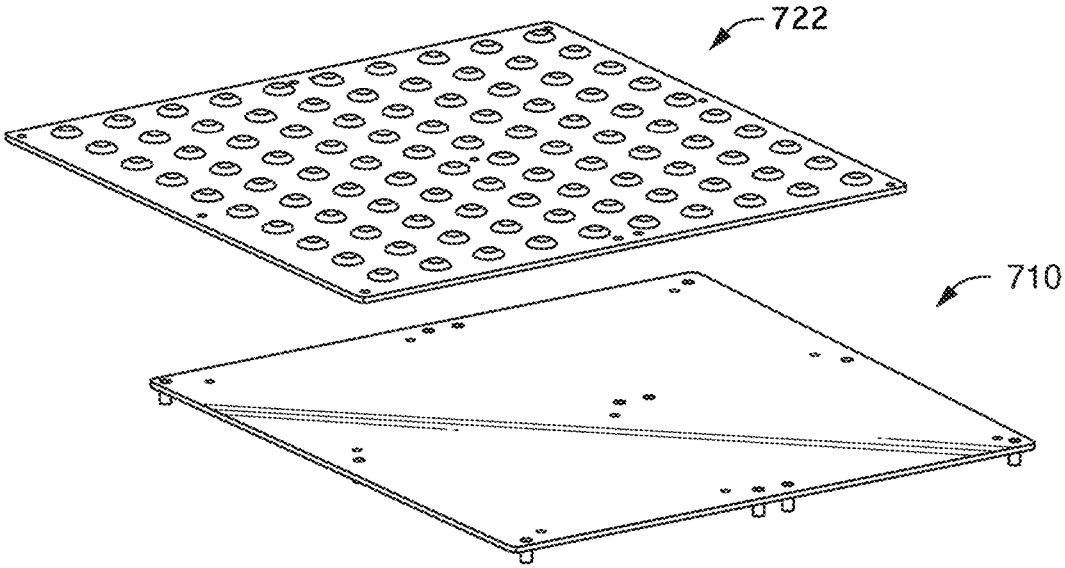
Figure 46:
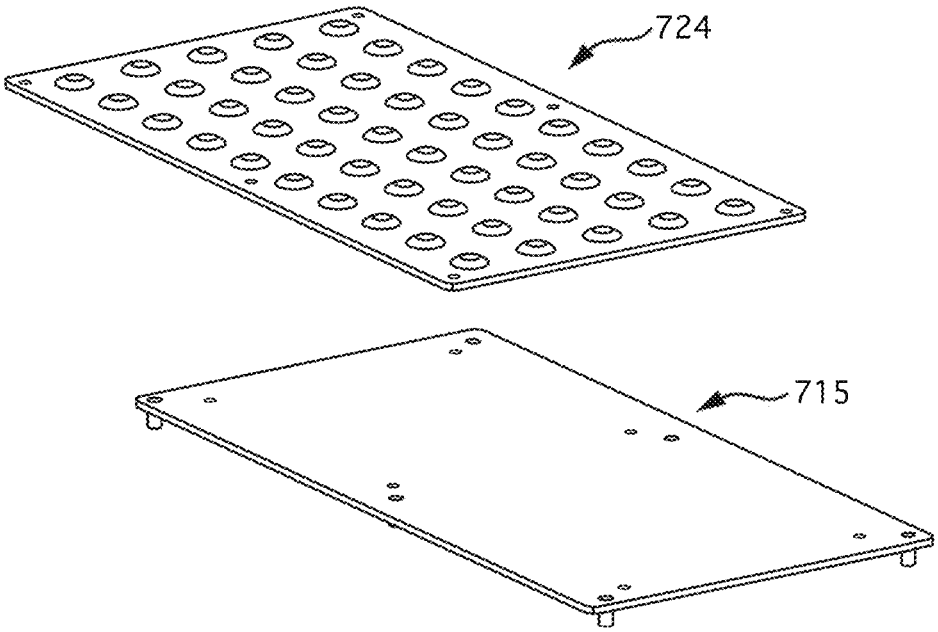
Figure 47:
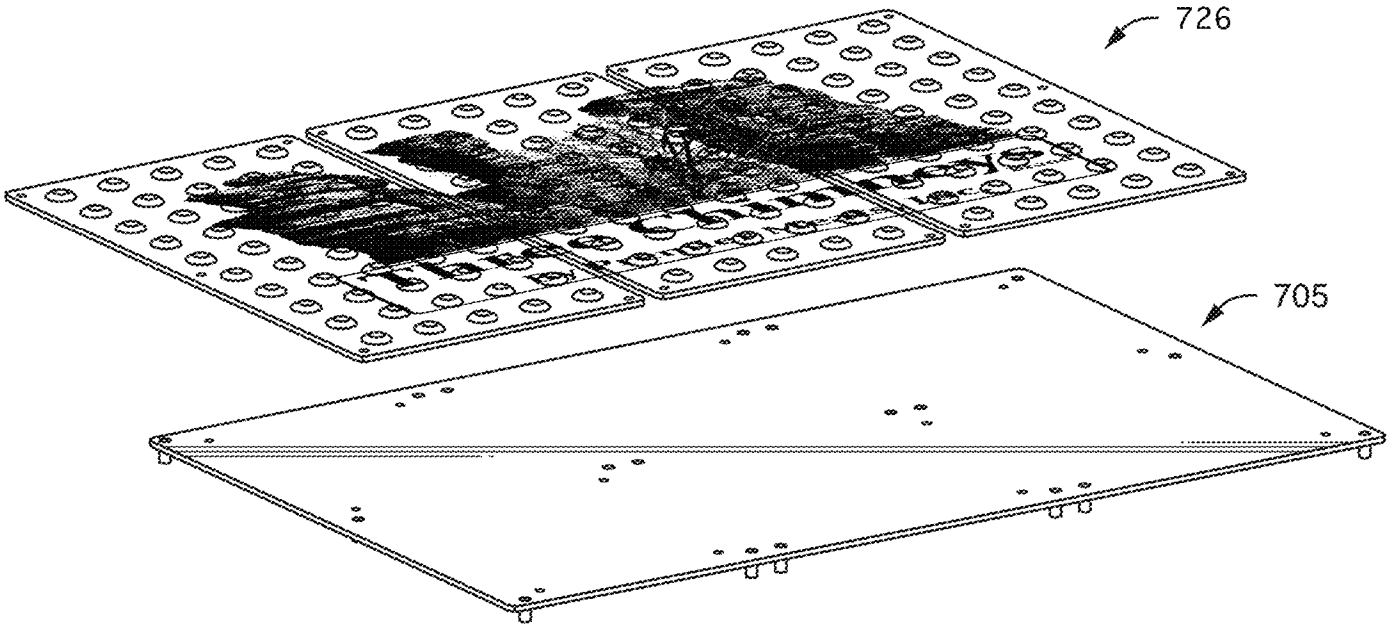
Figure 48:
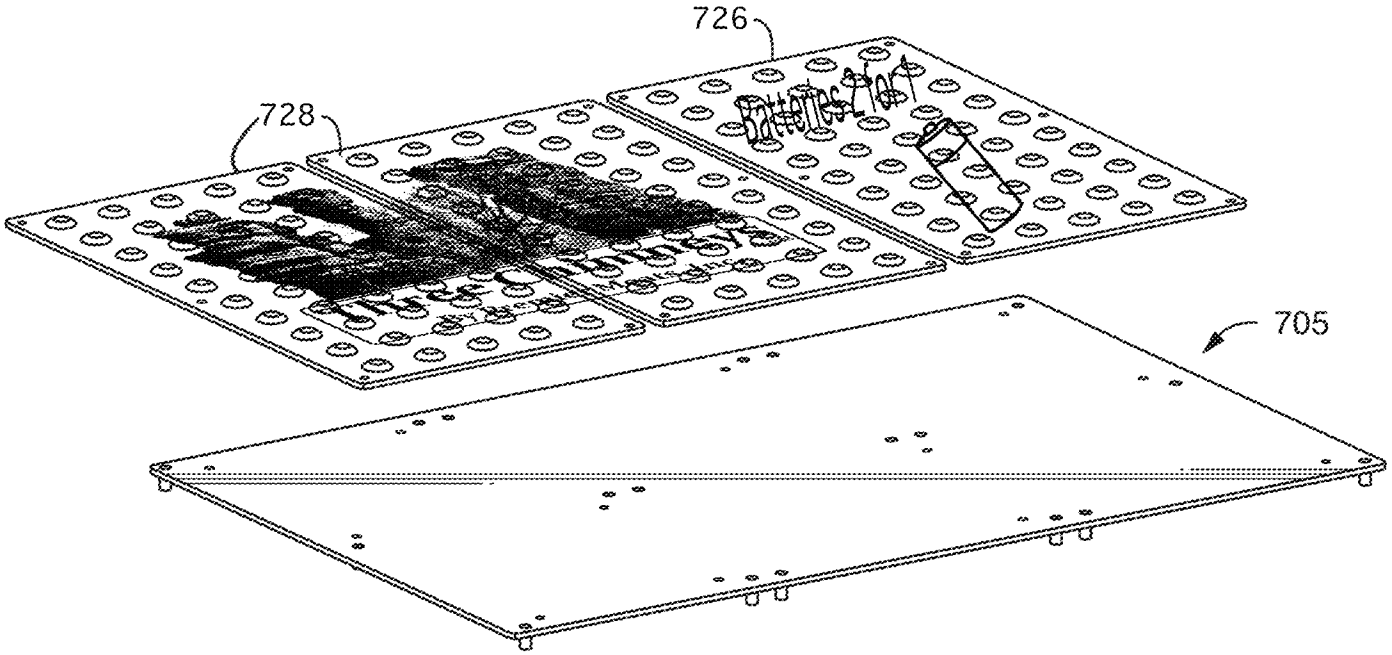

The tactile surface mount upper tactile panel can come in many different sizes. However the overall upper panel dimensions must conform to the dimensions of the lower base plate. The lower base plate size is based on the preformed ground surface site conditions and ADA requirements for the particular site. It is important for the upper tactile panel to be the same size as the lower base plate in order for the upper tactile panel to be secured properly to the lower base plate. The upper tactile panel may be a combination of different sizes that make up the same size as the lower base plate. The upper tactile panel can be made up of different sizes as long as the combination of the upper tactile panels equals the size of the lower base plate, and is super-imposable thereon. FIG. 43A illustrates an example of four (4) 1'×2' upper panels 701, each consisting of a plurality of domes and a plurality of through-holes on the interior and around the perimeter of the four (4) 1'×2' upper tactile panels 701 being placed and secured to a 2'×4' lower base plate 700. The four (4) 1'×2' upper panels 701 have an appropriate number of through-holes that match the receivers in the lower base plate 700. The advantages of this configuration include; the upper panel can be manufactured in just one (1) standard size, 1'×2', which will provide manufacturing efficiencies and the smaller 1'×2' panels can be stacked and shipped in a much smaller package which provides shipping economies and prevents damage to the upper panels. If the upper panel has been decorated with messaging or some type of advertising message as outlined in pending application US 2013/0212046 A1, then the four (4) upper panels can be printed as fragments of a single image, or be an aggregate of up to four (4) different images. Importantly, the through-hole configuration in the upper tactile panel must match the receivers in the lower base plate. This same lower base plate 700 can be used for many different size upper panel configurations. FIG. 43B illustrates a single 2'×4' upper panel 702 with a plurality of through-holes on the interior and around the perimeter of the upper tactile panel 702 being installed on a 2'×4' lower base plate 700. Other configurations on a 2'×4' lower base plate 700 could include two (2) 2'×2' upper panels, a single 2'×3' upper panel and one (1) 1'×2' upper panel and one (1) 2'×2' upper panel and two (2) 1'×2' upper panels. Building on this same build a panel puzzle concept, FIG. 44A illustrates three (3) 1'×2' upper panels 703 with a plurality of through-holes on the interior and around the perimeter of the upper tactile panels being installed on a 2'×3' lower base plate 705. FIG. 44B illustrates a single 2'×3' upper panel 707 with a plurality of through-holes on the interior and around the perimeter of the 2'×3' upper panel 707 being installed on a 2'×3' lower base plate 705. An alternative configuration on a 2'×3' lower base plate 705 incorporates one (1) 2'×2' upper panel and one (1) 1'×2' upper panel. FIG. 45A illustrates two (2) 1'×2' upper panels 720, with a plurality of through-holes on the interior and around the perimeter of the upper panel being installed on a 2'×2' lower base plate 710. FIG. 45B illustrates a single 2'×2' upper panel 722 with a plurality of through-holes on the interior and around the perimeter of the 2'×2' upper panel 722 being installed on a 2'×2' lower base plate 710. There are situations where a 1'×2' upper panel is desired. An example of this is along a transit platform where pedestrians board trains or subways. In this situation as illustrated in FIG. 46, a 1'×2' upper panel 724 with a plurality of through-holes on the interior and around the perimeter is being installed on a 1'×2' lower base plate 715. FIG. 47 illustrates that you can take three (3) 1'×2' upper panels, FIG. 44A, 703 and decorate them with messaging or some type of advertising message as outlined in pending application US 2013/0212046 A1 to form a single continuous image on three (3) 1'×2' upper panels 726 and secure them to a 2'×3' lower base plate 705. Given the interchangeability options of panel sizes of the current invention, therein lies the ability to decorate multiple single 1'×2' upper panels with different messages and imagery. FIG. 48 illustrates a 2'×3' lower base plate 705 on top of which are three (3) 1'×2' upper panels to be secured. Further FIG. 48 illustrates two (2) 1'×2' upper panels 728 have been decorated with a single continuous graphic image and one (1) 1'×2' upper panel 726 has been decorated with an entirely different graphic image. Having interchangeability options such as those depicted in FIG. 48 is advantageous for reasons such as; ability to change out single 1'×2' panels for refreshed messaging and upper plate panel damage to one or multiple panels while others remain undamaged and therefore not requiring or desiring replacement.

C. Graphic Designs on Upper and Lower Panels

In some embodiments, the either one or both of the upper and lower panels may preferably be decorated with a graphic design.

Accordingly, in some embodiments, the present invention provides a multiple panel assembly for attachment to a preformed ground surface that displays text and/or other graphic information such as commercial messages, trademarks, logos, directions, slogans, pictures, names, product illustrations, emblems, promotional information related to a product or service, Quick Response Codes, matrix code, two-dimensional bar code, optical machine-readable labels, and combinations thereof. In some embodiments, the upper panel or panels preferably is a TWSI in addition to comprising the graphic image. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors, most preferably at least three different primary colors, for example: red, green and blue; cyan, magenta and yellow; red, yellow and blue; cyan, magenta, yellow and black; and red, yellow, blue, white and black. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the graphic design is an image, for example a picture of a product, person, or place or provides a replicated image of a material such as wood, wood grain, marble, granite, stone, etc. The present invention further provides methods for producing graphic designs on the panels.

In preferred embodiments, direct sublimation decoration into the panel substrate, as well as, multilayers of powder coat paint and then decoration are applied to various substrates. Preferably, the substrate materials from which the panel is formed are selected from steel, cast iron, sheet molding compound, thermoset plastic, thermoplastics, and other plastic composite TWSI substrates.

The steel, cast iron, sheet molding compound and other plastic composite substrate types can be selected from numerous competing manufacturing companies.

The multi-step manufacturing process may include a pre-treatment and preparation of the substrate surface, a possible electrocoating step to protect labile elements from rust such as cast iron, a primer painting step, one or two coat powder coating step, a dye/ink sublimation step (which consists in the wrapping up or tightly covering of the substrate with a transfer support usually by a vacuum bagging technique, and the subsequent application of the decoration/graphic design in the substrate surface material) and a topcoat protective shield step.

The present invention utilizes a graphic design/print media/decoration system which is used for displaying visual images/graphic articles on conventional TWSI compliant substrate panels. The graphic design/print media/decoration system of the invention includes a plurality of individual three dimensional (preformed, complex shaped objects) substrates, each of which carries a graphic image within the surface material thereof. This decoration process is a multi-step manufacturing process which varies depending on the substrate material type and method of sublimation utilized. This invention includes manufacturing processes which utilizes texture powder coat paint, liquid paint, special dyes/inks, sublimation equipment and decoration methods on different material substrates.

In the present invention the need for painting the substrate and the method of decoration onto the substrate surface may vary depending on the substrate material type. The first method includes decorating both conductive and non-conductive panel substrates that are powder coat painted. This powder paint may include one or multiple layers of clear/transparent or colored powder paint. One or more of the powder coat paint layers will include textured powder coat paint. After the substrate is painted the ink/dye sublimation process will transfer the decoration/graphic design into the top powder coat layer of the substrate. The second method includes decorating both non-conductive panel substrates that have no powder coat paint or liquid paint on the substrate. In this case, the ink/dye sublimation process will transfer the decoration/graphic design directly into the substrate (for example—plastic composite substrates like sheet molding compound or vitrified polymer composite). In addition, in both of the above methods the substrate may then have applied a clear/transparent coating (protective shield) to protect the substrate and the graphic carried thereby. Such coatings can, for example, impart increased weather-ability, UV protection, abrasion resistance, slip resistance, chemical corrosion resistance, anti-graffiti and the like.

The decoration of a panel with a graphic design is a multi-step manufacturing process. This process generally comprises multiple steps depending on substrate material type and product usage factors.

The first step in the manufacturing process (powder coat paint and dye/ink sublimation process) for the present invention is to prepare the substrate for the powder coat and dye/ink sublimation processes. Both mechanical and chemical cleaning methods may be used depending on the material type of the substrate. In some embodiments, the substrate is pre-treated by submitting it to at least one step (selected from a list of both mechanical and chemical treatments) of surface preparation selected from the group consisting of degreasing, cleaning, anodic oxidation, neutralization, chromate treatment, phosphochromate treatment, phosphating, nitro cobalt treatment, treatment with chrome-free products and mechanical polishing or sandblasting. After the cleaning is completed, the substrate is dried prior to the painting and/or sublimation process.

The next step is a primer electrocoat process preferably used prior to the powder coat paint process for cast iron, ductile iron and in some cases steel substrates. This primer electrocoat process prevents aging/rusting of the iron or steel material if the installed substrate panel is scraped/scratched all the way through the powder coat paint layer(s) and down to the material surface. Once scraped/scratched on the material surface the iron or steel product will rust or take on a natural patina tone. The electrocoat process prevents this initial scratch from migrating out from the initial scratch location and further damaging the look of the panel. The finish applied is preferably a cathodic epoxy electrocoat product. PPG POWERCRON 6000CX—black cathodic epoxy finish is an example of a product that can be used in this process. Cathodic epoxy coatings offer the corrosion and chemical resistance and serve as a benchmark for primer performance. Applying E-coat is a generally a four step process. (1) In the electrocoat process substrates are cleaned and pretreated with a phosphate conversion coating to prepare the part for electrocoating. (2) Parts are then dipped into an electrocoat paint bath where direct current is applied between the parts and a "counter" electrode. Paint is attracted by the electric field and is deposited on the substrate. (3) The coated substrate is removed from the bath, and rinsed to reclaim undeposited paint solids (2-3 counter-flowing rinses located after the bath). (4) The substrate is then baked to cure the paint (standard bake is 20 minutes at 350 degree Fahrenheit metal temperature. The cast iron, ductile iron and steel panels are then ready to be powder coat painted.

The next step of the manufacturing process is used with non-conductive substrates such as plastic, nylon, fiberglass, concrete and plastic composites and the like which require an additional paint process in order to be powder coat painted. This is due to the non-conductive nature of these types of materials (unless conductive additives have been included in the plastic raw material prior to molding thus making it a conductive substrate) and the need to apply powder coat paints utilizing electrostatic methods. Non-conductive plastic substrates are selected from the group consisting of polyamide material, polypropylene material, polycarbonate-acrylonitrile-butadiene-styrene material, acrylonitrile-butadiene-styrene material and blends thereof. There are numerous industry known methods to make a non-conductive substrate conductive enough to powder coat paint. For example, a metal conductive dummy plate can be positioned behind the non-conductive plastic composite at the time the substrate is powder coat painted. Another method is to apply a liquid paint adhesive/primer which then makes the substrate conductive. This liquid paint process comprises the steps of cleaning the substrate, applying a water-based adhesive/primer, curing the adhesive/primer and then applying the desired coats of thermosetting powder and then curing. One such adhesive/primer that is available commercially is Spraylat's conductive coating technology.

The next steps of the manufacturing process relate to powder coat painting for certain substrate material types. Conductive substrates are preferably powder coat painted in order to use sublimation methods to decorate, as well as, meet the necessary slip resistance specifications for a product placed on the ground and used for wayfinding. The first decision to make in the powder coating selection process is to define the finish product requirements. The present invention for both conductive and non-conductive substrates preferably provides a super durable, maximum adhesion, anti-slip (textured), ultra-violet (UV) protection, highly chemical/corrosion resistant and excellent weather ability detectable warning panel. This invention preferably uses a specific powder paint described in more detail below and in the examples since in most cases it will be exposed to the harsh outdoor environment and be located on the surface of the ground (concrete or bituminous pavement). In addition, in most cases the panels will be on the ground and will have to withstand extensive foot traffic and weather related conditions (rain, ice, snow, salt, UV rays, hot and cold temperature fluctuations, substrate shrink and swell). The powder coat paint top layer will include a texturing agent in order to provide the slip resistance required for the panel product. In addition, this top layer textured powder coat paint preferably accepts the sublimation dyes/inks for the decoration and/or graphic art on the panel substrate.

The powder coat paint may be a thermoplastic or a thermoset polymer. The present invention will use thermoset powder paint. The thermoset powder coat paint is a type of coating that is applied as a free-flowing, dry powder. The coating is applied electrostatically and is then cured under heat to allow it to flow and form a "skin". When a thermoset powder is exposed to elevated temperature, it begins to melt, flows out, and then chemically reacts to form a higher molecular weight polymer in a network-like structure. This cure process, called crosslinking, requires a certain temperature for a certain length of time in order to reach full cure and establish the full film properties for which the powder coat paint material was designed.

The most common way of applying the powder coating on conductive substrates is to spray the powder using an electrostatic gun. The gun imparts a positive electric charge on the powder, which is then sprayed towards the grounded object by mechanical or compressed air spraying and then accelerated toward the work piece by the powerful electrostatic charge. The object is then heated, and the powder melts into a uniform film, and is then cooled to form a hard paint coating. In the present invention, the conductive substrate may be heated first and then sprayed with the powder paint onto the hot substrate.

As with any paint coating, formulation variables are critical to the processing and performance characteristics. The powder coat formulation is much like a liquid coat formulation except for that most of the components are in solid, melt processable form. The main raw material components used in powder coatings are resins, curing agents, accelerators, pigments, fillers, extenders, degassing agents, dry flow agents, flow agents, matting agents, texturing agents, rheological additives and waxes.

The primary resins used in the formulation of thermosetting powders are: epoxy, polyester and acrylic. These primary resins are used with different crosslinkers to produce a variety of powder materials. Many crosslinkers, or curing agents, are used in powder coatings including amines, anhydrides, melamines, and blocked or non-blocked isocyanates. Some materials also use more than one resin in hybrid formulas. The chemical reaction in the cure cycle creates a polymer network that provides excellent resistance to coating breakdown. A thermoset powder that has cured and crosslinked will not melt and flow again if subjected to heat a second time.

Epoxy powders were the first commercially available thermoset materials and they are the most commonly used of the thermoset powders. The primary drawback with epoxy powders for this invention is that they will chalk when subjected to UV radiation. For this reason, this powder paint formulation is not applicable for this invention which is in the outdoor environment and continuously exposed to UV radiation.

Hydroxyl terminated polyester resins are used to formulate urethane polyesters and carboxyl terminated polyester resins can be typically cured by triglycidyl isocyanurate (TGIC) or HAA, hydroxyalkyl amide materials. Urethane polyesters have excellent resistance to outdoor environments, toughness and very good appearance characteristics. A smooth, thin film that resists weathering and physical abuse makes the urethane polyesters a good choice for the outdoor environment. It is common to block the crosslinker in urethane polyesters with e-caprolactam. To begin the crosslinking process, the material preferably reaches a temperature above the blocking agent threshold. With e-caprolactam, unblocking occurs at approximately 182 degrees C. Other curative options include uretdione, self-blocked polyisocyantes for curing/crosslinking hydroxyl functional polyesters. Polyester TGIC coatings use the epoxy functional crosslinker triglycidyl isocyanurate (TGIC). In these coatings a low molecular weight glycidyl, epoxy functional curing agent is used to co-react with the polyester. In this way, the polyester constitutes a very high percentage of the resin and provides weather and corrosion resistance incomparable to the urethane cured polyesters. TGIC's have very good adhesion characteristics, corrosion resistance and exterior durability. They typically can be cured at lower temperatures than urethanes and/or have shorter cure cycles. All of the above powder coatings can be cured at lower temperatures when suitable resins are selected along with appropriate catalysts. Even cures at or below 212 F are possible with UV cure powder coatings.

Acrylic powders also give excellent exterior durability. Common acrylic-based materials include urethane acrylics (hydroxyl functional resins), acrylic hybrids (acid functional resins) and glycidyl methacrylate acrylics (GMA) (epoxy functional resins) which can be cured with diacids and/or anhydrides for example.

In some embodiments, the panels may be powder coat painted with either one or two coats. A third topcoat or protective shield coat layer may also be painted on the panel with either a powder or liquid coat paint. The specific type and number of powder coats and the possible topcoat or protective shield paint layer applied to the panel will depend on what is required for the end panel product application. The number and type (non-texture vs. texture) of powder paint coats needed in the first two layers will depend on a number of factors such as, the environment (inside or outdoors), base color in a first layer, and additional colors in successive powder coat layers, desired textures and durability for intended use.

In some embodiments of the present invention, the powder coat paint top layer preferably accepts sublimation of inks/dyes. This process has the advantage in that dyes penetrate 1-2 mils (about 40-80 micrometers) into the surface of the powder coated substrate making them scuff resistant in a walk-over surface. The preferred chemistry for dye sublimation heat transfer powder coatings is the polyester/urethane blend. The difference in the hydroxyl, OH functionality of competing resins can be used to produce gloss controlled thermosetting powder coatings suitable for dye sublimation heat transfer. Use of a medium hydroxyl, OH functional, and a very high OH functional resin in a one shot through the extruder formulation yields a gloss controlled powder coating. The medium hydroxyl functional polyester resin has hydroxyl value in the range of 30-50. The high functionality hydroxyl resin typically has hydroxyl value in the range of 200-300. When the above two polyesters compete for the isocyanate curing agent to cure, an incompatibility is created which results in a controlled lowering of gloss. The number of average molecular weights for the medium hydroxyl value polyester are typically 2200-3200. The number of average molecular weights for the high hydroxyl polyester are typically in the range of 1500-2500. A specially designed resin system for use with Uretdione (self-blocked) as a cross-linker can eliminate the blocking agent, e-caprolactam, evolution. Evaluations carried out with different ratios of medium OH and high OH number resins vary the gloss achieved. Table 1 shows the typical powder coat formulations for dye sublimation heat transfer.

TABLE 1

| Ingredients (b) | 1 | 2 | 3 | 4 | 5 |
|---|---|---|---|---|---|
| Albester 3225 | 500 | 500 | 500 | 500 | 500 |
| Albester 3115 | 166 | 166 | 166 | 166 | 166 |
| Albester 6520 | — | 20 | 40 | 60 | 80 |
| Crelan LS 2147 | 285 | 285 | 285 | 285 | 285 |
| Benzoine | 3 | 3 | 3 | 3 | 3 |
| Resiflow PV 88 | 20 | 20 | 20 | 20 | 20 |
| Bayferrox Yellow 420 (a) | 23 | 23 | 23 | 23 | 23 |
| Bayferrox Red 130 M (a) | 1 | 1 | 1 | 1 | 1 |
| Bayferrox Black 306 T (a) | 2 | 2 | 2 | 2 | 2 |
| Total (b) | 1000 | 1020 | 1040 | 1060 | 1080 |
| Gloss @ 60 Degrees | 16 | 19 | 21 | 24 | 27 |
| LS 2147 Stoich % | 78.10% | 77.71% | 77.40% | 76.90% | 76.50% |

(a) Pigments added to powder coat paint
(b) Units - grams/lbs./tons

Two polyester resins, Albester 3115 and Albester 3225 are specially designed for the use with Uretdione curing agents. Albester 6520 is designed as the gloss control resin and Albester 6320 is designed as a high durability, high Isophthaic Acid content, resin to improve the weatherability of the system. For the low gloss to properly develop, cure is preferably achieved. Minimum temperature for thermoset cure is determined by the isocyanates curing agent used as well as the choice/concentration of urethane catalysts. By using a medium hydroxyl value polyester, Albester 3225, a high hydroxyl value polyester, Albester 3115 and Crelan LS 2147 in powder coating formulations very low gloss coatings can be achieved. The excellent chemical resistance of the Albester 3115 and Albester 3225 system makes it suitable for exterior applications where high chemical resistance and durability are required. The low gloss polyester/urethane powder coating for dye sublimation heat transfer technology works as follows. In order for the process to yield high resolution full-color graphic design results the first layer base coat should be a white powder coat paint with a second layer topcoat of low gloss textured clear/transparent powder coat paint. Gloss modification is required to obtain the low gloss in the textured clear/transparent powder coat paint top layer.

The need for an additional powder coat or liquid paint topcoat or protective shield depends on the required durability, weather ability, and UV protection required for the end product. The main purpose for the additional topcoat or protective shield is for additional protection for the panel from UV rays and thus fading of the decoration or graphic art. In addition, the topcoat or protective shield can add additional slip resistance and anti-graffiti protection.

The powder coat paint process requires an electrostatic environment in order for the powder paint to adhere to the substrate prior to the baking/curing process. Certain types of substrate materials such as steel and cast iron can conduct the electrostatic charge needed for the powder paint process. These types of substrate materials are conductive. It is more challenging to paint non-conductive substrate materials such as plastics, sheet molding compound, plastic composites, nylon, nylon6, nylon66, fiberglass, concrete, and the like. Thus, both conductive and non-conductive substrate materials have their own set of rules for applying powder coat paints. The non-conductive substrate types preferably have a liquid adhesive primer paint applied to the substrate prior to the powder coat paint process. This adhesive primer serves many purposes such as, it increases the electrical surface conductivity, it allows the powder to bond properly during the powder curing stage, and it protects the surface of the non-conductive substrate from any undue chemical reaction with the thermosetting powder and it increases and enhances the transfer efficiency of the powder to the substrate.

Different clear/transparent textured topcoat powder coat paint formulations were developed and field tested for this invention. These powder coat paint texture formulations had to provide many different physical characteristics. These textured powder coatings had to impart durability, weatherability, UV protection, abrasion resistance, slip resistance, chemical corrosion resistance, anti-graffiti and the like. In addition, the inks/dyes from the sublimation process had to penetrate into this clear/transparent texture and provide a good graphic image quality. Super durable which are charged with UV inhibitors resins have been developed to give extended durability compared with conventional exterior coatings. A definition in terms of performance as to what is required from a super durable resin can be found in the Qualicoat Standard (super durable resins are called class 2 powders in this standard). A super durable powder preferably retains at least 90 percent of its original gloss level after one year in Florida and at least 50 percent of its gloss after three years' Florida weathering. Some raw materials used in resin manufacture give extended durability but do not give good mechanical results. Thus, various methods are being looked at to improve this situation. Resin manufacturers continue to develop super durable resins for curing with alternative crosslinkers.

The present invention includes several different textured powder coat paint formulations. Two of these textures were found to consistently provide the best results regarding the required criteria for the top layer of the panel. These two textured top layer powder coat paints have been labeled DS707 and ADA 1104/06. The non-abrasive gripping surface of the various textured powder coat paints function to provide the required slip resistance for this product. In addition, this texture also increases the durability of the powder coat paints.

The present invention includes the painting of conductive substrates with different combinations of powder coat paint. This can be either one or multiple coats of powder coat paint. The overriding requirement is that the top layer of powder coat paint has to be able to both receive sublimated dyes for the graphic design and provide the necessary slip resistance required for the detectable warning panel.

Once the substrate is powder coat painted and cured, the next step is to use dye/ink sublimation techniques to put a decoration/printed media/graphic art/corporate logo/advertising in the first layer (various colors/no texture/with texture) or second layer (clear/transparent texture layer) of the substrate depending on the number of layers of powder coat paint. It will be recognized by those of skill in the art that other methods may also be used to decorate the substrate with a desired graphic design. The dye/ink sublimated decoration will go in the top layer of powder coat paint. This patented dye/ink sublimation process and related equipment is detailed in six different patents. These patents and patent applications are hereby incorporated by reference in their entirety and include U.S. Pat. No. 6,015,469 (Jan. 18, 2000), U.S. Pat. No. 6,136,126 (Oct. 24, 2000), U.S. Pat. No. 6,335,749 (Jan. 1, 2002), U.S. Pat. No. 6,676,792 (Jan. 13, 2004), U.S. Pat. No. 7,033,973 (Apr. 25, 2006), U.S. Pat. No. 7,077,926 (Jul. 18, 2006), U.S. Pat. No. 7,302,981 (Dec. 4, 2007).

Dye/Ink sublimation is a direct transformation of the inks from a solid state to a vapor/gas state (without turning into a liquid). Sublimation decoration has many advantages compared with other decoration means. The ink vapors penetrate the powder coat top layer of the substrate and generate bright, colorful, vivid, resistant and no-thickness decorations. The dyes/inks sublimate into the top powder coat layer and take on the characteristics of this layer of powder coat. Thus, the decoration can support even heavy wear, abrasive and outdoor environments/conditions, including a high resistance to many chemicals.

After the substrate is powder coat painted and cured, preferably with the appropriate super durable (outdoor environment) types/layers of paint (colored powder paint, colored textured powder coat paint, clear/transparent textured powder coated paint), the substrate is then ready for the patented dye/ink sublimation process. This patented dye/ink sublimation process is designed for any three-dimensional, complex shaped, nonplanar object or substrate.

In preferred embodiments, graphics software is utilized to format and refine the digital decoration or graphic image that is to be sublimated onto the substrate. The graphics software generally accepts graphic images in file formats such as TIFF or PSD. Once the digital image has been formatted and aligned properly in the software program, including picking the appropriate pantone colors and letter fonts, the image is then printed on transfer film. A customized wide printer/plotter is used to print the decoration/graphic art image onto the clear transfer film/fabric with organic photosensitive pigments (dyes/inks) and cellulose resin. This clear transfer film/fabric may include alignment aids on the film. These alignment aids are useful for installing the decoration/graphic image on the three-dimensional, nonplanar or complex shaped substrates either in the center and/or straight. It will be important with the same decoration/graphic image to align the transfer film on the substrates exactly the same every time especially in a high production environment.

The powder coated substrate is placed on a specially designed table, rack or membrane system. This table top, rack, or membrane system may preferably have alignment aids built into it. These alignment aids may include on the table top or rack system marked notations, a saddle, mold or jig. The alignment aids will guarantee that the substrate is aligned properly for the sublimation process. In addition, the alignment aids will keep the substrate steady during the sublimation process. The transfer film/fabric is then placed on and wrapped over and/or around the substrate. The transfer film/fabric is then slightly warmed with IR technology, blown up slightly and then utilizing a pressure vacuum (around 200 Millibar) seal system the film is then sucked down and around the three-dimensional, nonplanar, complex shaped substrate (Decoral equipment using vacuum and heat combined). The substrate with the transfer film/fabric sucked tightly to it is then placed in an IR (infrared) technology oven, non-IR oven or other heat oven. Alternatively, the substrate may be wrapped with the transfer film/fabric and placed on or between a membrane(s). The membrane may preferably be made of high temperature silicon or other high temperature elastomeric material that will provide a sufficient pressure when vacuum is applied to conform to the shape of the substrate. Utilizing a pressure vacuum (e.g., around 200 millbar) seal system, the membrane is then compressed down and around the substrate using vacuum equipment (e.g., from Decoral). The dye/ink sublimation normal cure process takes place at around 300-400 F for 30 seconds to 30 minutes (depending on product) in order to obtain sublimation. This dye/ink sublimation transfer system makes the dyes/inks go from a solid state becoming gas and again back to solid without going into a liquid state. At the correct temperature and pressure, the pigment dyes/inks transfer from the film support and move into the synthetic layer of the textured powder coat paint, fixing both the color and graphic image position into it. Factors affecting the best quality and results are: right temperature, time and mechanical pressure. Since the full penetration of the pigment dyes/inks into the coating layer is the basic condition to get the highest quality result the Decoral System has adapted a microscope control system that allows an immediate quality check of the decorated pieces. Another reason for using this test is that it is an easy way to check how the pigments melt with the paint molecular structure of the coating layer.

The substrate is then removed from the curing oven or IR technology and allowed to cool. Once the substrate has cooled the transfer film/fabric is removed from the substrate. The decoration or graphic image is now in the top layer of powder coat paint (not on the surface but actually in the powder paint). This provides the decoration or graphic image the same durability as that of the powder coat paint (required for the outdoor environment).

This sublimation process includes powder coat paint, textured powder coat paint, textured powder paints that can except sublimated dyes/inks, transfer film/fabric, dyes/inks and sublimation equipment. This patent includes the option of putting a bar code, QR code, manufacturer name, date manufactured or other pertinent informational as part of the decoration or graphic art on the three-dimensional, nonplanar or complex shaped substrate.

At the present time many different types of metal objects have been painted in both solid colors and multi-colors. In addition, these metal objects have been decorated using silk printing, dye/ink sublimation and other methods. Typically, these metal objects are flat and have been used for indoor and/or outdoor sign applications such as the ubiquitous stop sign. For instance, U.S. Pat. No. 8,017,297 B1 discloses a method wherein a substantially planar (planar substrate that is flat or lying in a single geometric plane or a two dimensional substrate having only two dimensions) metal electrically conductive powder coated substrate is sublimated with an image on the surface. After the application and curing of both the powder coat paint and the dye/ink sublimation process, this substantially planar substrate is then shaped into a nonplanar article. This technique has significant drawbacks. The first drawback is that because it is difficult to apply an image to a complex three-dimensional shaped nonplanar article, the substantially planar substrate is first powder coat painted, the sublimated image applied and then it is stated that the painted and decorated planar substrate is formed into the desired shape.

U.S. Pat. No. 8,017,297 does not explain in any detail how both the powder coat paint and the sublimated image will need to stretch and bend in order to achieve the desired nonplanar substrate. The surface paint and sublimated image that is later shaped into a three-dimensional substrate may crack or get paint stretch marks (lighter color paint in the stretched or bend areas of the substrate). Thus, a quality image on a painted and dye sublimated planar substrate which is then shaped into a nonplanar object is very difficult to achieve using this process. No reference in the patent is made to the amount of physical stress (stretching and bending) the paint and dye/ink can handle before it fails and the image quality is compromised. Without unique stretchable/elastic powder paint and sublimation inks there can be significant loss of image quality or image degradation using this process. The second drawback is that it is difficult to provide a consistent quality painted substrate product using this method. Depending on the type and extent of post forming, different types of powder coat paint and dye/inks will be needed to handle the stress induced by the bending and stretching process. How much bending/stretching/forming can be achieved and the particular powder paint and dyes/inks needed to accomplish different types of bending/forming is not addressed in this patent. The third drawback is that this method does not address the paint and dyes/inks needed for outdoor environmental challenges such as UV radiation damage and weather related issues (temperatures both hot and cold, ice, salt, acid rain, etc.). There is a significant difference in the powder coat paints and dyes/inks needed to withstand the harsh outdoor environment. The fourth drawback of this patent is that it does not address the painting and dye/ink sublimation process for non-conductive substrates.

U.S. Pat. No. 6,987,081 B2 discloses a method for painting a metal sheet on which a printed design full of variety is given with a sublimation dye. The patent discusses the thermosetting powder paint and dye/ink sublimation process needed for a metal substrate. In addition, the patent claims textured glass flakes or silica topcoat powder paint that can be used for transfer-printing with a sublimation dye. The topcoat paint layer contains a component selected from a group of UV absorbing agents. The patent has many drawbacks. The first drawback is that the patent provides a paint process for only metal sheets. The second drawback is that the patent does not provide a means or method to paint and apply the sublimated decoration/graphic art to a three-dimensional shaped substrate. The third drawback is that the process to paint and sublimate dyes/inks does not include non-conductive substrates. The fourth drawback is that the patent does not provide the durable paint and/or sublimated dyes/inks needed for a substrate that is designed to be installed flat on the ground. This type of substrate will be required to withstand a very harsh outdoor environment including UV rays, snow, ice, hot, cold, frost, chemicals, graffiti, etc. In addition, the substrate needs to have the durability to withstand extensive foot traffic, motor vehicles, construction vehicles, snow plows, etc.

The final step in the decoration process is once the dye/ink sublimation is completed and the decoration or graphic image is in the top layer of powder coat paint an optional topcoat or protective shield layer may be applied to the substrate. This topcoat or protective shield could be either a liquid or powder coat paint product. The purpose of this final layer of paint is to provide additional protection for the decoration/graphic image from the harsh outdoor environment. This additional paint layer of protection may not be needed due to the durability of the powder coat paint layers. But certain outdoor environments may require additional protection and in those cases this topcoat may be applied. This protective shield coating could be a nano-coating technology paint product. This protective shield coating protection could add additional UV resistance, anti-graffiti, slip resistance, corrosion resistance, wear resistance and non-wetting or dirt repellant protection.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the field of this invention are intended to be within the scope of the following claims.

We claim:

1. A surface mount panel assembly system comprising:

a base plate directly attachable to an existing preformed ground surface, said base plate having a flat upper surface and a plurality of anchor holes therein for securing by anchoring said base plate to said preformed ground surface and a plurality of securement members therein that are offset from said anchor holes, wherein said base plate comprises a material selected from the group consisting of cast iron, ductile iron, steel, aluminum, and alloys thereof; and a removable upper panel having an upper surface comprising a plurality of raised, truncated domes in an attention pattern, said upper panel having a plurality of through holes therein that register with said securement members when said upper panel is placed on said base plate so that said upper panel can be removeably secured to said base plate, and a plurality of anchors insertable through said anchor holes so that said base plate can be secured to said preformed ground surface.

2. The surface mount assembly of claim 1, wherein said plurality of anchors comprise expansion flanges that engage said preformed ground surface.

3. The surface mount assembly of claim 2, wherein said plurality of anchors are nail drive expansion anchors.

4. The surface mount assembly of claim 1, wherein said plurality of anchors are mechanical anchors selected from the group consisting of screw anchors, drop-in anchors and impact anchors.

5. The surface mount assembly of claim 1, wherein said plurality of anchors each comprises a head.

6. The surface mount assembly of claim 5, wherein said removable upper panel comprises a plurality of hollow domes or raised projections that accommodate said heads of said plurality of anchors when said upper panel is attached to said base plate.

7. The surface mount assembly of claim 5, wherein said removable upper panel has a plurality of openings therein that accommodate said heads of said plurality of anchors when said upper panel is attached to said base plate.

8. The surface mount assembly of claim 1, wherein said plurality of through holes have a shape selected from the group consisting of circles, ovals, teardrops, keyholes, oblong holes and combinations thereof.

9. The surface mount assembly of claim 1, wherein said plurality of securement members comprise a shaft and head that project upwardly from said base plate and engage said upper panel through said though holes to releasably secure said upper panel to said base plate.

10. The surface mount assembly of claim 9, wherein said securement members are selected from the group consisting of a stand-off stud and a threaded screw or bolt.

11. The surface mount assembly of claim 1, wherein said securement member further comprises a plurality of receivers on said base plate and a plurality of fasteners that releasably secure said upper panel to said base plate.

12. The surface mount assembly of claim 11, wherein said fasteners are selected from the group consisting of threaded screws, threaded bolts, quick release fasteners, quarter turn fasteners, cam-lock fasteners, and dual lock reclosable fasteners.

13. The surface mount assembly of claim 11, wherein said plurality of receiver members project downwardly from said base plate and said plurality of fasteners engage said receiver members when inserted through said upper panel through holes to releasably secure said upper panel to said base plate.

14. The surface mount assembly of claim 11, wherein said receiver members are threaded receivers and said fasteners are threaded bolts that can be screwed into said threaded receivers.

15. The surface mount assembly of claim 11, wherein said receiver members are quarter turn receivers and said fasteners are quarter turn fasteners that engage said quarter turn receivers.

16. The surface mount assembly of claim 1, wherein said base plate does not include a downwardly projecting perimeter or interior flange.

17. The surface mount assembly of claim 1, wherein said upper panel does not include a downwardly projecting perimeter or interior flange.

18. The surface mount assembly of claim 1, wherein said base plate is mountable so that it is flush with said preformed ground surface.

19. The surface mount assembly of claim 1, wherein said assembly comprises at least two removeable upper panels that are removeably securable to said base plate.

20. The surface mount assembly of claim 1, wherein said assembly comprises at least two base plates.

21. The surface mount assembly of claim 1, wherein said upper panel comprises a graphic display displaying at least two colors.

22. The surface mount assembly of claim 21, wherein said graphic design displays at least three colors.

23. The surface mount assembly of claim 21, wherein said graphic design has a resolution of at least 300×300 dots per inch.

24. The surface mount assembly of claim 1, wherein said upper panel is textured to provide slip resistance and durability.

25. The surface mount assembly of claim 1, wherein said upper panel comprises raised features to provide slip resistance.

26. The surface mount assembly of claim 1, wherein said upper panel comprises an array of raised, truncated domes that are in register with raised, truncated domes on said base plate.

27. The surface mount assembly of claim 1, wherein said upper panel comprises a material selected from the group consisting of metal, polymeric materials, concrete, bricks, natural stone, ceramic, and tile.

28. The surface mount assembly of claim 27, wherein said metal is selected from the group consisting of cast iron, ductile iron, steel, aluminum, and alloys thereof.

29. The surface mount assembly of claim 27, wherein said polymeric material is selected from the group consisting of a plastic, thermoset plastic, thermoplastic, plastic composite, and fiber entrained plastic impregnated with carbon nanotubes, carbon black, or combinations thereof.

30. The surface mount assembly of claim 1, wherein said base plate comprises a graphic display displaying at least two colors.

31. The surface mount assembly of claim 30, wherein said graphic design displays at least three colors.

32. The surface mount assembly of claim 30, wherein said graphic design has a resolution of at least 300×300 dots per inch.

33. The surface mount assembly of claim 1, wherein said base plate is textured to provide slip resistance and durability.

34. The surface mount assembly of claim 1, wherein said base plate comprises raised features to provide slip resistance.

35. The surface mount assembly of claim 1, wherein said base plate comprises an array of raised, truncated domes that are in register with said raised, truncated domes on said upper panel.

36. The surface mount assembly of claim 1, wherein said base plate and said upper panel are flushly secured to as to prevent tripping.

37. The surface mount assembly of claim 1, wherein said upper panel is formed from a plastic composite and comprises a beveled edge that extends past the outer edge of said base plate and has therein an indentation on the underside of said upper panel to accommodate said base plate.

38. A surface mount panel assembly system comprising:

a base plate directly attachable to an existing preformed ground surface, said base plate having a flat upper surface and a plurality of anchor holes therein for securing by anchoring said base plate to said preformed ground surface and a plurality of securement members therein that are offset from said anchor holes; and a removable upper panel having an upper surface comprising a plurality of raised, truncated domes in an attention pattern, said upper panel having a plurality of through holes therein that register with said securement members when said upper panel is placed on said base plate so that said upper panel can be removeably secured to said base plate, wherein said upper panel is formed from a plastic composite and comprises a beveled edge that extends past the outer edge of said base plate and has therein an indentation on the underside of said upper panel to accommodate said base plate; and a plurality of anchors insertable through said anchor holes so that said base plate can be secured to said preformed ground surface.

39. The surface mount assembly of claim 38, wherein said plurality of anchors comprise expansion flanges that engage said preformed ground surface.

40. The surface mount assembly of claim 39, wherein said plurality of anchors are nail drive expansion anchors.

41. The surface mount assembly of claim 38, wherein said plurality of anchors are mechanical anchors selected from the group consisting of screw anchors, drop-in anchors and impact anchors.

42. The surface mount assembly of claim 38, wherein said plurality of anchors each comprises a head.

43. The surface mount assembly of claim 42, wherein said removable upper panel comprises a plurality of hollow domes or raised projections that accommodate said heads of said plurality of anchors when said upper panel is attached to said base plate.

44. The surface mount assembly of claim 42, wherein said removable upper panel has a plurality of openings therein that accommodate said heads of said plurality of anchors when said upper panel is attached to said base plate.

45. The surface mount assembly of claim 38, wherein said plurality of through holes have a shape selected from the group consisting of circles, ovals, teardrops, keyholes, oblong holes and combinations thereof.

46. The surface mount assembly of claim 38, wherein said plurality of securement members comprise a shaft and head that project upwardly from said base plate and engage said upper panel through said though holes to releasably secure said upper panel to said base plate.

47. The surface mount assembly of claim 46, wherein said securement members are selected from the group consisting of a stand-off stud and a threaded screw or bolt.

48. The surface mount assembly of claim 38, wherein said securement member further comprises a plurality of receivers on said base plate and a plurality of fasteners that releasably secure said upper panel to said base plate.

49. The surface mount assembly of claim 48, wherein said fasteners are selected from the group consisting of threaded screws, threaded bolts, quick release fasteners, quarter turn fasteners, cam-lock fasteners, and dual lock reclosable fasteners.

50. The surface mount assembly of claim 48, wherein said plurality of receiver members project downwardly from said base plate and said plurality of fasteners engage said receiver members when inserted through said upper panel through holes to releasably secure said upper panel to said base plate.

51. The surface mount assembly of claim 48, wherein said receiver members are threaded receivers and said fasteners are threaded bolts that can be screwed into said threaded receivers.

52. The surface mount assembly of claim 48, wherein said receiver members are quarter turn receivers and said fasteners are quarter turn fasteners that engage said quarter turn receivers.

53. The surface mount assembly of claim 38, wherein said base plate does not include a downwardly projecting perimeter or interior flange.

54. The surface mount assembly of claim 38, wherein said upper panel does not include a downwardly projecting perimeter or interior flange.

55. The surface mount assembly of claim 38, wherein said base plate is mountable so that it is flush with said preformed ground surface.

56. The surface mount assembly of claim 38, wherein said assembly comprises at least two removeable upper panels that are removeably securable to said base plate.

57. The surface mount assembly of claim 38, wherein said assembly comprises at least two base plates.

58. The surface mount assembly of claim 38, wherein said upper panel comprises a graphic display displaying at least two colors.

59. The surface mount assembly of claim 58, wherein said graphic design displays at least three colors.

60. The surface mount assembly of claim 58, wherein said graphic design has a resolution of at least 300×300 dots per inch.

61. The surface mount assembly of claim 38, wherein said upper panel is textured to provide slip resistance and durability.

62. The surface mount assembly of claim 38, wherein said upper panel comprises raised features to provide slip resistance.

63. The surface mount assembly of claim 38, wherein said upper panel comprises an array of raised, truncated domes that are in register with raised, truncated domes on said base plate.

64. The surface mount assembly of claim 38, wherein said base plate comprises a graphic display displaying at least two colors.

65. The surface mount assembly of claim 64, wherein said graphic design displays at least three colors.

66. The surface mount assembly of claim 64, wherein said graphic design has a resolution of at least 300×300 dots per inch.

67. The surface mount assembly of claim 38, wherein said base plate is textured to provide slip resistance and durability.

68. The surface mount assembly of claim 38, wherein said base plate comprises raised features to provide slip resistance.

69. The surface mount assembly of claim 38, wherein said base plate comprises an array of raised, truncated domes that are in register with said raised, truncated domes on said upper panel.

70. The surface mount assembly of claim 38, wherein said base plate comprises a material selected from the group consisting of metal, polymeric materials, concrete, bricks, natural stone, ceramic, and tile.

71. The surface mount assembly of claim 70, wherein said metal is selected from the group consisting of cast iron, ductile iron, steel, aluminum, and alloys thereof.

72. The surface mount assembly of claim 70, wherein said polymeric material is selected from the group consisting of a plastic, thermoset plastic, thermoplastic, plastic composite, and fiber entrained plastic impregnated with carbon nanotubes, carbon black, or combinations thereof.

73. The surface mount assembly of claim 38, wherein said base plate and said upper panel are flushly secured so as to prevent tripping.

* * * * *